US012416112B2

(12) United States Patent
Lee et al.

(10) Patent No.: US 12,416,112 B2
(45) Date of Patent: Sep. 16, 2025

(54) CLOTHING TREATMENT APPARATUS

(71) Applicant: LG ELECTRONICS INC., Seoul (KR)

(72) Inventors: Yunhi Lee, Seoul (KR); Jaehyun Kim, Seoul (KR); Hyunsun Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 522 days.

(21) Appl. No.: 17/827,260

(22) Filed: May 27, 2022

(65) Prior Publication Data

US 2022/0380958 A1 Dec. 1, 2022

(30) Foreign Application Priority Data

| | | |
|---|---|---|
| May 28, 2021 | (KR) | 10-2021-0069528 |
| Jun. 1, 2021 | (KR) | 10-2021-0071149 |
| Jul. 26, 2021 | (KR) | 10-2021-0097989 |
| Jul. 26, 2021 | (KR) | 10-2021-0097990 |
| Sep. 9, 2021 | (KR) | 10-2021-0120442 |
| Sep. 9, 2021 | (KR) | 10-2021-0120443 |

(51) Int. Cl.

| | |
|---|---|
| ***D06F 29/00*** | (2006.01) |
| ***D06F 34/28*** | (2020.01) |
| *D06F 34/05* | (2020.01) |
| *D06F 34/32* | (2020.01) |
| *D06F 101/00* | (2020.01) |

(52) U.S. Cl.

CPC ..... *D06F 29/005* (2013.01); *D06F 34/28* (2020.02); *D06F 34/05* (2020.02); *D06F 34/32* (2020.02); *D06F 2101/00* (2020.02)

(58) Field of Classification Search

CPC ..... D06F 34/28; D06F 29/005; D06F 2101/00

See application file for complete search history.

(56) References Cited

U.S. PATENT DOCUMENTS

| | | | |
|---|---|---|---|
| 7,320,234 | B2 | 1/2008 | Hershey et al. |
| 2002/0017117 | A1 | 2/2002 | Sunshine et al. |
| 2004/0194339 | A1 | 10/2004 | Johnson et al. |
| 2005/0155393 | A1 | 7/2005 | Wright et al. |
| 2006/0112585 | A1 | 6/2006 | Choi et al. |
| 2006/0137210 | A1 | 6/2006 | Lee et al. |
| 2006/0156765 | A1 | 7/2006 | Sunshine et al. |

(Continued)

FOREIGN PATENT DOCUMENTS

| | | | |
|---|---|---|---|
| CN | 103348053 | A | 10/2013 |
| CN | 104018328 | A | 9/2014 |

(Continued)

*Primary Examiner* — Michael E Barr
*Assistant Examiner* — Kevin G Lee
(74) *Attorney, Agent, or Firm* — Birch, Stewart, Kolasch & Birch, LLP

(57) ABSTRACT

A clothing treatment apparatus including a refresher having a third case disposed at least on one side of a washing machine and a dryer and having an inner space for receiving laundry, and a third door for opening and closing the third case, in which a display is disposed on a front surface of the third door, and displays an operation screen having a plurality of menu buttons for operating the washing machine, the dryer, and the refresher, and arrangement positions of the plurality of menu buttons on the operation screen vary according to a physical arrangement of the washing machine, the dryer and the refresher.

19 Claims, 30 Drawing Sheets

(56) References Cited

U.S. PATENT DOCUMENTS

| | | | | |
|---|---|---|---|---|
| 2007/0119072 | A1* | 5/2007 | Kim | D06F 58/26 34/550 |
| 2007/0151300 | A1 | 7/2007 | Sunshine | |
| 2007/0151301 | A1 | 7/2007 | Kendall et al. | |
| 2007/0169519 | A1 | 7/2007 | Hershey et al. | |
| 2007/0256457 | A1 | 11/2007 | Kendall et al. | |
| 2008/0229515 | A1 | 9/2008 | Hong et al. | |
| 2009/0126421 | A1 | 5/2009 | Kim et al. | |
| 2010/0299976 | A1 | 12/2010 | Roselle et al. | |
| 2011/0132043 | A1 | 6/2011 | Kim | |
| 2011/0185511 | A1 | 8/2011 | Ryoo et al. | |
| 2014/0026433 | A1 | 1/2014 | Bison et al. | |
| 2016/0186374 | A1 | 6/2016 | Ryoo et al. | |
| 2018/0202091 | A1* | 7/2018 | Son | D06F 33/52 |
| 2018/0340285 | A1 | 11/2018 | Chol et al. | |
| 2018/0340288 | A1 | 11/2018 | Kim et al. | |
| 2020/0240065 | A1 | 7/2020 | Underly et al. | |
| 2021/0148029 | A1 | 5/2021 | Lv et al. | |

FOREIGN PATENT DOCUMENTS

| | | | |
|---|---|---|---|
| CN | 105316890 | A | 2/2016 |
| CN | 106032612 | A | 10/2016 |
| CN | 106283485 | A | 1/2017 |
| CN | 108301165 | A | 7/2018 |
| CN | 109582306 | A | 4/2019 |
| CN | 209652609 | U | 11/2019 |
| CN | 209686107 | U | 11/2019 |
| CN | 111996767 | A | 11/2020 |
| DE | 10 2006 015 840 | A1 | 10/2007 |
| DE | 10 2008 006 111 | A1 | 7/2009 |
| DE | 10 2008 064 737 | B3 | 8/2016 |
| EP | 1 029 961 | A2 | 8/2000 |
| EP | 3 940 134 | A1 | 1/2022 |
| JP | 2004-159859 | A | 6/2004 |
| JP | 2008-307151 | A | 12/2008 |
| KR | 10-2005-0066534 | A | 6/2005 |
| KR | 10-2006-0042568 | A | 5/2006 |
| KR | 10-2006-0046802 | A | 5/2006 |
| KR | 10-2006-0060211 | A | 6/2006 |
| KR | 10-0587360 | B1 | 6/2006 |
| KR | 10-2006-0111128 | A | 10/2006 |
| KR | 10-0658842 | B1 | 12/2006 |
| KR | 10-0674718 | B1 | 1/2007 |
| KR | 10-0839519 | B1 | 6/2008 |
| KR | 10-2008-0100964 | A | 11/2008 |
| KR | 10-2010-0025981 | A | 3/2010 |
| KR | 10-2019-0131259 | A | 11/2019 |
| KR | 10-2120993 | B1 | 6/2020 |
| KR | 10-2020-0109194 | A | 9/2020 |
| KR | 10-2200698 | B1 | 1/2021 |
| KR | 10-2254903 | B1 | 5/2021 |
| WO | WO 2007/148894 | A2 | 12/2007 |
| WO | WO2008/066539 | A1 | 6/2008 |
| WO | WO 2011/149320 | A2 | 12/2011 |
| WO | WO 2014/017004 | A1 | 1/2014 |
| WO | WO 2017/119673 | A1 | 7/2017 |
| WO | WO 2019/141063 | A1 | 7/2019 |
| WO | WO 2019/154266 | A1 | 8/2019 |
| WO | WO 2021/083006 | A1 | 5/2021 |

* cited by examiner

CLOTHING TREATMENT APPARATUS

CROSS-REFERENCE TO RELATED APPLICATIONS

This application claims the priority benefit of Korean Patent Application No. 10-2021-0069528, filed on May 28, 2021 in the Republic of Korea, Korean Patent Application No. 10-2021-0071149, filed on Jun. 1, 2021 in the Republic of Korea, Korean Patent Application No. 10-2021-0097989, filed on Jul. 26, 2021 in the Republic of Korea, Korean Patent Application No. 10-2021-0097990, filed on Jul. 26, 2021 in the Republic of Korea, Korean Patent Application No. 10-2021-0120442, filed on Sep. 9, 2021 in the Republic of Korea, and Korean Patent Application No. 10-2021-0120443, filed on Sep. 9, 2021 in the Republic of Korea, all of these applications are incorporated herein by reference in their entireties.

BACKGROUND OF THE DISCLOSURE

1. Field of the Invention

The present disclosure relates to a clothing treatment apparatus, and more particularly to a clothing treatment apparatus including a plurality of clothing treatment machines.

2. Description of the Related Art

Clothing treatment machines, such as washing machines, dryers, and refreshers, are installed in different spaces, such as a kitchen, a utility room, and an outdoor space, according to usage in a residential space.

Korean Laid-Open Patent Publication No. 10-2020-0109194 discloses a washing machine. The washing machine washes laundry by supplying water and detergent into a tub and a drum and by rotating the drum in which the laundry is placed. In the washing machine, water from an external water source is supplied into the tub or the drum, and a pump is used to circulate the water in the tub to the drum or to discharge the water in the tub to the outside. The washing machine is generally installed in the kitchen or in the utility room for the supply and discharge of water.

The washing machine separately includes a heater for heating air, a blower fan, and a steam generator, to dry or sterilize the laundry.

Korean Patent No. 10-2120993 discloses a dryer. The dryer may dry the laundry, placed in the drum, by heating air using a heating means and a blower fan and by supplying the heated air into the drum. The dryer is generally disposed adjacent to the washing machine, to dry the washed laundry and to allow a user to easily load the laundry containing moisture into the dryer.

By using the steam generator for generating steam and spraying the steam into the drum, the dryer may sterilize the laundry or may relieve wrinkles from the laundry. Water may be supplied into the dryer for generating the steam, and water not changed into steam may be reused or may be discharged to the outside. Further, in order to deodorize the dried laundry, the dryer may further have a deodorization function for filtering the circulated air.

Korean Patent No. 10-2254903 discloses a refresher. The refresher may perform functions, such as drying, deodorizing, de-wrinkling, de-static and/or sterilization (hereinafter referred to as "refreshing").

The refresher is used for treating clothes, such as suits and coats, which are frequently used by a user after washing. Generally, the user hangs the clothes, such as suits and coats, in a wardrobe. Accordingly, the refresher may be installed adjacent to the wardrobe, or may be installed instead of the wardrobe, in a dressing room, a living room, or a bedroom. Further, not only for the clothes or garments, the refresher may also be used for all washable items, such as shoes, socks, gloves, hats, scarves, etc., which are worn by users, as well as dolls, towels, blankets, etc., which are frequently used by users.

However, the existing clothing treatment machines, which are installed in different spaces, have a problem in that users need to move the laundry items, which are sorted by the user, to the respective clothing treatment machines performing corresponding clothing treatment processes, thereby requiring a longer workflow, and making the clothing treatment processes uncomfortable.

In addition, as the refresher is installed in a different place from the washing machine and the dryer, it is cumbersome for users to move the washed wet clothes or the dried clothes to the place where the refresher is installed.

Further, in the existing clothing treatment machines, it is inconvenient because users need to directly operate control panels provided for each of the existing clothing treatment machines.

Recently, the clothing treatment machines having communication modules may be registered with manufacturers and service providers to receive various functions and services, but it is cumbersome for users to separately register each of the clothing treatment machines.

Furthermore, each of the existing clothing treatment machines that perform clothing treatment using hot air and steam separately requires its own water supply equipment, drainage equipment, an air heater, a steam generator, a pump, a blower fan, an air passage, a steam passage, etc., thereby causing a problem in that a space for receiving clothes is reduced. In addition, each of the machines includes its own heater, its own steam generator, or drainage system etc., causing a problem in that costs and energy consumption of the entire system may increase. For instance, existing clothing treatment machines lack integration, lack support for different configurations and different arrangements, and often require individual operation units and separate systems even when performing similar functions without the ability to share resources or components resulting in redundancies, added expense and waste.

SUMMARY OF THE DISCLOSURE

It is an object of the present disclosure to solve the above and other problems.

It is another object of the present disclosure to provide a clothing treatment apparatus including a plurality of clothing treatment machines.

It is yet another object of the present disclosure to provide a clothing treatment apparatus including a washing machine, a dryer, and a refresher.

It is still another object of the present disclosure to provide a clothing treatment apparatus capable of performing washing, drying, and refreshing of clothing in the same space.

It is still another object of the present disclosure to provide a clothing treatment apparatus capable of minimizing a user's workflow required for clothing treatment.

It is still another object of the present disclosure to provide a clothing treatment apparatus with improved workability in washing, drying, and refreshing processes of clothing.

It is still another object of the present disclosure to provide a clothing treatment apparatus capable of improving user convenience in operating components, such as a door, a control panel, etc., which require operation by a user.

It is still another object of the present disclosure to provide a clothing treatment apparatus, in which any one of the clothing treatment machines may communicate with an external device, such as a server, a mobile terminal, etc., and may transmit various signals, such as a control command, information, etc., to other clothing treatment machines.

It is still another object of the present disclosure to provide a clothing treatment apparatus, in which any one of the clothing treatment machines may function as a wireless router, such that even when a wireless router of an external network is turned off, services may be provided using a mobile terminal and the like.

It is still another object of the present disclosure to provide a clothing treatment apparatus capable of integrating communications and operations of the clothing treatment machines, thereby improving user convenience.

It is still another object of the present disclosure to provide a clothing treatment apparatus, in which operation panels may be integrated, and integrated management of the respective clothing treatment machines may be provided by using an application and the like.

It is still another object of the present disclosure to provide a clothing treatment apparatus, in which information visibility may be improved, and information on the overall product operation may be easily identified.

It is still another object of the present disclosure to provide a clothing treatment apparatus capable of providing a communication connection structure which allows for easy connection and installation of the clothing treatment machines.

It is still another object of the present disclosure to provide a clothing treatment apparatus capable of providing an intuitive user experience according to the arrangement of the clothing treatment machines, even when positions of the various clothing treatment machines are changed, rearranged or configured in different orientations.

It is still another object of the present disclosure to provide a clothing treatment apparatus capable of automatically sensing the arrangement of the clothing treatment machines.

The objects of the present disclosure are not limited to the aforementioned objects and other objects not described herein will be clearly understood by those skilled in the art from the following description.

In order to achieve the above objects, there is provided a clothing treatment apparatus including two or more clothing treatment machines that perform different functions.

In order to achieve the above objects, there is provided a clothing treatment apparatus including clothing treatment machines which may share some of the components, such as a shared display or a shared heater or drainage system, etc.

In order to achieve the above objects, there is provided a clothing treatment apparatus including clothing treatment machines which may communicate with each other to transmit and receive signals.

In order to achieve the above objects, there is provided a clothing treatment apparatus capable of providing integrated operation of clothing treatment machines in a simple and convenient manner.

In order to achieve the above objects, there is provided a clothing treatment apparatus capable of providing clothing treatment machines in various arrangements, and providing user experience according to the arrangements.

In accordance with an aspect of the present disclosure, the above and other objects can be accomplished by providing a clothing treatment apparatus including: a washing machine including a first case having a first laundry loading opening, a first door for opening and closing the first case, a tub disposed in the first case, and a first drum which is rotatably mounted in the tub and in which laundry is placed; a dryer including a second case vertically disposed with respect to the first case and having a second laundry loading opening, a second door for opening and closing the second case, and a second drum which is rotatably mounted in the second case and in which laundry is placed; and a refresher including a third case disposed at least on one side of the washing machine and the dryer and having an inner space for receiving laundry, and a third door for opening and closing the third case, in which a display is disposed on a front surface of the third door, and displays an operation screen having a plurality of menu buttons for operating the washing machine, the dryer, and the refresher, in which arrangement positions of the plurality of menu buttons on the operation screen vary according to arrangement of the washing machine, the dryer, and the refresher.

Each of the washing machine, the dryer, and the refresher may include a position sensor for sensing other adjacent clothing treatment machines, in which the arrangement positions of the plurality of menu buttons may be automatically changed based on data sensed by the position sensors.

The refresher may include a first position sensor disposed on a left side thereof and a second position sensor disposed on a right side thereof, the first position sensor and the second position sensor being disposed at different heights, in which each of the washing machine and the dryer may include side panels forming a left side and a right side, in which an object to be sensed, which is sensed by the first and second position sensors, is disposed on the left and right side panels.

A distance between the first position sensor and the second position sensor may be equal to a distance between the object to be sensed, which is disposed on the washing machine, and the object to be sensed which is disposed on the dryer.

Each of the washing machine and the dryer may include an upper panel forming an upper surface and a lower panel forming a lower surface, in which: the position sensor may be disposed on the upper panel; and the object to be sensed, which is sensed by the position sensors, may be disposed on the lower panel.

The operation screen may include a washing machine display area in which menu buttons for operating the washing machine are provided, a dryer display area in which menu buttons for operating the dryer are provided, and a refresher display area in which menu buttons for operating the refresher are provided, in which arrangements of the washing machine display area, the dryer display area, and the refresher display area may be identical to or spatially match an arrangement of the washing machine, the dryer, and the refresher (e.g., if the refresher is attached to the left side of the washer and dryer machines, then the display can include buttons or a user interface corresponding to the refresher on a left side of the display, and buttons or a user interface corresponding to the washer and dryer machines on a right side of the display).

In response to an input to the washing machine, the dryer, or the refresher, the display may change brightness of a display area corresponding to the input, among the washing machine display area, the dryer display area, and the refresher display area.

In response to an input to the washing machine, the dryer, or the refresher, an internal LED provided for the washing machine, the dryer, or the refresher may be turned on.

In response to an input to the washing machine, the dryer, or the refresher, the display may display only a display area corresponding to the input, among the washing machine display area, the dryer display area, and the refresher display area.

In response to an input to the washing machine, the dryer, or the refresher, the display may enlarge only a display area corresponding to the input, among the washing machine display area, the dryer display area, and the refresher display area.

The clothing treatment apparatus may further include a control panel disposed between the washing machine and the dryer.

Each of the washing machine, the dryer, and the refresher may include one or more communication modules to communicate with each other by wire or wirelessly, in which one or more of the washing machine, the dryer, and the refresher may wirelessly communicate with an external device.

Each of the washing machine, the dryer, and the refresher may include one or more communication modules to communicate with each other, in which any one clothing treatment machine among the washing machine, the dryer, and the refresher may include a representative communication module for wireless communication with the external device according to a first communication method, in which the clothing treatment machines, other than the representative clothing treatment machine including the representative communication module, may communicate with the representative clothing treatment machine by using the first communication method or a second communication method which is different from the first communication method.

At least one of the washing machine, the dryer, and the refresher may function as a wireless router.

The clothing treatment apparatus may further include a heating device for heating air, in which the heated air may be supplied to one or more of the washing machine, the dryer, and the refresher.

The clothing treatment apparatus may further include a machine room forming a space in which the heating device is disposed, in which the machine room may be disposed between the first drum and the second drum.

The clothing treatment apparatus may further include a machine room forming a space in which the heating device is disposed, in which the machine room may be disposed under the washing machine or the dryer.

Any one clothing treatment machine among the washing machine, the dryer, the refresher, and the heating device may include a representative communication module for wireless communication with an external device according to a first communication method, in which the clothing treatment machines, other than the representative clothing treatment machine including the representative communication module, may communicate with the representative clothing treatment machine by using the first communication method or a second communication method which is different from the first communication method.

In accordance with another aspect of the present disclosure, the above and other objects can be accomplished by providing a clothing treatment apparatus including: a washing machine including a first case having a first laundry loading opening, a first door for opening and closing the first case, a tub disposed in the first case, and a first drum which is rotatably mounted in the tub and in which laundry is placed; a dryer including a second case vertically disposed with respect to the first case and having a second laundry loading opening, a second door for opening and closing the second case, and a second drum which is rotatably mounted in the second case and in which laundry is placed; a refresher including a third case disposed at least on one side of the washing machine and the dryer and having an inner space for receiving laundry, and a third door for opening and closing the third case; and a control panel displaying an operation screen having a plurality of menu buttons for operating the washing machine, the dryer, and the refresher, in which arrangement positions of the plurality of menu buttons on the operation screen vary according to arrangement of the washing machine, the dryer, and the refresher.

Each of the washing machine, the dryer, and the refresher may include a position sensor for sensing other adjacent clothing treatment machines, in which the arrangement positions of the plurality of menu buttons may be automatically changed or updated based on data sensed by the position sensors.

The operation screen may include a washing machine display area in which menu buttons for operating the washing machine are provided, a dryer display area in which menu buttons for operating the dryer are provided, and a refresher display area in which menu buttons for operating the refresher are provided, in which arrangement of the washing machine display area, the dryer display area, and the refresher display area may be identical to or spatially match an arrangement of the washing machine, the dryer, and the refresher.

In response to an input to the washing machine, the dryer, or the refresher, the display may change brightness of a display area corresponding to the input, among the washing machine display area, the dryer display area, and the refresher display area.

Each of the washing machine, the dryer, and the refresher may include one or more communication modules to communicate with each other, in which any one clothing treatment machine among the washing machine, the dryer, and the refresher may include a representative communication module for wireless communication with the external device according to a first communication method, in which the clothing treatment machines, other than the representative clothing treatment machine including the representative communication module, may communicate with the representative clothing treatment machine by using the first communication method or a second communication method which is different from the first communication method.

The clothing treatment apparatus may further include a heating device for heating air supplied to one or more of the washing machine, the dryer, and the refresher, in which the heated air may be supplied to at least one of the washing machine, the dryer, and the refresher.

Any one clothing treatment machine among the washing machine, the dryer, the refresher, and the heating device may include a representative communication module for wireless communication with an external device according to a first communication method, in which the clothing treatment machines, other than the representative clothing treatment machine including the representative communication module, may communicate with the representative clothing treatment machine by using the first communication method or a second communication method which is different from the first communication method.

Other detailed matters of the example embodiments are included in the detailed description and the drawings.

According to at least one of the embodiments of the present disclosure, there is provided a clothing treatment apparatus including a plurality of clothing treating machines.

According to at least one of the embodiments of the present disclosure, there is provided a clothing treatment apparatus including a washing machine, a dryer, and a refresher.

According to at least one of the embodiments of the present disclosure, there is provided a clothing treating apparatus, in which the washing machine, the dryer, and the refresher are disposed in the same space, thereby performing washing, drying, and refreshing in the same space.

According to at least one of the embodiments of the present disclosure, there is provided a clothing treatment apparatus capable of treating clothing in the same space regardless of the type of clothing.

According to at least one of the embodiments of the present disclosure, there is provided a clothing treating apparatus, in which when washing, drying, and refreshing processes are performed, a user's load (e.g., amount of work, workflow, etc.) for moving clothing items may be reduced.

According to at least one of the embodiments of the present disclosure, there is provided a clothing treatment apparatus in which the clothing treatment machines may communicate with each other, such that the clothing treatment machines may be easily used and managed, and resources or components can be shared among the clothing treatment machines.

According to at least one of the embodiments of the present disclosure, there is provided a clothing treating apparatus, in which any one of the clothing treatment machines may communicate with an external device, such as a server, a mobile terminal, etc., and may transmit various signals, such as a control command, information, etc., to other clothing treating machines, such that the clothing treatment apparatus may be provided with a low cost.

According to at least one of the embodiments of the present disclosure, there is provided a clothing treating apparatus, in which any one of the clothing treatment machines may function as a wireless router, such that even when a wireless router of an external network is turned off, services may be provided using a mobile terminal and the like.

According to at least one of the embodiments of the present disclosure, there is provided a clothing treatment apparatus capable of integrating communications and operations of the clothing treating machines, thereby improving user convenience.

According to at least one of the embodiments of the present disclosure, there is provided a clothing treating apparatus, in which operation panels may be integrated, and integrated management of the respective clothing treatment machines may be provided by using an application and the like.

According to at least one of the embodiments of the present disclosure, there is provided a clothing treating apparatus, in which information visibility may be improved, and information on the overall product operation may be easily identified.

According to at least one of the embodiments of the present disclosure, there is provided a clothing treatment apparatus capable of providing a communication connection structure which allows for easy connection and installation of the clothing treating machines, and easy reconfiguration and modular updates.

According to at least one of the embodiments of the present disclosure, there is provided a clothing treatment apparatus capable of providing an intuitive user experience according to the arrangement of the clothing treating machines.

According to at least one of the embodiments of the present disclosure, there is provided a clothing treatment apparatus capable of automatically sensing the arrangement of the clothing treating machines.

The effects of the present disclosure are not limited to the aforesaid examples, and other effects not described herein will be clearly understood by those skilled in the art from the following description of the appended claims.

Further scope of applicability of the present disclosure will become apparent from the detailed description given hereinafter. However, it should be understood that the detailed description and specific examples are given by illustration only, since various changes and modifications within the spirit and scope of the present disclosure will become apparent to those skilled in the art from this detailed description.

DETAILED DESCRIPTION OF THE EMBODIMENTS

Figure 1:
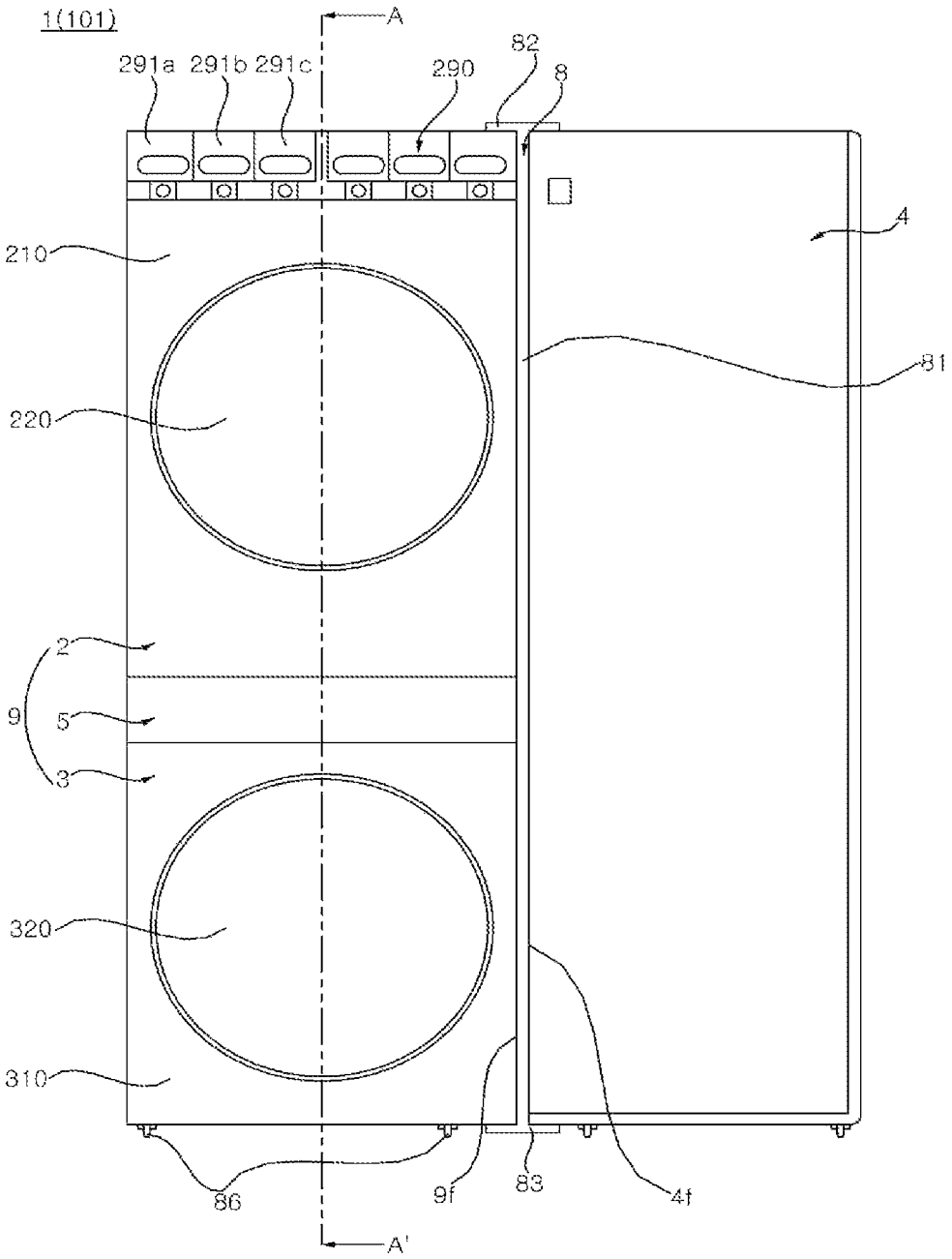
FIG. 1 is a front view of a clothing treatment apparatus according to an embodiment of the present disclosure.

Hereinafter, the present disclosure will be described in detail with reference to the accompanying drawings, in which the same reference numerals are used throughout the drawings to designate the same or similar components, and a redundant description thereof will be omitted.

Terms "module" and "unit" for elements used in the following description are given simply in view of the ease of the description, and do not have a distinguishing meaning or role.

It will be noted that a detailed description of known arts will be omitted if it is determined that the detailed description of the known arts can obscure the embodiments of the invention. Further, the accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that, although the terms first, second, etc., may be used herein to describe various elements, these elements should not be limited by these terms. These terms are only used to distinguish one element from another.

It will be understood that when an element is referred to as being "connected" or "coupled" to another element, it can be directly connected or coupled to the other element or intervening elements can be present. In contrast, when an element is referred to as being "directly connected" or "directly coupled" to another element, there are no intervening elements present.

As used herein, the singular forms are intended to include the plural forms as well, unless the context clearly indicates otherwise.

An inventive concept shared by embodiments of the present disclosure, common components for implementing the inventive concept, and a relationship between the common components will be described below with reference to FIGS. 1 to 7.

A clothing treatment apparatus 1 according to embodiments of the present disclosure includes one or more clothing treatment machines. The clothing treatment machines refer to devices for washing, drying, and/or refreshing objects (e.g., clothing, towels, bedding, etc.)

The clothing treatment apparatus 1 can include a plurality of clothing treatment machines of the same type. For example, the clothing treatment apparatus 1 can include two or more washing machines 2. For example, the clothing treatment apparatus 1 can include two or more dryers 3. For example, the clothing treatment apparatus 1 can include two or more refreshers 4.

The clothing treatment apparatus 1 can include different types of clothing treatment machines. For example, the clothing treatment apparatus 1 can include the washing machine 2, the dryer 3, and the refresher 4.

The clothing treatment apparatus 1 can include a plurality of clothing treatment machines of the same type, and clothing treatment machines which are of different types. For example, the clothing treatment apparatus can include two or more washing machines, one dryer, and one refresher. For example, the clothing treatment apparatus can include one washing machine, one dryer, and two or more refreshers.

The clothing treatment apparatus 1 of the present disclosure is not limited to the type and number of the clothing treatment machines and can include various combinations thereof. Hereinafter, the clothing treatment apparatus 1 including one washing machine 2, one dryer 1, and one refresher 3 will be described as an example, but the present disclosure is not limited thereto.

The washing machine 2, the dryer 1, and the refresher 3 can be referred to as any one of first to third clothing treatment machines, respectively. For example, the washing machine 2 can be referred to as the "first clothing treatment machine," the dryer 3 can be referred to as the "second clothing treatment machine," and the refresher 4 can be referred to as the "third clothing treatment machine."

The washing machine 2 and the dryer 1 can be vertically disposed. A control panel 5 can be disposed between the washing machine 2 and the dryer 3. The control panel 5 and the refresher 4 can be vertically disposed.

The clothing treatment apparatus 1 can include a controller 690 for controlling operation of the washing machine 2, the dryer 1, the refresher 4, and a heating device 6. The controller 690 can be mounted on a Printed Circuit Board (PCB). The controller 690 can control the washing machine 2, the dryer 1, the refresher 4, and the heating device 6 based on an electrical signal received from the control panel 5 which will be described later. The controller 690 can communicate with the control panel 5.

The washing machine 2 and the dryer 1 can be vertically disposed. A control panel 5 can be disposed between the washing machine 2 and the dryer 3. The control panel 5 and the refresher 4 can be vertically disposed.

A user can input a command to the clothing treatment apparatus 1 through the control panel 5. By operating the control panel 5, the user can control the operations of the washing machine 2, the dryer 3, and the refresher 4. By operating the control panel 5, the user can control the operation of the heating device 6. The control panel 5 can transmit an electrical signal, input by the user's operation, to the controller 690.

A space for providing the PCB can be formed in the control panel 5. The controller 690 can be mounted on the PCB.

Alternatively, the controller 690 can be disposed on a rear surface of the control panel 5. The space, in which the PCB is mounted, can be formed on the rear surface of the control panel 5. The controller 690 can be mounted on the PCB.

Alternatively, at least some of the washing machine 2, the dryer 3, the refresher 4, and a machine room S (see 6*s* of FIG. 2) can include respective controllers for controlling each operation thereof. Even in this situation, the respective controllers can be mounted on the PCB. The respective controllers can communicate with each other. In some situations, at least one controller can be an upper level controller (e.g., a master controller) that can control other controllers and devices (e.g., slave devices). The electrical signal, input by the user's operation, can be transmitted to the controller 690.

A space for providing the PCB can be formed in the control panel 5. The controller 690 can be mounted on the PCB.

Alternatively, the controller 690 can be disposed on a rear surface of the control panel 5. The space, in which the PCB is mounted, can be formed on the rear surface of the control panel 5. The controller 690 can be mounted on the PCB.

Alternatively, at least some of the washing machine 2, the dryer 3, the refresher 4, and a machine room S (see 6*s* of FIG. 2) can include respective controllers for controlling each operation thereof. Even in this situation, the respective controllers can be mounted on the PCB. The respective controllers can communicate with each other. In some situations, at least one controller can be an upper level controller that can control other controllers and devices.

The control panel 5 can display an operating state of the clothing treatment apparatus 1. The user can check and view information on the operating state of the clothing treatment apparatus 1 through the control panel 5.

The clothing treatment apparatus 1 can include the heating device 6. The heating device 6 can supply hot air to the dryer 3. The heating device 50 can also supply hot air to the refresher 4. The heating device 6 can also supply hot air to the washing machine 2. The hot air, supplied to the respective clothing treatment machines, can be drawn into the heating device 6 again for circulation. For example, the same heating device 6 can be used to route hot air to any of the dryer 6, the washing machine 2 and the refresher 4. In this way, the different clothing treatment machines can all share the same heating device, thereby reducing space, saving energy and minimizing costs.

The clothing treatment apparatus 1 can include the machine room 6*s*. The machine room 6*s* can provide a space in which the heating device 6 is disposed. The machine room 6*s* can be a concept that refers to a space in which the heating device 6 and other components are disposed. In addition to the heating device 6, a pump, a blower fan, an air passage, a steam device, a stream passage, a dehumidification device, a controller, a motor, a fan housing, and the like can be disposed in the machine room 6*s*.

In the present disclosure, the machine room 6*s* can refer to the space in which the heating device 6 is disposed, or can be an upper concept that encompasses the heating device 6.

The machine room 6*s* can include a separate case. When the machine room 6*s* includes its own separate case, the machine room 6*s* can be separated from a first cabinet 210 and a second cabinet 310. Alternatively, the machine room 6*s* can be disposed inside any one of first, second and third cabinets 210, 310, and 410. In the situation where the machine room 6*s* is disposed in any one of the first to third cabinets 210, 310, and 410, the machine room 6*s* can be a concept that refers to a space or area in which various components including the heating device 6 are disposed. That is, in the situation where the machine room 6*s* is disposed in any one of the first to third cabinets 210, 310, and 410, the machine room 6*s* can refer to a part or portion of the inner space within the first to third cabinets 210, 310, and 410.

The machine room 6*s* can be vertically disposed with respect to the washing machine 2 and the dryer 1. The machine room 6*s* can be disposed over or on top of the washing machine 2 and the dryer 1. The machine room 6*s* can be disposed between the washing machine 2 and the dryer 1. The machine room S can be disposed under the washing machine 2 and the dryer 1. Alternatively, the machine room 6*s* and the refresher 4 can be vertically disposed. The machine room 6*s* can be disposed inside of, over or under the refresher 3.

The heating device 6 can supply hot air to the washing machine 2. Also, the heating device 6 can recover the hot air supplied to the washing machine 2.

The heating device 50 can supply hot air to the dryer 3. Also, the heating device 6 can recover the hot air supplied to the dryer 3.

The heating device 6 can supply hot air to the refresher 4. Also, the heating device 6 can recover the hot air supplied to the refresher 4. Thus, the heating device 6 can recirculate hot air from any of the washing machine 2, refresher 4 and dryer 3, and redistribute and reroute the hot air to the other clothing treatment machines.

The heating device 6 can supply steam to the washing machine 2. The heating device 6 can supply steam to the dryer 3. The heating device 6 can supply steam to the refresher 4. For example, heating device 6 can be shared by the washing machine 2, the dryer 3 and the refresher 4, and can provide steam or hot air to all of the clothing treatment machines.

The heating device 6 can include a heat pump device. The heat pump device can include a compressor 620, a condenser 630, an evaporator 650, and an expansion device 660. The heating device 6 can include a fan 640. The heat pump device can be referred to as a "heat exchange unit" or a "heat exchanger."

The heating device 6 can include a heat exchange unit for heating air flowing through a supply passage 62 and a return passage 64. The heat exchange unit can be a heating device, such as a heat pump device or a heater.

The heating device 6 can be vertically disposed with respect to the washing machine 2, and the dryer 1. The heating device 6 can be disposed over the washing machine 2 and the dryer 3, can be disposed between the washing machine 2 and the dryer 3, or can be disposed under the washing machine 2 and the dryer 3, or inside of one or more of the washing machine 2 and the dryer 3.

The heating device 6 and the refresher 4 can be vertically disposed. The heating device 6 can be disposed in a rear space of the refresher 4.

A clothing treatment unit 9 can be a concept that encompasses the washing machine 2, the dryer 3, the control panel 5, and the heating device 6. The washing machine 2, the dryer 3, the control panel 5, and the heating device 6 can be vertically disposed to form the clothing treatment unit 9. The clothing treatment unit 9 can include a detergent supply device 290. However, depending on placement of the detergent supply device 290 and arrangement positions of the control panel 5 and the heating device 6, the clothing treatment unit 9 can include only the washing machine 2 and the dryer 3.

Figure 2:
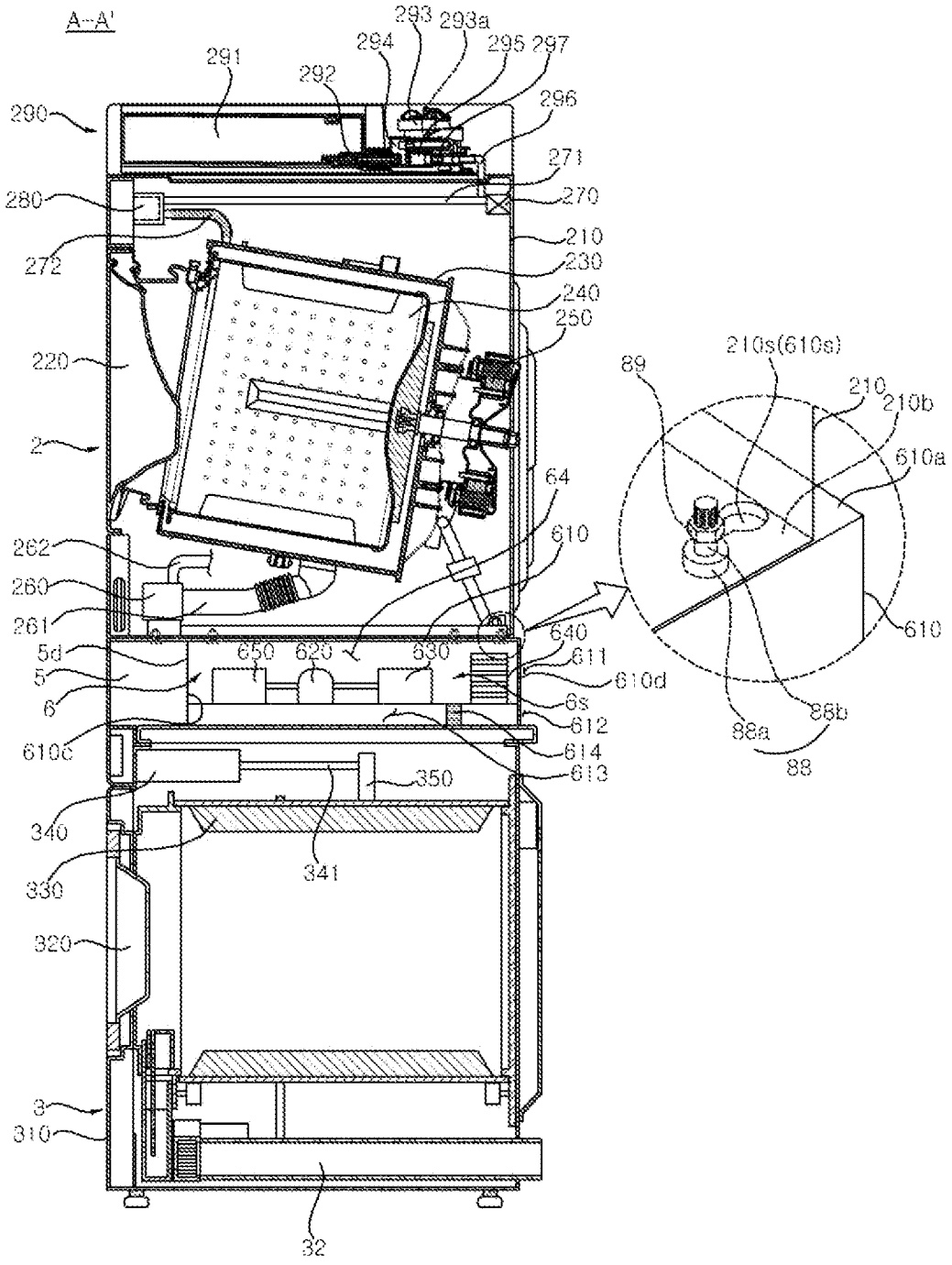
FIG. 2 is a cross-sectional view of a clothing treatment apparatus of FIG. 1, taken along line A-A' according to an embodiment of the present disclosure.

Referring to FIGS. 1 and 2, the components 2, 3, 5, 6, and 290 included in the clothing treatment unit 9 can be connected to each other by fastening members 88 and 89. The following description will be given using a connection structure of the washing machine 2 and the heating device 6 as an example. The description of the connection structure of the washing machine 2 and the heating device 6 can also be applied to connection structures of the components 2, 3, 5, 6, and 290 included in the clothing treatment unit 9. That is, the connection structures via the fastening members 88 and 89 can be applied to the connection structures between adjacent components 2, 3, 5, 6, and 290, regardless of the order of vertical arrangement of the respective components 2, 3, 5, 6, and 290.

A first case 210 of the washing machine 2 can have a first fastening hole 210*s* which is vertically open. A heating device case 610 of the heating device 6 can have a second fastening hole 610*s* which is vertically open. In the situation where the washing machine 2 is disposed over the heating device 6, the first fastening hole 210*s* can be formed in a lower panel 210*b* of the washing machine 2, and the second fastening hole 610*s* can be formed in an upper panel 610*a* of the heating device 6. The first fastening hole 210*s* and the second fastening hole 610*s* can communicate with each other.

The fastening members 88 and 89 can include a first fastening member 88, passing through the first fastening hole 210*s* and the second fastening hole 610*s*, and a second fastening member 89 fixed to the first fastening member 88. The first fastening member 88 can be a bolt having a screw thread, and the second fastening member 89 can be a nut engaged with the screw thread. However, the connection structure of the clothing treatment unit 9 is not limited to the above fastening structure with the bolt and nut, and various fastening methods can be used for coupling the cases of the respective components 2, 3, 5, 6, and 290.

The first fastening member 88 can include a head 88*a* having an outer diameter greater than diameters of the first fastening hole 210*s* and the second fastening hole 610*s*, and a leg 88*b* extending vertically from the head 88*a*. The leg 88*b* can pass through the first fastening hole 210*s* and the second fastening hole 610*s* and can have a screw thread. The second fastening member 89 can have an outer diameter greater than the diameters of the first fastening hole 210*s* and the second fastening hole 610*s*. The second fastening member 89 can be engaged with the screw thread formed on the leg 88*b*. When the first fastening member 88 and the second fastening member 89 are coupled to each other, the lower panel 210*b* of the washing machine 2 and the upper panel 610*a* of the heating device 6 can be disposed between the head 88*a* and the second fastening member 89. The case 210 of the washing machine 2 and the case 610 of the heating device 6 can be fixed by coupling the first fastening member 88 and the second fastening member 89. For example, the clothing treatment unit 9 can have a modular design, in which various clothing treatment machines (e.g., dryer, washer, refresher, heating device, etc.) can be configured in different arrangements and individual units can be swapped in or out and replaced (e.g., a user can retain the dryer and refresher within the overall treatment unit, but selectively replace the washer with a newer model, and vice-versa, as desired or according to an as needed basis). Accordingly, the clothing treatment unit 9 according to embodiments can provide a user with much more versatility and longevity, while also reducing manufacturing costs and saving energy.

Both sides of each of the washing machine 2, the dryer 3, the control panel 5, and the heating device 6 included in the clothing treatment unit 9 can be disposed on the same plane.

A lower surface of the clothing treatment unit 9 can be any one of a lower surface of the washing machine 2, a lower surface of the dryer 3, and a lower surface of the heating device 6, depending on the order of vertical arrangement of the washing machine 2, the dryer 3, and the heating device 6.

An upper surface of the clothing treatment unit 9 can be any one of an upper surface of the washing machine 2, an upper surface of the dryer 3, and an upper surface of the heating device 6, depending on the order of vertical arrangement of the washing machine 2, the dryer 3, and the heating device 6.

The refresher 4 can be disposed on one side of the clothing treatment unit 9. The refresher 4 can be spaced from one side of the clothing treatment unit 9, and one side surface 4*f* of the refresher 4 can come into contact with one side surface 9*f* of the clothing treatment unit 9.

The clothing treatment unit 9 can be referred to as a "first unit," and the refresher 4 can be referred to as a "second unit." For example, the refresher (e.g., second unit) can be configured on either side of the stacked washer/dryer combination (e.g., first unit).

A height of the refresher 4 can be equal to a height of the clothing treatment unit 9. The lower surface of the refresher 4 can be disposed on the same plane as the lower surface of the clothing treatment unit 9, and the upper surface of the refresher 4 can be disposed on the same plane as the upper surface of the clothing treatment unit 9.

A plate 8 can be disposed between the clothing treatment unit 9 and the refresher 4. The plate 8 can come into contact with the one side surface 9*f* of the clothing treatment unit 9 and the one side surface 4*f* of the refresher 4.

Figure 3:
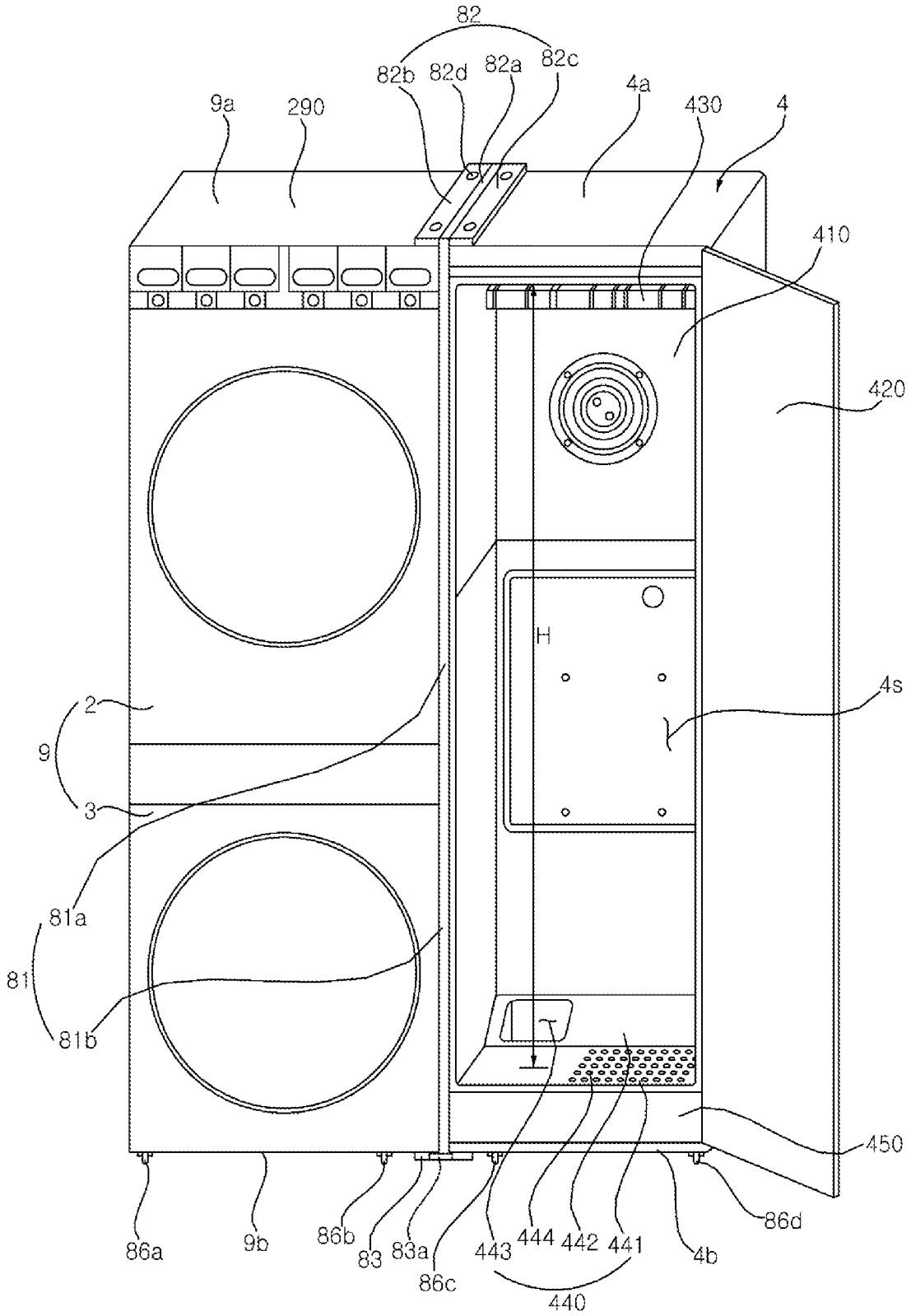
FIG. 3 is a perspective view of a clothing treatment apparatus according to an embodiment of the present disclosure.

Referring to FIGS. 1 to 3, the plate 8 can connect the clothing treatment unit 9 and the refresher 4 with each other. The plate 8 can connect and fix the clothing treatment unit 9 and the refresher 4 regardless of the order of vertical arrangement of the components 2, 3, 5, 6, and 290 included in the clothing treatment unit 9. The connecting structure between the clothing treatment unit 9 and the refresher 4 via the plate 8 can also be applied to all the embodiments of the present disclosure.

The plate 8 can include a first plate 81 disposed between the clothing treatment unit 9 and the refresher 4. The first plate 81 can reduce vibrations generated between the clothing treatment unit 9 and the refresher 4.

When the drum 240 of the washing machine 2 rotates, a tub 230 can vibrate. The washing machine 2 can be shaken due to the rotation of the drum 240 and the vibration of the tub 230. In the clothing treatment apparatus 1 according to the embodiments of the present disclosure, the refresher 4 is disposed on one side of the clothing treatment unit 9, and the clothing treatment unit 9 and the refresher 4 can be fixed to each other by a block 8. Accordingly, the entire transverse width of the clothing treatment apparatus 1 can be greater than a transverse width of the washing machine 2, thereby preventing rocking of the washing machine 2.

The first plate 81 can extend vertically and can be disposed between the washing machine 2 and the refresher 4 and between the dryer 3 and the refresher 4. The first plate 81 can include a second plate 81*a* disposed between the washing machine 2 and the refresher 4, and a third plate 81*b* disposed between the dryer 3 and the refresher 4. The second plate 81*a* and the third plate 81*b* can be separated from each other or can be integrally formed with each other. Without the third plate 81*b*, only the second plate 81*a* can be disposed between the clothing treatment unit 9 and the refresher 4. The first plate 81 can come into contact with the one side surface 9*f* of the clothing treatment unit 9 and the one side surface 4*f* of the refresher 4, or can be coupled thereto via a predetermined fastening member. The first plate 81 can be adhered to the one side surface 9*f* of the clothing treatment unit 9 and the one side surface 4*f* of the refresher 4 with an adhesive agent.

When the drum 240 rotates and the tub vibrates, the first case 210 of the washing machine 2 can vibrate. During rinsing and spin-drying cycles, a first drum 240 of the washing machine 2 can rotate at a high speed. For example, the first drum 240 can rotate at 100 rpm or higher. The first drum 240 of the washing machine 2 can rotate at a relatively higher speed than a second drum 330 of the dryer 3.

Even when the washing machine 2 and the refresher 4 are fixed to each other, the first case 210 can also rock. As the first case 210 facing the one side surface of the refresher 4 rocks, the first case 210 of the washing machine 2 can collide with the third case 410 of the refresher 4, thereby causing vibrations and noise in the entire clothing treatment apparatus 1.

The first plate 81 can include a damping material. The second plate 81*a* can be a damping material. The second plate 81*a* disposed between the washing machine 2 and the refresher 4 can prevent rocking of the first case 210, thereby preventing collisions between the first case 210 and the refresher 4 even when the first case 210 rocks.

The plate 8 can include an upper mount 82 disposed on an upper side of the first plate 81, and a lower mount 83 disposed on a lower side of the first plate 81. The first plate 81, the upper mount 82, and the lower mount 83 can be separated from each other or can be integrally formed with each other.

The upper mount 82 can be coupled to an upper panel 9*a* of the clothing treatment unit 9 and an upper panel 4*a* of the refresher 4. The upper panel 9*a* of the clothing treatment unit 9 can be any one of an upper panel of a detergent supply device 29, an upper panel 310*a* of the dryer 3, and the upper panel 610*a* of the heating device 6, depending on the order of vertical arrangement of the washing machine 2, the dryer 3, and the heating device 6.

The upper mount 82 includes a first upper mount 82*a* connected to the first plate 81, a second upper mount 82*b* extending from the first upper mount 82*a* toward the clothing treatment unit 9, and a third upper mount 82*c* extending from the first upper mount 82*a* toward the refresher 4. The second upper mount 82*b* can be coupled to the upper panel 9*a* of the clothing treatment unit 9. The third upper mount 82*c* can be coupled to the upper panel 4*a* of the refresher 4. The upper mount 82 can include a coupling member 82*d* for fixing the second upper mount 82*b* and the third upper mount 82*c* to the clothing treatment unit 9 and the refresher 4, respectively. The coupling member 82*d* can pass through the upper mount 82 and the upper panels 9*a* and 4*a*, to couple the upper mount 82 and the upper panels 9*a* and 4*a*. The coupling member 82*d* can be disposed between the upper mount 82 and the upper panels 9*a* and 4*a*, to be attached to each of the upper mount 82 and the upper panels 9*a* and 4*a*.

The lower mount 83 can be symmetrical to the upper mount 82 with respect to the first plate 81. The lower mount 83 can be coupled to a lower panel 9*b* of the clothing treatment unit 9 and a lower panel 4*b* of the refresher 4. A coupling structure of the lower mount 83 and the lower panels 9*b* and 4*b* can be the same as the coupling structure of the upper mount 82 and the upper panels 9*a* and 4*a*.

The lower mount 83 can have a grip 83*a* recessed upwardly from a lower surface of the lower mount 83. By holding the grip 83*a*, a user can move the assembled clothing treatment apparatus 1.

Rollers 86 can be disposed on the lower panel 9*b* of the clothing treatment unit 9 and the lower panel 4*b* of the refresher 4. The rollers 86 can protrude downwardly from the lower panels 9*b* and 4*b*. A plurality of rollers 86 can be provided which are horizontally spaced apart from each other. There can be four rollers 86, but the number of the rollers 86 is not limited thereto.

A first roller 86*a* and a second roller 86*b* can be spaced apart from each other on the lower panel 9*b* of the clothing treatment unit 9. A third roller 86*c* and a fourth roller 86*d* can be spaced apart from each other on the lower panel 4*b* of the refresher 4. The lower mount 83 can be disposed between the second roller 86*b* and the third roller 86*c*.

When the user moves the assembled clothing treatment apparatus 1 by holding the grip 83*a*, the rollers 86 can support the weight of the clothing treatment apparatus 1. When the clothing treatment apparatus 1 is moved, the rollers 86 can roll along the indoor floor surface. Bearings can be used as a type of the rollers 86.

Figure 4:
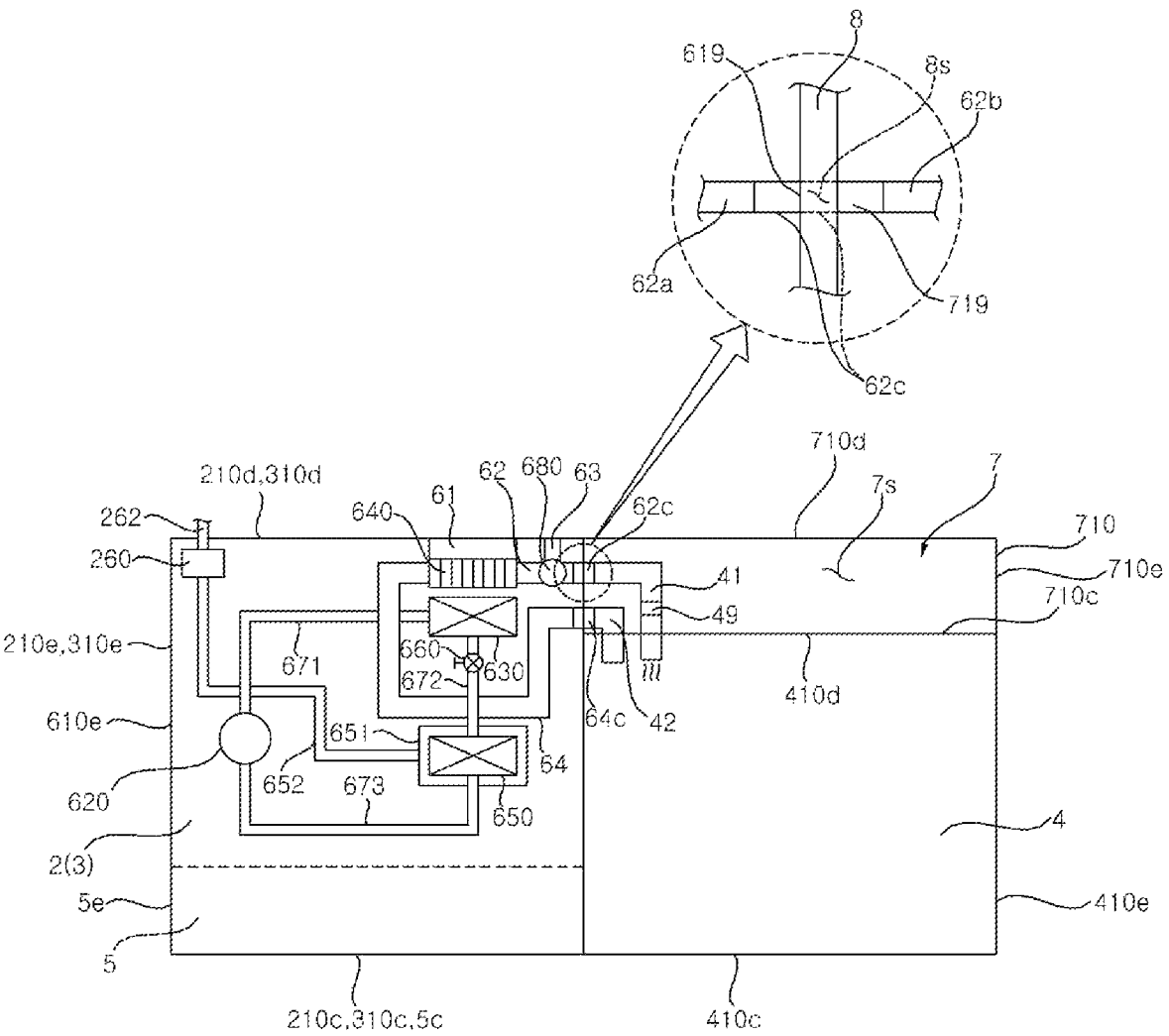
FIG. 4 is a conceptual diagram illustrating a hot air passage according to embodiments of the present disclosure.

Referring to FIG. 4, the washing machine 2, the dryer 3, and the refresher 4 can be supplied with hot air from the heating device 6. The hot air supplied to each of the washing machine 2, the dryer, and the refresher 4 can be recovered to the single heating device 6 for circulation.

The heating device 6 can include the compressor 620, the condenser 630 connected to the compressor 620 by a first refrigerant tube 671, the evaporator 650 connected to the condenser 630 by a second refrigerant tube 672, the expansion device 660 disposed in the second refrigerant tube 672, and a third refrigerant tube 673 connecting the compressor 620 and the evaporator 650. The compressor 620, the condenser 630, the evaporator 650, the expansion device 660, and the refrigerant tubes 671, 672, and 673 can form the heat pump device.

High temperature and high pressure refrigerant, discharged from the compressor 620, can flow into the condenser 630 through the first refrigerant tube 671. The refrigerant, flowing into the condenser 630, can supply heat to the air drawn into the heating device 6 by the fan 640, or the air recovered through the return passage 64. The refrigerant condensed by the condenser 630 can flow into the expansion device 660 through the second refrigerant tube 672 to be decompressed, and then can flow into the evaporator 650. The refrigerant flowing into the evaporator 650 can absorb heat from the air recovered through the return passage 64. The refrigerant evaporated by the evaporator 650 can flow into the compressor 620 through the third refrigerant tube 673 for circulation.

The temperature of hot air supplied into the refresher 4 can be lower than the temperature of hot air supplied into the washing machine 2 or the dryer 3. Accordingly, when only the refresher 4 is operated among the washing machine 2, the dryer 3, and the refresher 4, an operating frequency of the compressor 620 can be set lower than an operating frequency of the compressor 620 for when the washing machine 2 or the dryer 3 is operated.

The heating device 6 can include a fan 640. The fan 640 can circulate the hot air supplied into the washing machine 2, the dryer 3, and the refresher 4.

The fan 640 can draw in outside air from around the clothing treatment apparatus 1 through a suction passage 61. The fan 640 can cause the air drawn through the suction passage 61 and the air recovered through the return passage 64 to flow to the supply passage 62.

The supply passage 62 can be referred to as any one of first to third supply pipes. For example, the supply passage 62 can be referred to as a first supply pipe. The supply passage 62 can be referred to as a second supply pipe. The supply passage 62 can be referred to as a third supply pipe.

Figure 5:
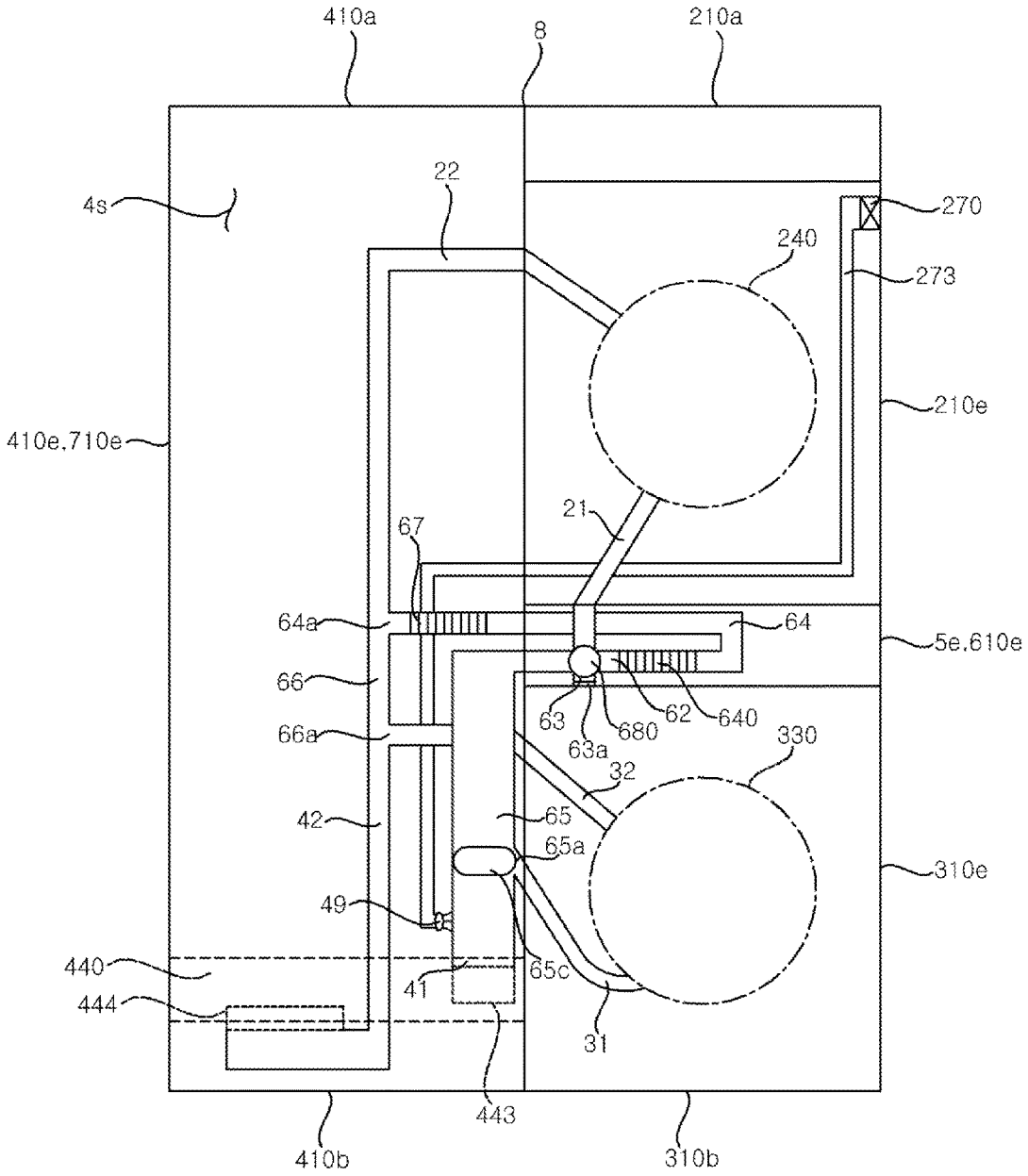
FIG. 5 is a conceptual diagram illustrating a hot air passage of a clothing treatment apparatus according to an embodiment of the present disclosure.

For example, with reference to FIG. 5, the supply passage 62 can be a concept that encompasses the first supply pipe 21, the second supply pipe 31, and the third supply pipe 41 (e.g., supply lines to the washing machine 2, the dryer 3 and the refresher 4).

The return passage 64 can be referred to as any one of first to third return lines. For example, the return passage 64 can be referred to as a first return line. The return passage 64 can be referred to as a second return line. The return passage 64 can be referred to as a third return line.

As shown in FIG. 5, the return passage 64 can be a concept that encompasses the first return line 22, the second return line 32, and the third return line 42 (e.g., return lines from the washing machine 2, the dryer 3 and the refresher 4).

The heating device 6 can include a switching valve 680 for controlling a flow direction of the air blown by the fan 640. The switching valve 680 can be disposed at the supply passage 62.

The switching valve 680 can be connected to the supply passage 62 connected to the fan 640, a dehumidification passage 63 communicating with the outside of the clothing treatment apparatus 1, the first supply passage 21 connected to the drum 240 of the washing machine 2, the second supply passage 31 connected to the drum 330 of the dryer 3, and the third supply passage 41 connected to an outlet port 443 of the refresher 4.

The switching valve 680 can control the air, blown by the fan 640, to flow to the outside of the clothing treatment apparatus 1, the drum 240 of the washing machine 2, the drum 330 of the dryer 3, or the outlet port 443 of the refresher 4.

In addition, the switching valve 680 control the air, blown by the fan 640, to flow to one or more of the outside of the clothing treatment apparatus 1, the drum 240 of the washing machine 2, the drum 330 of the dryer 3, or the outlet port 443 of the refresher 4.

The switching valve 680 can selectively open and close each of the dehumidification passage 63, the first supply passage 21, the second supply passage 31, and the third supply passage 41.

The heating device 6 can include the return passage 64, to which the hot air supplied into the washing machine 2, the dryer 3, and the refresher 4 are recovered.

The return passage 64 can include the first return line 22 connected to the drum 240 of the washing machine 2, the second return line 32 connected to the drum 330 of the dryer 3, and the third return line 42 connected to an inlet port 444 of the refresher 4.

The air flowing into the return passage 64 through the first return line 22, the second return line 32, and the third return line 42 can flow toward the fan 640 to be blown to the supply passage 62. The air introduced into the return passage 64 can be heat exchanged with the evaporator 650, so that the air which is reduced in temperature and humidity can flow toward the fan 640.

The fan 640 can pressurize the air circulating in the supply passage 62 and the return passage 64. The air circulating through the clothing treatment apparatus 1 can be circulated by a blowing force of the fan 640. The supply passage 62 and the return passage 64 can be the inner space of the heating device 6.

The laundry treating apparatus 1 can include a passage placement portion 7 in which the supply pipes 21, 31, and 41, and the return lines 22, 32, and 42 are disposed.

As shown in FIG. 4 can show a top down type of cutaway view of the clothing treatment apparatus 1, in which a passage placement portion 7 can be disposed at the rear side of the refresher 4. The passage placement portion 7 can include a fourth case 710 connected to the clothing treatment unit 9 and the refresher 4. A passage space 7*s*, in which the supply pipes 21, 31, and 41, and the return lines 22, 32, and 42 are disposed, can be formed in the fourth case 710 (e.g., behind the refresher 4).

The supply passage 62 can pass through the plate 8 from the inside of the heating device 6 to extend into the passage space 7*s*. The supply passage 62 can be branched into the plurality of supply pipes 21, 31, and 41 in the passage space 7*s*.

The return passage 64 can pass through the plate 8 from the inside of the heating device 6 to extend into the passage space 7*s*. The first return line 22, the second return line 32, and the third return line 42 can be joined together in the passage space 7*s* to be connected to the return passage 64. As shown in FIG. 5 (e.g., FIG. 5 can be a rear view of the clothing treatment apparatus 1), the return passage 64 can extend toward the heating device 6 from a junction point 64*a* formed in the passage space 7*s* or can pass through the plate 8 to extend into the heating device 6.

FIG. 4 illustrates an example of the third supply pipe 41 and the third return line 42 among the plurality of supply pipes 21, 31, and 41, and the return lines 22, 32, and 42. The third supply pipe 41 can branch off from the supply passage 62 in the passage space 7*s*, to extend into an inner space 4*s* of the refresher 4. A cooling device 49 for reducing temperature of flowing air can be disposed in the third supply pipe 41. The third return line 42 can be joined into the return passage 64 in the passage space 7*s*, to extend into the heating device 6. Like the third supply pipe 41, the first and second supply pipes 21 and 31 can also branch off from the supply passage 62 in the passage space 7*s*, to extend toward the washing machine 2 or the dryer 3. Like the third return line 42, the first and second return lines 22 and 32 can be joined into the return passage 64 in the passage space 7*s*, to extend into the heating device 6.

A point where the supply passage 62 branches off and a point where the return passage 64 is joined are formed in the passage space 7*s*, and the plurality of supply pipes 21, 31, and 41 and the plurality of return lines 22, 32, and 42 are disposed in the passage space 7*s*, such that the hot passages 62, 64, 21, 31, 41, 22, 32, and 42 can be managed collectively in the passage space 7*s*.

The supply passage 62 and the return passage 64 can pass through the plate 8 from the heating device 6 to extend into the passage space 7*s*.

With reference to the enlarged portion of FIG. 4 (e.g., the dashed circle area), The supply passage 62 can include a first supply passage 62*a* extending in the heating device 6, a second supply passage 62*b* extending in the passage space 7*s*, a first joint 62*c* connecting the first supply passage 62 and the second supply passage 62*b* and passing through the plate 8. The first supply passage 62*a* and the second supply passage 62*b* can be separated from the first joint 62*c*. The first joint 62*c* can be attached to and detached from each of the first passage 62*a* and the second supply passage 62*b* and can be formed of a flexible material.

The first supply passage 62*a* can be referred to as a "first connection part," and the second supply passage 62*b* can be referred to as a "second connection part."

With reference to FIGS. 2 and 4, the heating device case 610 can have a first pass-through portion 619, through which the first joint 62*c* passes. The passage case 710 can have a second pass-through portion 719, through which the first joint 62*c* passes. The plate 8 can have a third pass-through portion 8*s*, through which the first joint 62*c* passes.

When a user installs the clothing treatment unit 9 and the passage placement portion 7, the first joint 62*c* can be pressed to pass through the first pass-through portion 619, the second pass-through portion 719, and the third pass-through portion 8*s*. By pressing the first joint 62*c*, having passed through the pass-through portions 619, 719, and 8*s*, to connect to each of the first supply passage 62*a* and the second supply passage 62*b*, the user can release the pressing.

With reference to FIG. 4, as in the supply passage 62, the return passage 64 can include a second joint 64*c* passing through the plate 8. The second joint 64*c* can be attached to and detached from the return passage 64 in the heating device 6 and the return passage 64 in the passage space 7*s*, and can be formed of a flexible material. When the user installs the clothing treatment unit 9 and the passage placement portion 7, the return passage 64 can also be installed using the second joint 64*c*, in the same manner as the supply passage 62.

A front panel 210*c* of the washing machine 2, a front panel 310*c* of the dryer 3, and a front panel 5*c* of the control panel 5 can be disposed on the same vertical plane. A front surface of the clothing treatment unit 9 can be formed as a plane.

The front panel 210*c* of the washing machine 2, the front panel 310*c* of the dryer 3, the front panel 5*c* of the control panel 5, and a front panel 410*c* of the refresher 4 can be disposed on the same vertical plane. The front surface of the clothing treatment apparatus 1 can be formed as a plane. For example, the washing machine 2, the dryer 3 and the refresher 4 can be combined together to substantially present single front surface of clothing treatment apparatus 1, in which the fronts of the devices are substantially flush with each other.

A side panel 210*e* of the washing machine 2, a side panel 310*e* of the dryer 3, a side panel 5*e* of the control panel 5, and a side panel 6*e* of the heating device 6 can be disposed on the same vertical plane. A side surface of the clothing treatment unit 9 can be formed as a plane.

A side panel 410*e* of the refresher 4 and a side panel 710*e* of the passage placement portion 7 can be disposed on the same vertical plane. A side surface of the clothing treatment apparatus 1 can be formed as a plane.

A rear panel 210*d* of the washing machine 2 and the rear panel 310*d* of the dryer 3 can be disposed on the same vertical plane. A rear surface of the clothing treatment unit 9 can be formed as a plane.

The rear panel 210*d* of the washing machine 2, the rear panel 310*d* of the dryer, and a rear panel 710*d* of the passage placement portion 7 can be formed on the same vertical plane. A rear surface of the clothing treatment apparatus 1 can be formed as a plane.

A rear panel 410*d* of the refresher 4 and a front panel 710*c* of the passage placement portion 7 can face each other. The rear panel 410*d* of the refresher 4 and the front panel 710*c* of the passage placement portion 7 can come into contact with or can be coupled to each other.

The rear panel 410*d* of the refresher 4 can be disposed in front of the rear panels 210*d* and 310*d* of the washing machine 2 and the dryer 3. A longitudinal width of the passage placement portion 7 can correspond to a space between the rear panel 410*d* of the refresher 4 and the rear panels 210*d* and 310*d* of the washing machine 2 and the dryer 3. A sum of longitudinal widths of the refresher 4 and the passage placement portion 7 can be equal to a sum of longitudinal widths of the washing machine 2 and the dryer 3. Accordingly, the washing machine 2, the dryer 3, the refresher 4, the heating device 6 and the passage placement portion 7 can be combined together to present a single overall unit forming the clothing treatment apparatus 1, which can have a rectangular cuboid shape, but it is not limited thereto.

The heating device 6 can include a drain pan 651 disposed under the evaporator 650. The return passage 64 can be a portion of the inner space of the heating device 6, and air passing through the return passage 64 can be heat exchanged with the evaporator 650, so that the air which is reduced in temperature and humidity can flow toward the fan 640. Humid air, flowing in each of the first return line 22 connected to the washing machine 2, the second return line 32 connected to the dryer 3, and the third return line 42 connected to the refresher 4, can be joined into the return line 64 to be heat exchanged with the evaporator 650. The drain pan 651 can receive condensate generated by heat exchange between the humid air and the evaporator 650.

The drain pan 651 can be connected to a drain pump 260, disposed in the washing machine 2, by a drain pipe 652 (e.g., see FIG. 2). The condensate stored in the drain pan 651 (e.g., see FIG. 4) can flow toward the drain pump 260 through the drain pipe 651 by the operation of the drain pump 260. The drain pump 260 can be connected to a drain pipe 262 for discharging water, extruded by the drain pump 260, to the outside of the washing machine 2. The drain pump 260 can discharge the water, stored in the drain pan 651, to the outside of the clothing treatment apparatus 1.

Referring to FIG. 2, the washing machine 2 can include the first case 210, a first door 220 rotatably coupled to the first case 210, the tub 230 mounted in the first case 210, the first drum 240 rotatably mounted in the tub 230, a motor 250 transmitting power to the first drum 240, the drain pump 260 discharging water, generated in the clothing treatment apparatus 1, to the outside thereof, a water supply valve 270 connected to an external water source, and a drawer 280 in which detergent is stored.

The drain pump 260 can be connected to the tub 230 by a first drain pipe 261. The drain pump 260 can discharge water, introduced through the first drain pipe 261 and the drain pipe 652, to the outside of the clothing treatment apparatus 1 through a second drain pipe 262.

The water supply valve 270 can control a flow rate of water flowing into the washing machine 2 from the external water source. The water supply valve 270 can be connected to a first water supply pipe 271. The first water supply pipe 271 can be connected to the drawer 280 in which the detergent is stored. The water flowing into the drawer 280 through the first water supply pipe 271 can flow into the tub 230, with the detergent being dissolved therein, through a second water supply pipe 272 (e.g., see FIG. 2).

The dryer 3 includes a second case 310, a second door 320 rotatably coupled to the second case 310, and a second drum 330 rotatably mounted in the second case 310, a container 340 in which water is stored, and a steam generator 350 connected to the container 340 by a water pipe 341.

The container 340 can be connected to the first water supply pipe 271 of the washing machine 2, and can receive water, supplied from the external water source, through the first water supply pipe 271.

The steam generator 350 can be supplied with water stored in the container 340 to generate steam. The steam generator 350 can supply the generated steam into the first drum 240 of the washing machine 2, the second drum 330 of the dryer 3, and the inner space 4*s* of the refresher 4. For example, the steam generator 350 can be shared by each of the washing machine 2, the dryer 3 and the refresher 4.

The steam generator 350 can be disposed in the dryer 3, but the arrangement position is not limited to the inside of the dryer 3. The steam generator 350 can be disposed in the heating device 6 or can be disposed in the passage space 7*s*.

An outside air inlet 611 can be formed in a rear panel 610*d* of the heating device 6. When the fan 640 operates, outside air of the clothing treatment apparatus 1 can be introduced into the heating device 6 through the outside air inlet 611.

The heating device 6 can include a cooling dehumidification passage 613 branching off from the return passage 64. The cooling dehumidification passage 613 can branch off from the return passage 64 between the evaporator 650 and the fan 640. Low-temperature dry air, heat-exchanged with the evaporator 650, can flow to the cooling dehumidification passage 613 branching off from the return passage 64.

An auxiliary fan 614 can be disposed in the cooling dehumidification passage 613. The auxiliary fan 614 can be selectively operated when it is required to supply the low-temperature dry air into an inner space during the summer. When the auxiliary fan 614 is operated, the low-temperature dry air, flowing in the return passage 64, can flow to the cooling dehumidification passage 614. A dry air outlet 612, communicating with the outside of the clothing treatment apparatus 1, can be formed in the rear panel 610*d* of the heating device 6. When the auxiliary fan 614 is operated, the low-temperature dry air, heat exchanged with the evaporator 650, can be supplied into the inner space through the dry air outlet 612.

Referring to FIG. 3, the refresher 4 can include the third case 410, a third door 420 rotatably coupled to the third case 410, a hanger 430 which is disposed in the third case 410, and on which clothing is hung, a discharge panel 440 having the outlet port 443 formed therein, and a storage part 450 disposed under the discharge panel 440.

The space 4*s*, in which clothing is placed, is formed in the refresher 4. The clothing can be placed in the space 4*s* by being hung on the hanger 430. The space 4*s* can be formed between an upper panel 410*a* of the refresher 4 and the discharge panel 440. The space 4*s* can have a height H corresponding to a space between the upper panel 410*a* of the refresher 4 and the discharge panel 440. The heating device 6 for generating hot air to be supplied into the space 4*s* can also be disposed in the refresher 4. However, the heating device 6 of the clothing treatment apparatus 1 according to the embodiments of the present disclosure is disposed vertically with respect to the washing machine 2 and the dryer 3 of the clothing treatment unit 9. Accordingly, the clothing treatment apparatus 1 according to embodiments of the present disclosure can have the space 4*s* having a height which increases by a height occupied by the heating device 6 in the refresher 4, in the situation where the heating device 6 is disposed in the refresher 4. That is, the height H of the space 4*s* of the refresher 4 in the clothing treatment apparatus 1 according to the embodiments of the present disclosure can be greater than the height of a clothing receiving space when the heating device 6 is disposed in the refresher 4.

The discharge panel 440 can include a first discharge panel 441 having the inlet port 444 formed therein, and a second discharge panel 442 having the outlet port 443 formed therein.

The first discharge panel 441 can be disposed side by side with the upper panel 410*a* and a lower panel 410*b* of the refresher 4. The inlet port 444 can be perforated in the first discharge panel 441.

The second discharge panel 442 can extend obliquely upwardly from the first discharge panel 441. The outlet port 443 can be open in the second discharge panel 442. The outlet port 443 can extend obliquely upwardly with respect to a horizontal direction.

The storage part 450 can be disposed under the discharge panel 440. The storage part 450 can be withdrawn forwardly. By the storage part 450, the discharge panel 440 can be upwardly spaced apart from the lower panel 410*b* of the refresher 4.

Clothing, occupying a small volume such as hats, can be placed in the storage part 450. A UV lamp (LED) for sterilizing the clothing placed therein can be disposed in the storage part 450.

Rather than the clothing, a detergent box, fabric softener, and other parts of the clothing treatment apparatus 1 can be stored in the storage box 450.

However, unlike the clothing treatment apparatus 1 according to the embodiments of the present disclosure, the storage part 450 can not be provided, in which case the height H between the discharge panel 440 and the upper panel 410*a* can be further extended.

The above description of the clothing treatment apparatus 1 can also be applied to the respective embodiments of the present disclosure illustrated in FIGS. 1 to 23. That is, regardless of the order of vertical arrangement of the components 2, 3, 5, and 6 included in the clothing treatment unit 9, the above description of the clothing treatment apparatus 1 can also be applied to the respective embodiments.

Hereinafter, a clothing treatment apparatus 101 according to a first embodiment will be described with reference to FIGS. 1 to 5.

Referring to FIG. 1, in the clothing treatment apparatus 101 according to the first embodiment, the washing machine 2 is disposed over the dryer 3 (e.g., to allow for convenient transfer of wet clothes, from the washing machine 2, to the dryer 3).

The control panel 5 can be disposed between the washing machine 2 and the dryer 3. A front surface of the washing machine 2, a front surface of the dryer 3, and a front surface of the control panel 5 can form a front surface of the clothing treatment unit 9.

In the situation where the washing machine 2 is disposed under the dryer 3, a user needs to lift washed heavy laundry to load the laundry into the dryer 3 disposed at a higher position than the washing machine 2. In the situation where the washing machine 2 is disposed over the dryer 3, the washed heavy laundry is dropped into the dryer 3 disposed at a lower position than the washing machine 2, such that a user's load for moving the laundry can be reduced compared to the situation of lifting heavy wet laundry. That is, in the clothing treatment apparatus 101 according to the first embodiment, the washing machine 2 is disposed over the dryer 3, such that the washed heavy laundry items can be easily loaded into the dryer 3, compared to the situation where the washing machine 2 is disposed under the dryer 3.

The clothing treatment apparatus 101 can include a detergent supply device 290. The detergent supply device 290 can be disposed over the first case 210.

In the situation where the washing machine 2 is disposed over the dryer 3, a height of the washing machine 2 increases, such that it is difficult to refill detergent for washing. Accordingly, in the situation where the washing machine 2 is disposed over the dryer 3, the detergent supply device 290 can be provided for automatically supplying detergent into the drum 240.

The detergent supply device 290 can include a plurality of cartridges 291*a*, 291*b*, and 291*c* which are separated from each other. Different types of detergents can be received in the respective cartridges 291*a*, 291*b*, and 291*c*.

An upper surface of the detergent supply device 290 can form an upper surface of the clothing treatment unit 9. The upper surface of the detergent supply device 290 can be disposed on the same horizontal plane as the upper surface of the refresher 4.

The plate 8 can be connected to the upper surface of the detergent supply device 290 and the upper surface of the refresher 4. The upper mount 82 can be coupled to each of the detergent supply device 290 and the upper panel 410*a* of the refresher 4.

Referring to FIG. 2, the detergent supply device 290 can include: a cartridge 291 holding detergent; a docking valve 292 disposed in the cartridge 291; a pump 293 including a piston 293*a*; a first detergent introduction channel 294 selectively communicating with the inside of the cartridge 291; a second detergent introduction channel 295 selectively communicating with the first detergent introduction channel 294 by the movement of a shut-off valve 297; and a detergent introduction pipe 296 connecting the second detergent introduction channel 295 and the first water supply pipe 271.

When the piston 293*a* is moved in a first direction so that negative pressure is formed in the first detergent introduction channel 294, the docking valve 292 is moved to allow the inside of the cartridge 291 to communicate with the first detergent introduction channel 294. The detergent in the cartridge 291 can flow to the first detergent introduction channel 294 by the negative pressure. In this situation, when the piston 293*a* is moved in a second direction opposite the first direction, positive pressure can be formed in the first detergent introduction channel 294. When the positive pressure is formed in the first detergent introduction channel 294, and the shut-off valve 297 allows the first detergent introduction channel 294 to communicate with the second detergent introduction channel 295, the detergent introduced into the first detergent introduction channel 294 can flow to the detergent introduction pipe 296 through the second detergent introduction channel 295. The detergent flowing to the detergent introduction pipe 296 can be dissolved in water flowing through the water supply pipe 271, to be supplied into the tub 240.

The heating device 6 can be disposed at a rear side of the control panel 5. The heating device 6 can be disposed between the washing machine 2 and the dryer 3. The heating device 6 can have the same height as that of the control panel 5 or a height that is at least substantially the same as that of the control panel 5. A rear panel 5*d* of the control panel 5 and a front panel 610*c* of the heating device 6 can face each other or can be coupled to each other.

Referring to FIG. 5, the heating device 6 can supply hot air to each of the washing machine 2, the dryer 3, and the refresher 4, or can recover the supplied hot air.

The first supply pipe 21, the second supply pipe 31, and the third supply pipe 41, which will be described below, can be referred to as any one of the first to third supply pipes. For example, a supply pipe connected to the washing machine 2 can be referred to as the "first supply pipe," a supply pipe connected to the dryer 3 can be referred to as the "second supply pipe," and a supply pipe connected to the refresher 4 can be referred to as the "third supply pipe."

The first return line 22, the second return line 32, and the third return line 42, which will be described later, can be referred to as any one of the first to third return lines. For example, a return line connected to the washing machine 2 can be referred to as the "first return line," a return line connected to the dryer 3 can be referred to as the "second return line," and a return line connected to the refresher 4 can be referred to as the "third return line."

The air blown by the fan 640 to the supply passage 62 is supplied with heat from the condenser 630, such that temperature of the air increases. The hot air in the supply passage 62 is introduced into the switching valve 680 to be selectively supplied to the first supply pipe 21, a supply junction tube 65 or the dehumidification passage 63. The switching valve 680 can control a flow direction of the hot air introduced through the supply passage 62. The supply passage 62 can include the supply junction tube 65.

The hot air introduced into the dehumidification passage 63 from the switching valve 680 can be discharged into an indoor space through a hot air outlet 63*a* communicating with the outside of the clothing treatment apparatus 1.

The hot air introduced into the first supply pipe 21 from the switching valve 680 can flow into the first drum 240 of the washing machine 2. The hot air flowing into the first drum 240 can dry laundry after the laundry is washed and spin-dried.

The hot air introduced into the supply junction tube 65 from the switching valve 680 flows toward a branch point 65*a*. The supply junction tube 65 can branch off at the branch point 65*a* into the second supply pipe 31 and the third supply pipe 41. A control valve 65*c* can be disposed at the branch point 65*a*. The control valve 65*c* can control an amount of flowing hot air supplied to each of the second supply pipe 31 and the third supply pipe 41.

The hot air introduced into the second supply pipe 31 can flow into the second drum 330 of the dryer 3. The hot air flowing into the second drum 330 can dry laundry placed in the second drum 330.

The hot air introduced into the third supply pipe 41 can be discharged into the inner space 4*s* of the refresher 4 through the outlet port 443 of the refresher 4. The hot air discharged into the inner space 4*s* can dry clothing placed in the refresher 4.

The hot air introduced into the third supply pipe 41 is reduced in temperature by the cooling device 49, to be discharged through the outlet port 443 (e.g., see FIG. 5). The cooling device 49 can be connected to the water supply valve 270 by a third water supply pipe 273. The cooling device 49 can be a nozzle for spraying water, supplied from the external water source, through the third water supply pipe 273. The cooling device 49 can spray water toward the third supply pipe 41 to reduce the temperature of the hot air flowing in the third supply pipe 41.

Depending on the type of clothing and temperature of the hot air, if the high temperature hot air supplied through the supply passage 62 is supplied directly into the refresher 4, the clothing can be damaged. Accordingly, by reducing the temperature of the hot air discharged into the inner space 4*s* of the refresher 4 by using the cooling device 49, it is possible to prevent damage to the clothing and also condition the air to be more humid.

The hot air supplied into the first drum 240 can flow into the first return line 22. The hot air supplied into the second drum 330 can flow into the second return line 32. The hot air supplied into the inner space 4*s* of the refresher 4 can flow into the third return line 42 through the inlet port 444.

The first return line 22 can be connected to the first drum 240 at a position above the first supply pipe 21. The second return line 32 can be connected to the second rum 30 at a position above the second supply pipe 31. In this structure, the hot air supplied to a lower portion of the drums 240 and 330 moves upward to uniformly dry the laundry, and the upwardly moving hot air can be effectively recovered.

The hot air flowing through the second return line 32 and the hot air flowing through the third return line 42 can be joined at a first junction point 66*a*.

The hot air joined at the first junction point 66*a* can flow through a return junction pipe 66, to join the hot air flowing through the first return line 22 at a second junction point 64*a*. An auxiliary fan 67 for blowing the hot air flowing through the respective return lines 22, 32, and 42 can be disposed at the second junction point 64*a*.

The hot air joined at the second junction point 64*a* can flow to the fan 640 through the return passage 64 and can be recirculated through the washing machine 2, the dryer 3, and the refresher 4 by the fan 640 in the above route.

The supply passage 62 can pass through the plate 8 to form the branch point 65*a* in the passage space 7*s*. The first return line 22, the second return line 32, and the third return line 42 can form the junction points 66*a* and 64*a* in the passage space 7*s*. The hot air flowing through the first return line 22, the second return line 32, and the third return line 42 can be joined at the second junction point 64*a* formed in the passage space 7*s*, to flow to the fan 640 through the return passage 64 passing through the pate 8.

In the above structure, a rear space of the refresher 4 can be used as a space for providing hot air passages, thereby allowing integrated management of the hot air passages. In addition, the total length of the passages through which the hot air is supplied to the respective units 2, 3, and 4 and passages through which the hot air is recovered from the respective units 2, 3, and 4 can be reduced and an overall size of the combined clothing treatment apparatus 1(101) can be made smaller.

In the clothing treatment apparatus 101 according to the first embodiment, the heating device 6 is adjacent to all of the washing machine 2, the dryer 3, and the refresher 4, such that the passages for supplying the hot air to the respective units 2, 3, and 4 from the heating device 6 and the passages for recovering the hot air from the respective units 2, 3, and 4 can be reduced in length. For example, the heating device 6 can occupy a center position within the clothing treatment apparatus 101, in which the washing machine 2, the dryer 3, and the refresher 4 are disposed around the heating device 6 so that the lengths of various air passages can be minimized.

The upper panel 410*a* of the refresher 4 and an upper panel 210*a* of the washing machine 2 can be disposed on the same horizontal plane.

The lower panel 410*b* of the refresher 4 and a lower panel 710*b* of the passage placement portion 7 can be disposed on the same horizontal plane. The lower panel 410*b* of the refresher 4 and a lower panel 310*b* of the dryer 3 can be disposed on the same horizontal plane.

The side panel 410*e* of the refresher 4 and the side panel 710*e* of the passage placement portion 7 can be disposed on the same vertical plane.

The side panel 5*e* of the control panel 5 and a side panel 610*e* of the heating device 6 can be disposed on the same vertical plane.

The side panel 610*e* of heating device 6, the side panel 210*e* of the washing machine 2, and the side panel 310*e* of the dryer 3 can be disposed on the same vertical plane.

Hereinafter, a clothing treatment apparatus 102 according to a second embodiment will be described with reference to FIGS. 6 and 7.

Figure 6:
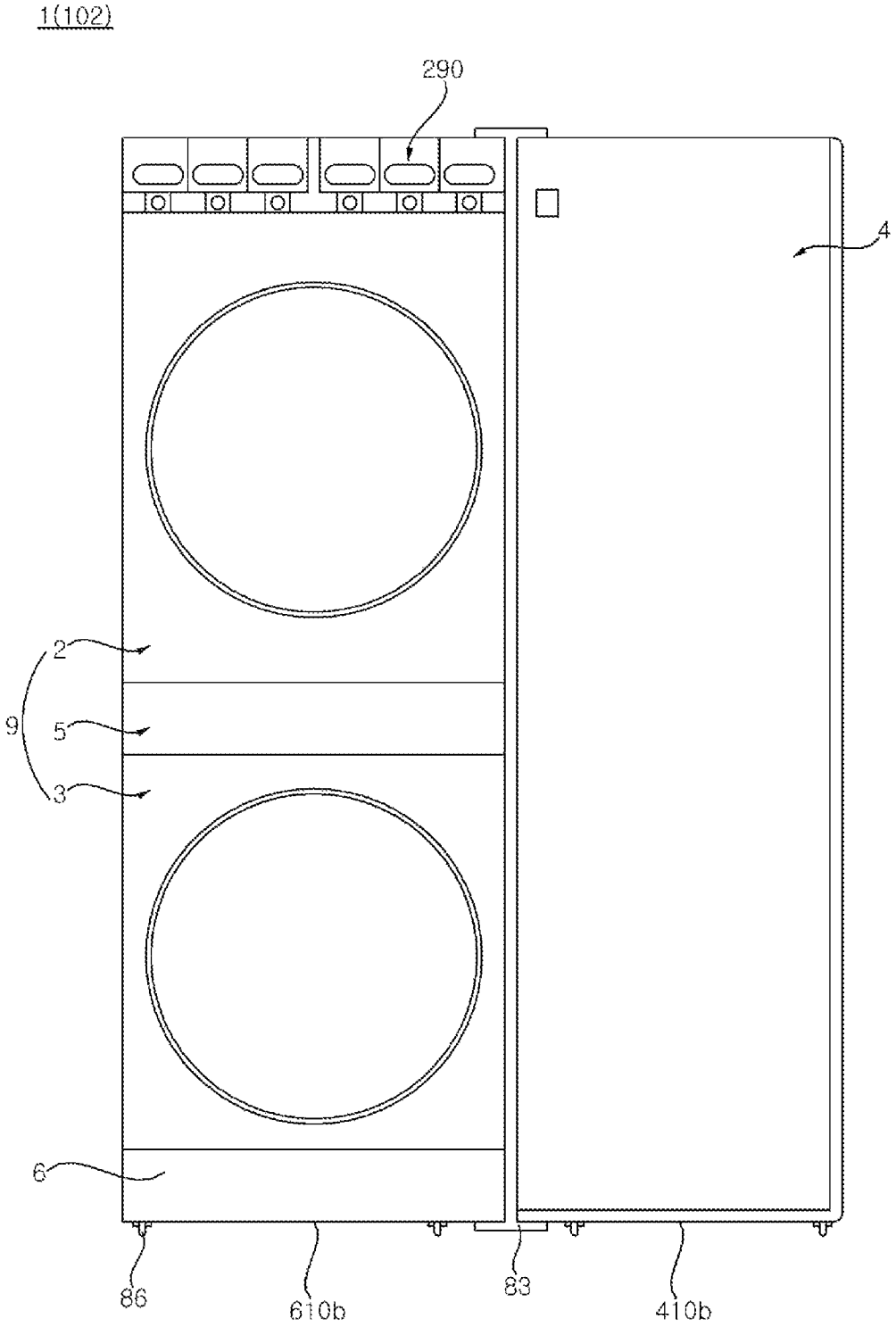
FIG. 6 is a front view of a clothing treatment apparatus according to an embodiment of the present disclosure.

Referring to FIG. 6, in the clothing treatment apparatus 102 according to the second embodiment, the washing machine 2 is disposed over the dryer 3.

The control panel 5 can be disposed between the washing machine 2 and the dryer 3. A front surface of the washing machine 2, a front surface of the dryer 3, and a front surface of the control panel 5 can form a front surface of the clothing treatment unit 9.

In the clothing treatment apparatus 102 according to the second embodiment of the present disclosure, the washing machine 2 is disposed over the dryer 3, such that a user can easily move the washed heavy laundry into the dryer 3, compared to the situation where the washing machine 2 is disposed under the dryer 3.

The clothing treatment apparatus 102 can include the detergent supply device 290. The detergent supply device 290 can be disposed over the second case 210. The description of the detergent supply device 290 can be the same as the detergent supply device 290 according to the clothing treatment apparatus 101 of the first embodiment.

An upper surface of the detergent supply device 290 can form the upper surface of the clothing treatment unit 9. The upper surface of the detergent supply device 290 can be disposed on the same horizontal plane as the upper surface of the refresher 4.

The heating device 6 can be disposed under the washing machine 2 and the dryer 3 (e.g., at a lower portion of clothing treatment apparatus 102, such as near the ground). The heating device 6 can form a lower surface of the clothing treatment unit 9. A lower surface of the heating device 6 can be disposed on the same horizontal plane as the lower surface of the refresher 4.

The lower mount 83 and the rollers 86 can be coupled to the lower panel 610*b* of the heating device 6. The rollers 86 can protrude downwardly from the lower panel 610*b* of the heating device 6. The lower mount 83 can couple the lower panel 610*b* of the heating device 6 and the lower panel 410*b* of the refresher 4.

Figure 7:
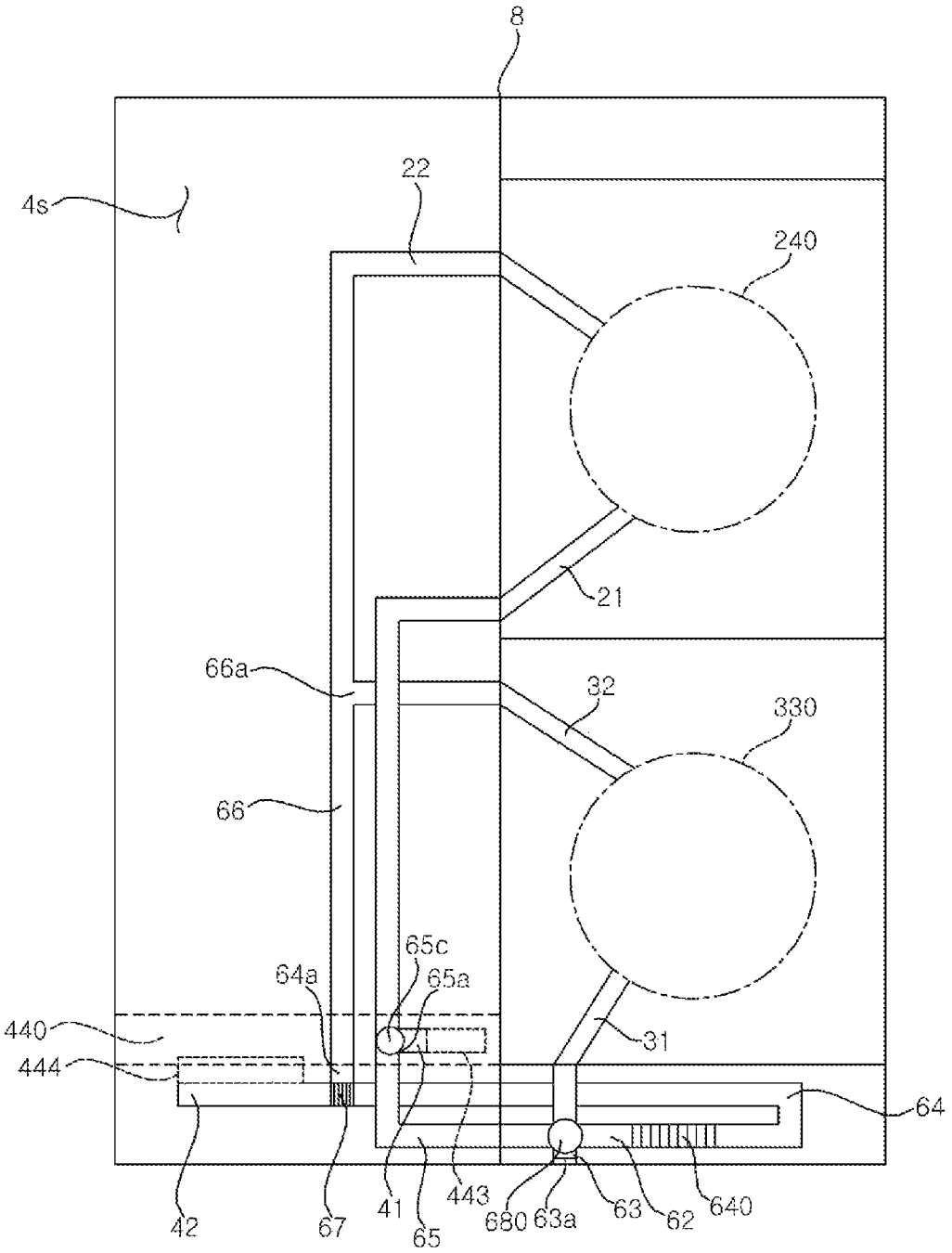
FIG. 7 is a conceptual diagram illustrating a hot air passage of a clothing treatment apparatus according to an embodiment of the present disclosure.

Referring to FIG. 7, the heating device 6 can supply hot air to each of the washing machine 2, the dryer 3, and the refresher 4 and can also recover the supplied hot air.

The hot air blown by the fan 640 to the supply passage 62 can be supplied with heat from the condenser 630, such that temperature of the hot air increases. The hot air in the supply passage 62 can be introduced into the switching valve 680 to be selectively supplied to the second supply pipe 31, the supply junction pipe 65, or the dehumidification passage 63. The switching valve 680 can control a flow direction of the hot air introduced through the supply passage 62. The supply passage 62 can include the supply junction pipe 65.

The hot air introduced into the dehumidification passage 63 from the switching valve 680 can be discharged into an indoor space through the hot air outlet 63*a* communicating with the outside of the clothing treatment apparatus 1.

The hot air introduced into the second supply pipe 31 from the switching valve 680 can flow into the second drum 330 of the dryer 3. The hot air flowing into the second drum 330 can dry laundry placed in the second drum 330.

The hot air introduced into the supply junction tube 65 from the switching valve 680 flows toward the branch point 65*a*. The supply junction tube 65 can branch off at the branch point 65*a* into the first supply pipe 21 and the third supply pipe 41. The control valve 65*c* can be disposed at the branch point 65*a*. The control valve 65*c* can control an amount of flowing hot air supplied to each of the first supply pipe 21 and the third supply pipe 41.

The hot air introduced into the first supply pipe 21 can flow into the first drum 240 of the washing machine 2. The hot air flowing into the first drum 240 can dry laundry placed in the first drum 240.

The hot air introduced into the third supply pipe 41 can be discharged into the inner space 4*s* of the refresher 4 through the outlet port 443 of the refresher 4. The hot air discharged into the inner space 4*s* can dry clothing placed in the refresher 4.

The hot air introduced into the third supply pipe 41 is reduced in temperature by the cooling device 49, to be discharged through the outlet port 443.

The hot air supplied into the first drum 240 can flow into the first return line 22. The hot air supplied into the second drum 330 can flow into the second return line 32. The hot air supplied into the inner space 4*s* of the refresher 4 can flow into the third return line 42 through the inlet port 444.

The first return line 22 can be connected to the first drum 240 at a position above the first supply pipe 21. The second return line 32 can be connected to the second rum 30 at a position above the second supply pipe 31. In this structure, the hot air supplied to a lower portion of the drums 240 and 330 moves upward to uniformly dry the laundry, and the upwardly moving hot air can be effectively recovered.

The hot air flowing through the first return line 22 and the hot air flowing through the second return line 32 can be joined at a first junction point 66*a*.

The hot air joined at the first junction point 66*a* can flow through the return junction pipe 66, to join the hot air flowing through the third return line 42 at the second junction point 64*a*. The auxiliary fan 67 for blowing the hot air flowing through the respective return lines 22, 32, and 42 can be disposed at the second junction point 64*a*.

The hot air joined at the second junction point 64*a* can flow to the fan 640 through the return passage 64 and can be recirculated through the washing machine 2, the dryer 3, and the refresher 4 by the fan 640 in the above route.

The supply passage 62 can pass through the plate 8 to form the branch point 65*a* in the passage space 7*s*. The first return line 22, the second return line 32, and the third return line 42 can form the junction points 66*a* and 64*a* in the passage space 7*s*. The hot air flowing through the first return line 22, the second return line 32, and the third return line 42 can be joined at the second junction point 64*a* formed in the passage space 7*s*, to flow to the fan 640 through the return passage 64 passing through the pate 8.

In the above structure, a rear space of the refresher 4 can be used as a space for providing hot air passages, thereby allowing integrated management of the hot air passages. In addition, the total length of the passages through which the hot air is supplied to the respective units 2, 3, and 4 and passages through which the hot air is recovered from the respective units 2, 3, and 4 can be reduced.

The second junction point 64*a* can be formed at a position below the outlet port 443 and the inlet port 444 of the refresher 4. The high temperature hot air, flowing through the first return line 22 and the second return line 32, can be cooled sufficiently when reaching the second junction point 64*a*. The hot air flowing through the first return line 22 and the second return line 32 can be primarily cooled before reaching the second junction point 64*a*, and then can be cooled secondarily at the evaporator 650 while flowing through the return passage 64, such that energy efficiency can be improved.

In the clothing treatment apparatus 102 according to the second embodiment, the heating device 6 is disposed under the washing machine 2 and the dryer 3, such that the third supply pipe 41 and the supply junction pipe 65 for supplying hot air to the refresher 4 can be reduced in length.

In the clothing treatment apparatus 1 according to the present disclosure, the respective clothing treatment machines 2, 3, and 4 include one or more communication modules 1120 (see FIG. 11) to transmit and receive predetermined signals with each other. That is, each of the washing machine 2, the dryer 3, and the refresher 4 can include one or more communication modules 1120 to communicate with each other.

Further, in one embodiment of the present disclosure, the communication module 1120 can also be provided for the heating device 6 and/or the machine room 6*s*, to communicate with the clothing treatment machines 2, 3, and 4.

The clothing treatment apparatus 1 of the present disclosure can have various combinations and arrangements of the clothing treatment machines 2, 3, and 4. Accordingly, various communication connection structures of components included in the clothing treatment apparatus 1 can be implemented, and an optimal communication connection structure can be provided for the respective components of the clothing treatment apparatus 1.

Figure 8A:
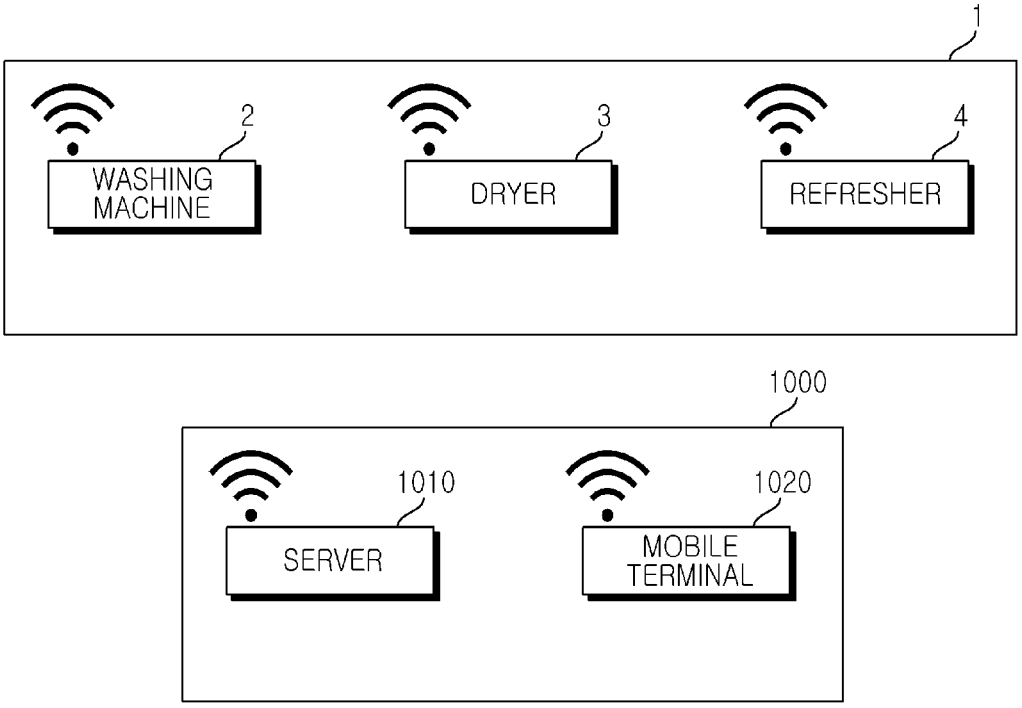
FIGS. 8A to 8C are diagrams referred to in the description of various communication connection structures according to embodiments of the present disclosure.
Figure 8B:
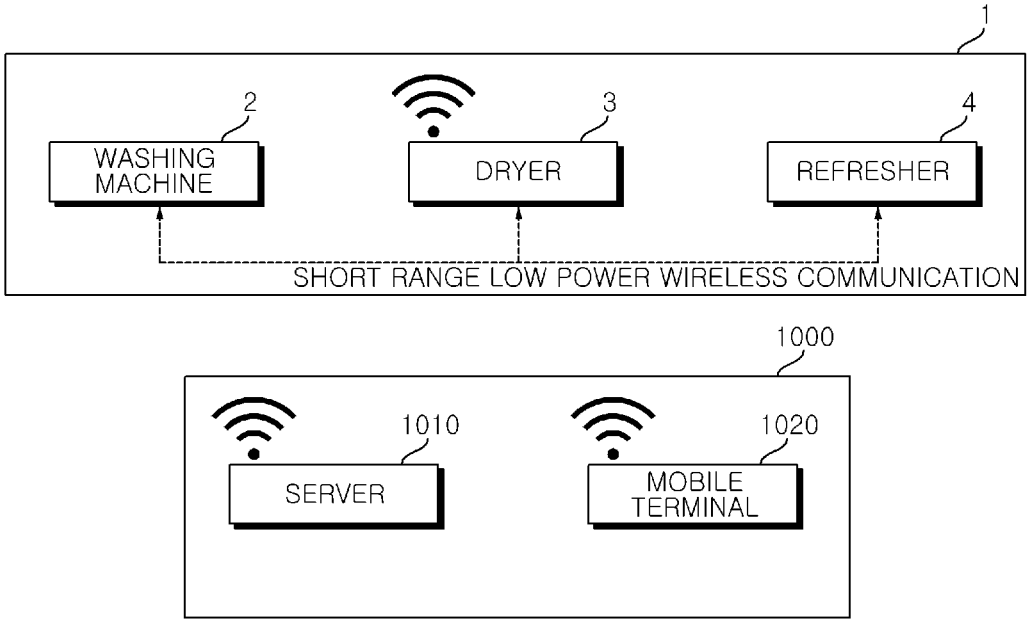
Figure 8C:
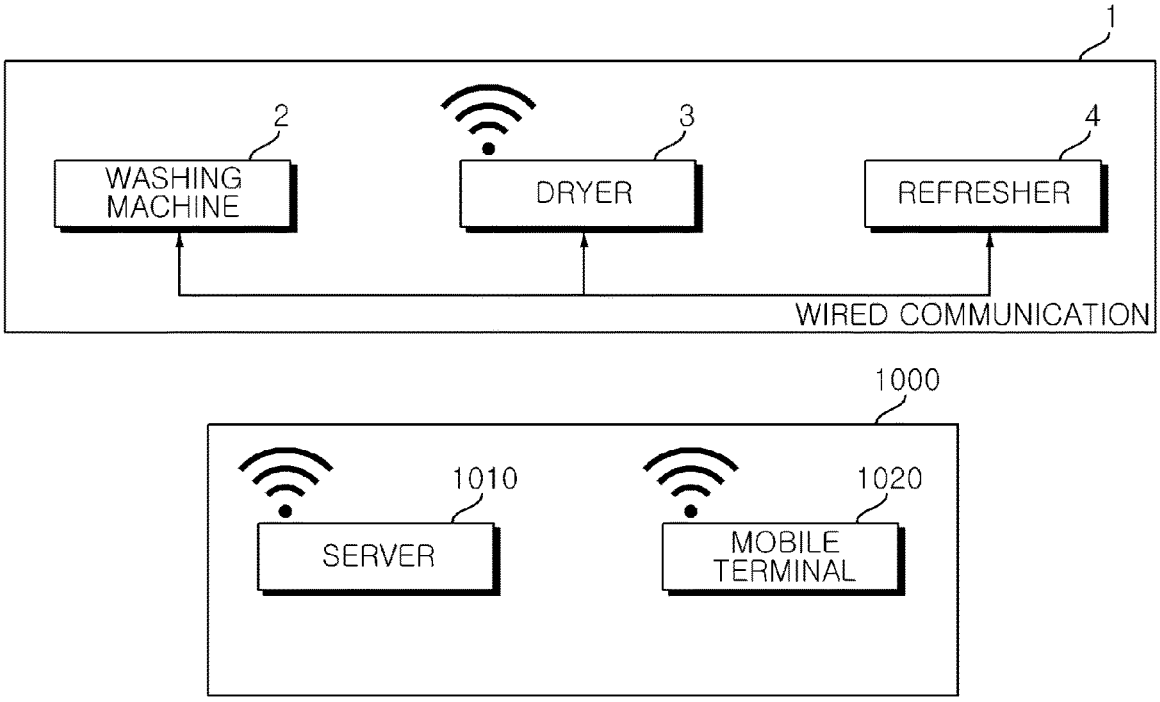

FIGS. 8A to 8C are diagrams referred to in the description of a communication connection structure according to an embodiment of the present disclosure.

Referring to FIG. 8A, each of the washing machine 2, the dryer 3, and the refresher 4 can include its own Wi-Fi communication module and can wirelessly communicate with other according to Wi-Fi standards.

Further, each of the washing machine 2, the dryer 3, and the refresher 4 can freely transmit and receive data with an external device 1000, such as a server 1010, a mobile terminal 1020, etc., using wireless communication according to the Wi-Fi standards. For example, the mobile terminal 1020 can wirelessly communicate with the washing machine 2, the dryer 3, and the refresher 4 to transmit a user's control command and can receive state information of the respective clothing treatment machines 2, 3, and 4 and display the information.

The washing machine 2, the dryer 3, and the refresher 4, each having the wireless communication module, can produce an effect that the external device 1000, such as the server 1010, the mobile terminal 1020, etc., can be connected independently to the clothing treatment machines 2, 3, and 4. In addition, the wireless communication requires no communication lines, such that the connection to the clothing treatment machines 2, 3, and 4 is not interrupted, thereby reducing a level of work difficulty and work time.

Meanwhile, any one of the washing machine 2, the dryer 3, and the refresher 4 can function as a wireless router. That is, any one of the Wi-Fi communication modules included in the clothing treatment machines 2, 3, and 4 can function as a wireless router. Accordingly, even when an external wireless router of the clothing treatment apparatus 1, such as a wireless router of a home network and the like, is turned off, the washing machine 2, the dryer 3, and the refresher 4 can perform wireless communication.

According to an embodiment of the present disclosure, any one of the washing machine 2, the dryer 3, and the refresher 4 can include a representative communication module for wireless communication with an external device according to a first communication method. The clothing treatment machine including the representative communication module can be referred to as a representative clothing treatment machine.

The representative clothing treatment machines, other than the clothing treatment machine, can communicate by wire or wirelessly with the representative clothing treatment machine (e.g., in a master/slave type of configuration).

Depending on embodiments, the representative clothing treatment machine and the other clothing treatment machines can also communicate wirelessly with each other by the first communication method, and any one clothing treatment machine can function as the wireless router.

Alternatively, only one of the washing machine 2, the dryer 3, and the refresher 4 can include the representative communication module to communicate with an external device, and the other clothing treatment machines can communicate only with each other (e.g., as its own local area network (LAN) while the representative communication module can connect the LAN to a wide area network WAN). For example, any one of the clothing treatment machines can include the Wi-Fi communication module for wireless communication according to the Wi-Fi communication scheme and can wirelessly communicate with the external device 1000, such as the server 1010, the mobile terminal 1020, etc., according to the Wi-Fi standards. Further, the clothing treatment machines 2, 3, and 4 can perform wired or wireless communication with each other.

Meanwhile, the representative clothing treatment machine and the other clothing treatment machines can perform communication using a second communication method which is different from the first communication method. Here, compared to the first communication method, the second communication method can be a low power short range wireless communication or wired communication. For example, the first communication method can be the Wi-Fi communication, and the second communication method can be a short range communication method, such as Bluetooth and the like, which consumes relatively less power and has a short communication distance. Alternatively, the first communication method can be the Wi-fi communication, and the second communication method can be a wired communication method such as RS232, RS422, RS485, and the like.

FIGS. 8B and 8C are diagrams illustrating a situation where the dryer 3 is the representative clothing treatment machine having the Wi-Fi communication module, and the washing machine 2 and the refresher 4 are general clothing treatment machines having only the Bluetooth communication module. The dryer 3 also having the Bluetooth communication module can communicate with the washing machine 2 and the refresher 4. FIG. 8B is merely an example and the present disclosure is not limited thereto, and the washing machine 2 or the refresher 4 can also be the representative clothing treatment machine.

Referring to FIG. 8B, the clothing treatment machines 2, 3, and 4 can perform short-range wireless communication, such as Bluetooth communication and the like, with each other. The external device 1000, such as the server 1010, the mobile terminal 1020, etc., can wirelessly communicate with the dryer 3 having the Wi-Fi communication module, to transmit a user's control command and to receive state information of the clothing treatment machines 2, 3, and 4 and display the information. The dryer 3 can transmit a control command to be received by the washing machine 2 and the refresher 4. In addition, the dryer 3 can transmit data, received from the washing machine 2 and the refresher 4, to the server 1010, the mobile terminal 1020, and the like.

Accordingly, the plurality of clothing treatment machines 2 and 4 can include only the short-range wireless communication modules for communication with nearby clothing treatment machines 2, 3, and 4, thereby reducing production costs.

Only one of the washing machine 2, the dryer 3, and the refresher 4 can include the Wi-Fi communication module and the others are connected by a low power wireless communication. Accordingly, the server 1010 or the mobile terminal 1020 can perform integrated management by using only one device and Wi-Fi communication, thereby minimizing power consumption.

The machines having the short range communication module can communicate with each other with low power, thereby minimizing unnecessary power consumption and costs required for Wi-Fi communication components. In addition, the wireless communication requires no communication lines, such that the connection of the clothing treatment machines 2, 3, and 4 is not interrupted, and a level of work difficulty and work time can be reduced.

Meanwhile, while not in use, the general clothing treatment machines can be turned off or switched into a standby mode; and when needed, the representative clothing treatment machine can turn on or wake up at least one of the clothing treatment machines, thereby reducing power consumption more effectively.

FIG. 8C illustrates an example in which the dryer 3 serving as the representative clothing treatment machine communicates with the external device 1000, and the clothing treatment machines 2, 3, and 4 communicate with each other by wire.

The clothing treatment machines 2, 3, and 4 communicate with each other by wire, thereby reducing power consumption and providing much faster communication speed than the wireless communication. Further, there is no need to install a low power short range communication module, such that communication can be provided at the lowest production costs with a high communication speed.

According to the embodiments of the present disclosure, the clothing treatment machines 2, 3, and 4 are coupled to each other at adjacent positions, such that one Wi-Fi communication module for communication with the server 1010 and the mobile terminal 1020 and a plurality of low power communication module (e.g., BLUETOOTH, Bluetooth Low Energy (BLE), ZIGBEE, etc.) for communication therebetween can be provided. In addition, wired communication between the machines can also be provided, thereby reducing total power consumption.

The Wi-Fi communication consumes 10 times more power than the low power communication, such as BLE and the like, such that by minimizing the number of Wi-Fi communication modules and Wi-Fi communication, power consumption can be reduced.

By executing an application using the mobile terminal 1020, or by accessing a predetermined website, a user can monitor and control the clothing treatment apparatus 1. In this embodiment, the clothing treatment machines are connected to each other by communication, such that the user can easily use and manage the machines. According to at least one of the embodiments of the present disclosure, any one of the clothing treatment machines can communicate with the external device such as the server 1010, the mobile terminal 1020, etc., and can transmit and receive various signals, such as a control command, information, etc., with the other clothing treatment machines, thereby reducing costs.

In addition, the machines can communicate with each other, such that the operation of the washing machine 2, the dryer 3, and the refresher 4 can be controlled with a single operation panel, thereby improving convenience in operation.

Meanwhile, the heating device 6 for heating air also has a communication module, such that the heating device 6 can communicate with the representative clothing treatment machine and/or the general clothing treatment machines.

The air heated by the heating device 6 can be supplied to at least one of the washing machine 2, the dryer 3, and the refresher 4. In this situation, the heating device 6 can receive a predetermined request from the washing machine 2, the dryer 3, and the refresher 4, or can receive sensing data from sensors included in the washing machine 2, the dryer 3, and the refresher 4. Further, the heating device 6 can transmit information, such as current state information, reserved operations, etc., to the respective clothing treatment machines 2, 3, and 4.

Figure 9A:
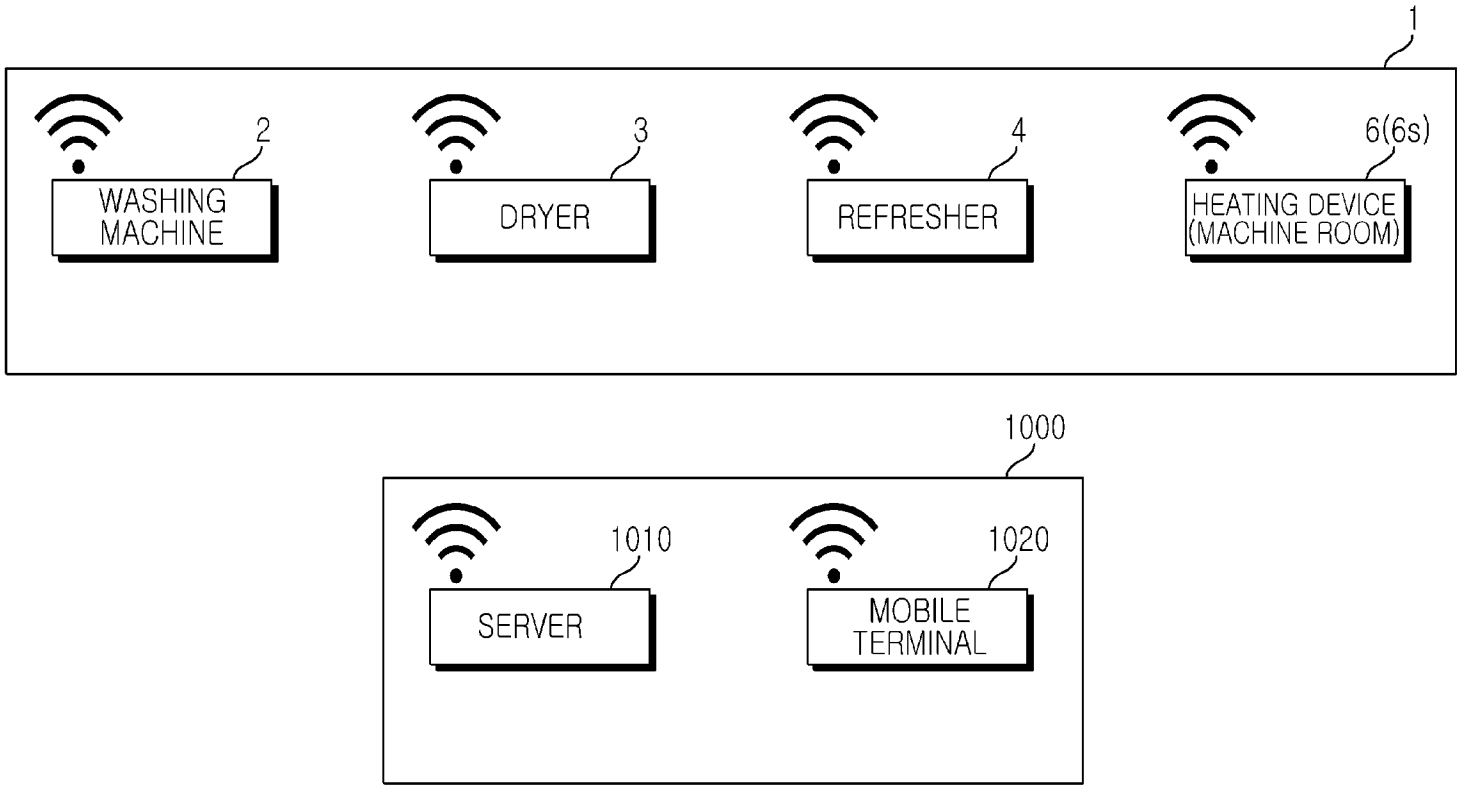
FIGS. 9A to 9C are diagrams referred to in the description of various communication connection structures according to embodiments of the present disclosure.
Figure 9B:
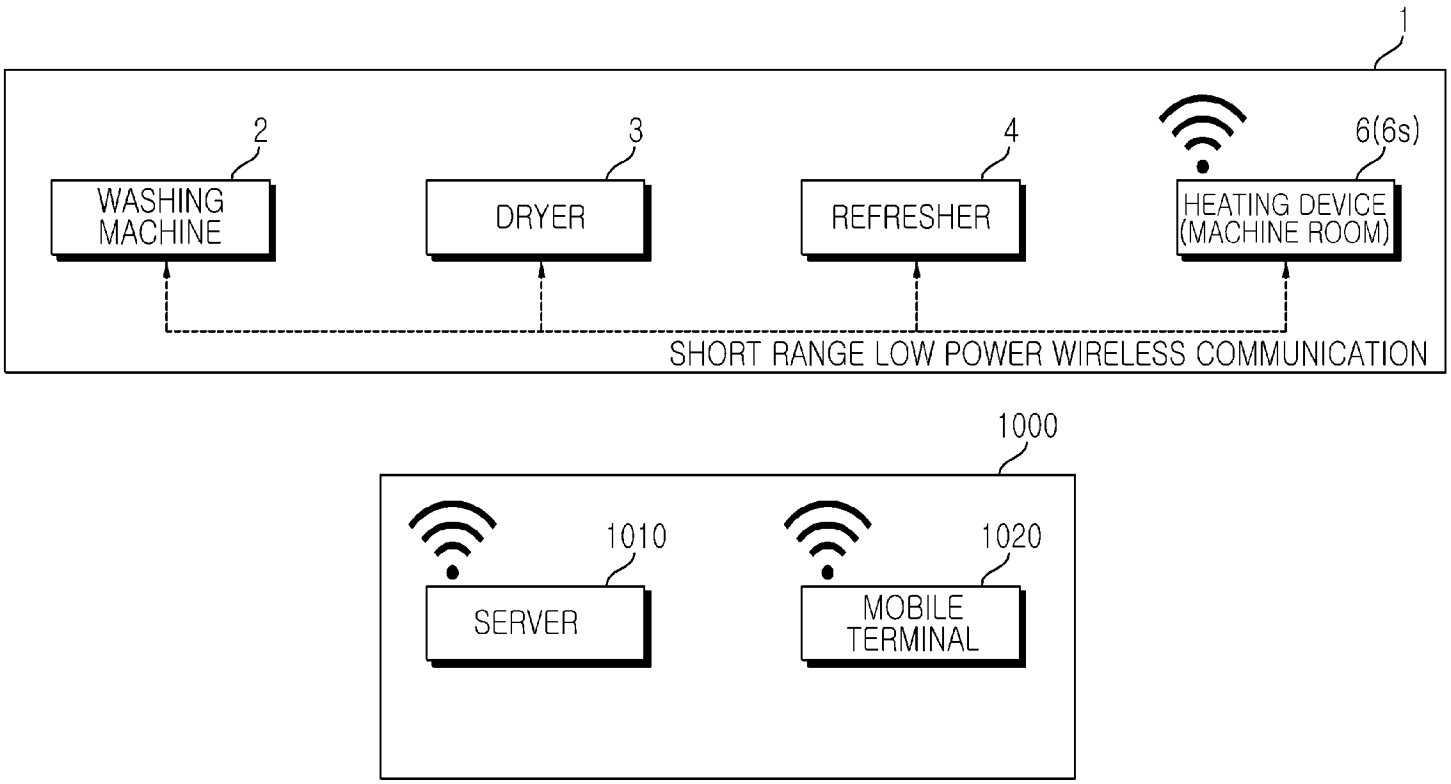
Figure 9C:
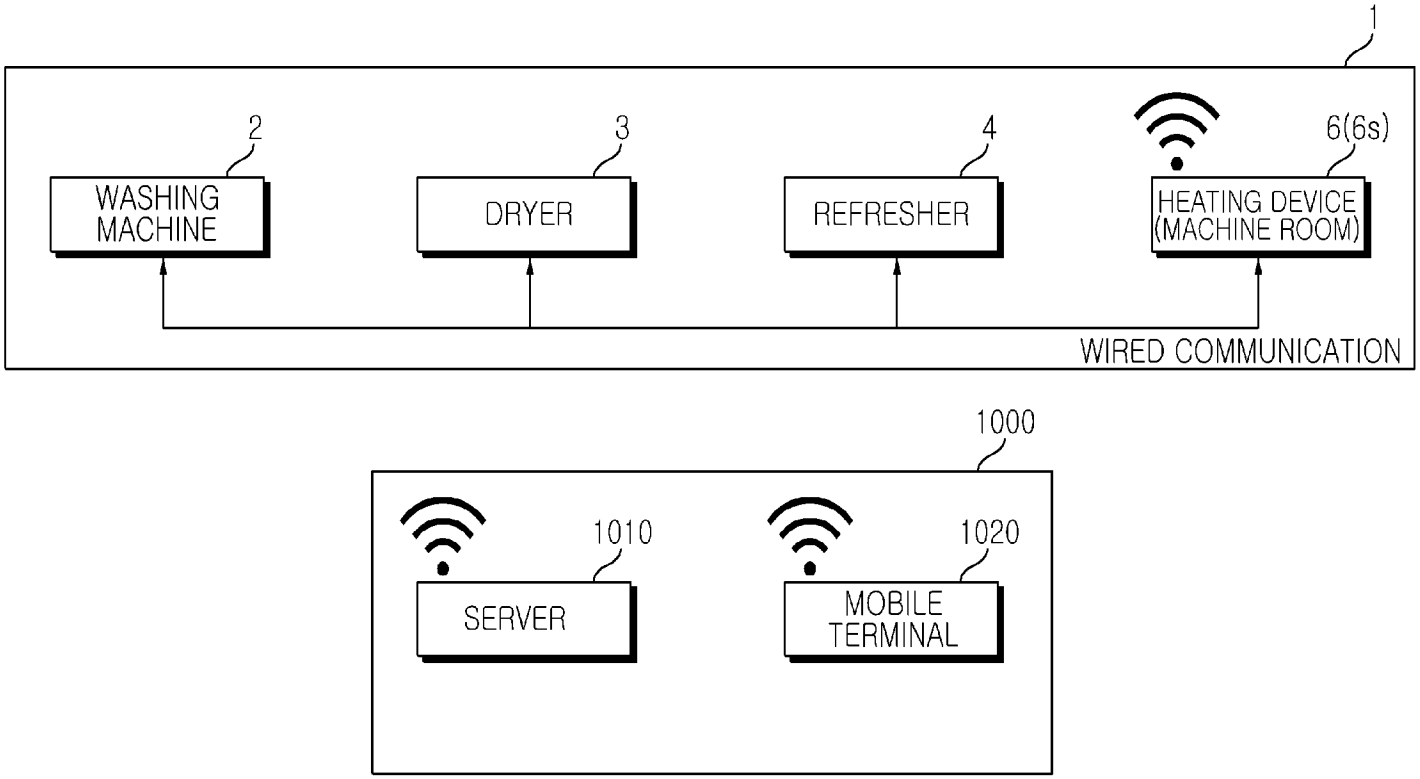

FIGS. 9A to 9C are diagrams referred to in the description of a communication connection structure according to an embodiment of the present disclosure, which is different from the embodiment of FIGS. 8A to 8C in that the heating device 6 or the machine room 6*s* is further included.

While the following description will be given of an example in which the heating device 6 includes a communication module, a device other than the heating device 6 can also be provided in the machine room 6*s*. In addition to the heating device 6, a communication module can be provided for other device or in a predetermined inner space of the machine 6*s*. Accordingly, the heating device 6 can be replaced with the machine room 6*s*.

Referring to FIG. 9A, each of the washing machine 2, the dryer 3, the refresher 4, and the heating device 6 can include the Wi-Fi communication module, and can wirelessly communicate with each other according to Wi-Fi standards.

Further, each of the washing machine 2, the dryer 3, the refresher 4, and the heating device 6 can freely communicate wirelessly with the external device 1000, such as the server 1010, the mobile terminal 1020, etc., according to the Wi-Fi standards to transmit and receive data.

Meanwhile, any one of the washing machine 2, the dryer 3, the refresher 4, and the heating device 6 can function as a wireless router. That is, any one of the Wi-Fi communication modules included in the clothing treatment machines 2, 3, 4, and 6 can function as a wireless router. Accordingly, even when an external wireless router of the clothing treatment apparatus 1, such as a wireless router of a home network and the like, is turned off, the machines 2, 3, 4, and 6 can wirelessly communicate with each other.

According to an embodiment of the present disclosure, any one of the washing machine 2, the dryer 3, the refresher 4, and the heating device 6 can include a representative communication module for wireless communication with an external device according to a first communication method. The clothing treatment machine including the representative communication module can be referred to as a representative clothing treatment machine.

The rest of the clothing treatment machines, other than the representative clothing treatment machine, can be referred to as general machines and can communicate by wire or wirelessly with the representative clothing treatment machine.

Depending on embodiments, the general machines as well as the representative machine can also communicate wirelessly with each other using the first communication method, and any one of the machines can function as the wireless router.

Meanwhile, only one of the machines 2, 3, 4, and 6 included in the clothing treatment apparatus 1 can include the representative communication module to communicate with the external device, and the other clothing treatment machines can communicate only with each other. For example, any one of the clothing treatment machines can include the Wi-Fi communication module for wireless communication by the Wi-Fi communication scheme and can wirelessly communicate with the external device 1000, such as the server 1010, the mobile terminal 1020, etc., according to the Wi-Fi standards. Further, the clothing treatment machines 2, 3, 4, and 6 can perform wired or wireless communication with each other.

Meanwhile, the representative clothing treatment machine and the other clothing treatment machines can perform communication using a second communication method which is different from the first communication method. Here, compared to the first communication method, the second communication method can be a low power short range wireless communication or wired communication method. For example, the first communication method can be the Wi-Fi communication, and the second communication method can be a short range communication method, such as Bluetooth and the like, which consumes relatively less power and has a short communication distance. Alternatively, the first communication method can be the Wi-fi communication, and the second communication method can be a wired communication method such as RS232, RS422, RS485, and the like.

FIGS. 9B and 9C are diagrams illustrating a case where the heating device 6 is the representative machine having the Wi-Fi communication module, and the washing machine 2, the dryer 3, and the refresher 4 are general clothing treatment machines having only the Bluetooth communication module. The heating device 6 also having the Bluetooth communication module can communicate with the washing machine 2, the dryer 3, and the refresher 4. FIGS. 9B and 9C are merely an example and the present disclosure is not limited thereto, and any one of the clothing treatment machines 2, 3, and 4 can also be the representative machine.

Referring to FIG. 9B, the clothing treatment machines 2, 3, 4, and 6 can perform short-range wireless communication, such as Bluetooth communication and the like, with each other. The external device 1000, such as the server 1010, the mobile terminal 1020, etc., can wirelessly communicate with the heating device 6 having the Wi-Fi communication module, to transmit a user's control command and to receive state information of the clothing treatment machines 2, 3, 4, and 6 and display the information. The heating device 6 can transmit a received control command to the clothing treatment machines 2, 3, and 4. In addition, the heating device 6 can transmit data, received from the clothing treatment machines 2, 3, and 4 to the server 1010, the mobile terminal 1020, and the like.

Accordingly, the plurality of clothing treatment machines 2, 3, and 4 can include only the short-range wireless communication modules for communication with nearby clothing treatment machines 2, 3, 4, and 6, thereby reducing production costs.

Only one of the machines 2, 3, 4, and 6 can include the Wi-Fi communication module and the others are connected by a low power wireless communication. Accordingly, the server 1010 or the mobile terminal 1020 can perform integrated management by using only one device and Wi-Fi communication, thereby minimizing power consumption.

The machines having the short range communication module can communicate with each other by low power communication, thereby minimizing unnecessary power consumption and costs required for Wi-Fi communication components. In addition, the wireless communication requires no communication lines, such that the connection of the clothing treatment machines 2, 3, and 4 is not interrupted, and a level of work difficulty and work time can be reduced.

Meanwhile, while not in use, the general clothing treatment machines can be turned off or switched into a standby mode; and when needed, the representative clothing treatment machine can turn on or wake up at least one of the clothing treatment machines, thereby reducing power consumption more effectively.

FIG. 9C illustrates an example in which the heating device 6 serving as the representative clothing treatment machine communicates with the external device 1000, and the clothing treatment machines 2, 3, 4, and 6 communicate with each other by wire.

The clothing treatment machines 2, 3, 4, and 6 communicate with each other by wire, thereby reducing power consumption and providing much faster communication speed than the wireless communication. Further, there is no need to install a low power short range communication module, such that communication can be provided at the lowest production costs with a high communication speed.

According to one embodiment of the present disclosure, the heating device 6 can be disposed between the washing machine 2 and the dryer 3. In this situation, the heating device 6 can communicate by wire with the washing machine 2 and the dryer 3, and can communicate wirelessly with the refresher 4.

According to one embodiment of the present disclosure, the control panel 5 can be disposed between the washing machine 2 and the dryer 3, and the heating device 6 is disposed at a rear side of the control panel 5. In this situation, the control panel 5 and the heating device 6 can be connected by wire for wired communication.

According to one embodiment of the present disclosure, the heating device 6 is disposed under the washing machine 2 or the dryer 3 such that the heating device 6 can wirelessly communicate with the washing machine 2, the dryer 3, and the refresher 4.

Figure 10:
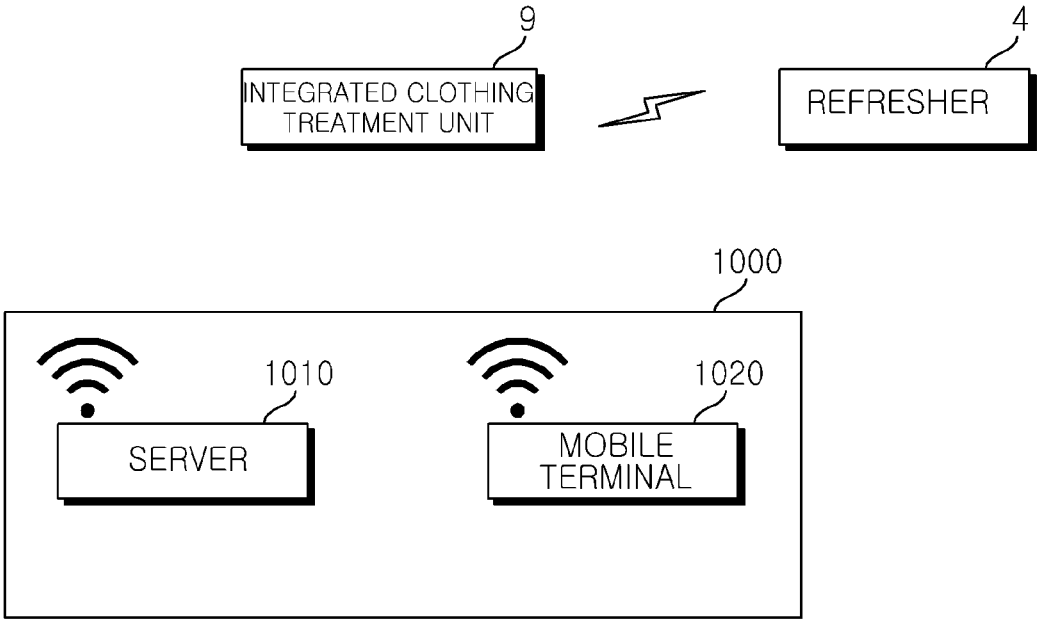
FIG. 10 is a diagram referred to in the description of a communication connection structure according to an embodiment of the present disclosure.

FIG. 10 is a diagram referred to in the description of a communication connection structure according to an embodiment of the present disclosure.

The clothing treatment unit 9 can be a concept that includes the washing machine 2, the dryer 3, and the heating device 6. The clothing treatment unit 9 can include a Wi-Fi communication module to wirelessly communicate with the external device 1000.

In addition, the clothing treatment unit 9 can communicate with the refresher 4 by Wi-Fi communication or short range wireless communication. Alternatively, the clothing treatment unit 9 can communicate by wire with the refresher 4.

The Wi-Fi communication module can be provided in any one of the washing machine 2, the dryer 3, and the heating device 6. The washing machine 2, the dryer 3, and the heating device 6 can be connected to each other via wired communication. Alternatively, the washing machine 2, the dryer 3, and the heating device 6 can communicate with each other by short range wireless communication.

Figure 11:
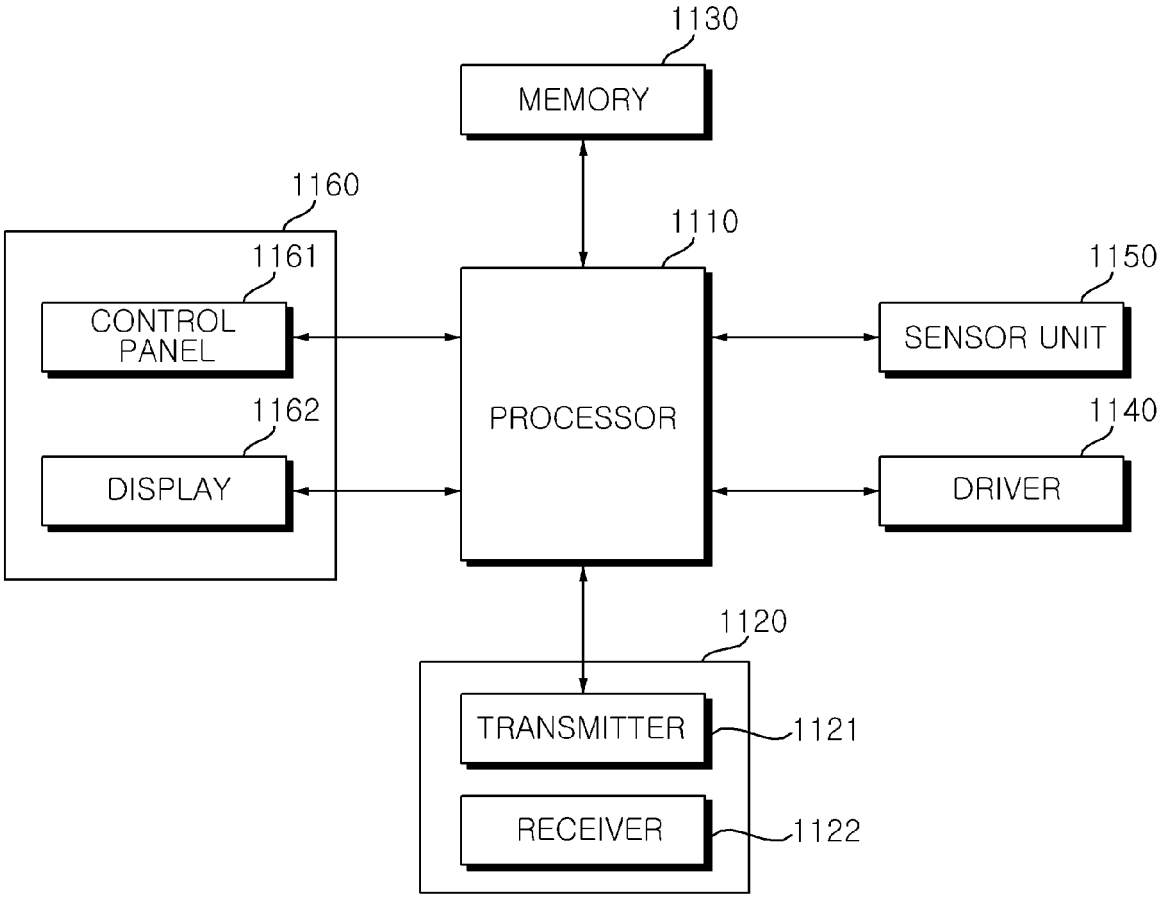
FIG. 11 is a schematic internal block diagram of a clothing treatment apparatus according to an embodiment of the present disclosure.

FIG. 11 is a schematic internal block diagram of a clothing treatment apparatus according to an embodiment of the present disclosure.

Referring to FIG. 11, the respective machines 2, 3, 4, and 6 included in the clothing treatment apparatus 1 can include a sensor unit 1150, an interface 1160, a memory 1130, a communication module 1120, and a processor 1110 for controlling the overall operation thereof, which can be commonly included in the respective machines 2, 3, 4, and 6, and a detailed configuration thereof can vary depending on the characteristics of the apparatus. In addition, the respective machines 2, 3, 4, and 6 can have components for performing predetermined operations and a driver 1140 for the components.

For example, the washing machine 2 can include a motor 250 for transmitting power to the first rotatable drum 240, and the drain pump 260 for discharging water, generated in the clothing treatment apparatus 1, to the outside thereof. The driver 1140 of the washing machine 2 can include a motor driver, such as an inverter and the like, for driving the motor 250, a pump driver for driving the drain pump 260, and the like. The dryer 3 can include a second drum 330 rotatably mounted therein, the container 340 in which water is stored, and the steam generator 350 connected to the container 340 by the water pipe 341. The steam generator 350 can be included in another configuration. For example, the steam generator 350 can be disposed in the machine room 6*s* or in the heating device 6. The refresher 4 can include the hanger 430 and a hanger motor for moving the hanger 430.

The type, number, and installation position of sensors included in the sensor unit 1150 can vary depending on the type of the machines 2, 3, 4, and 6.

The sensor unit 1150 can include a plurality of sensors for sensing a state of the clothing treatment apparatus 1. The sensor unit 1150 can include various types of sensors. For example, the sensor unit 1150 can include a temperature sensor, a humidity sensor, a pressure sensor, and the like. In addition, the sensors included in the sensor unit 1150 can be disposed at positions required for obtaining data. For example, various sensors can be disposed in the heating device 6, the duct system, and the respective clothing treatment machines 2, 3, and 4.

The memory 1130 can store control data for controlling operations of the machines 2, 3, 4, and 6, and operation data generated or sensed during the operations. The memory 1130 can store execution programs for each function, data for controlling the operations, and transmitted and received data.

The interface 1160 can include components for receiving a user's control command. For example, the interface 1160 can include a receiver for receiving a control command transmitted from a remote control device. Depending on embodiments, the interface 1160 can include at least one input means, such as a button, a switch, and a touch input means.

The interface 1160 can include a control panel 1611 and/or a display 1162. Here, the control panel 1611 can be the aforementioned control panel 5. Alternatively, the control panel 1611 can include a control panel disposed at another position, in addition to the control panel 5 disposed between the washing machine 2 and the dryer 3.

The display 1162 can visually display predetermined information. For example, the display 1162 can output state information of the clothing treatment apparatus 1, data sensed by the sensors, guide information guiding a specific operation/function, and the like.

Figure 16:
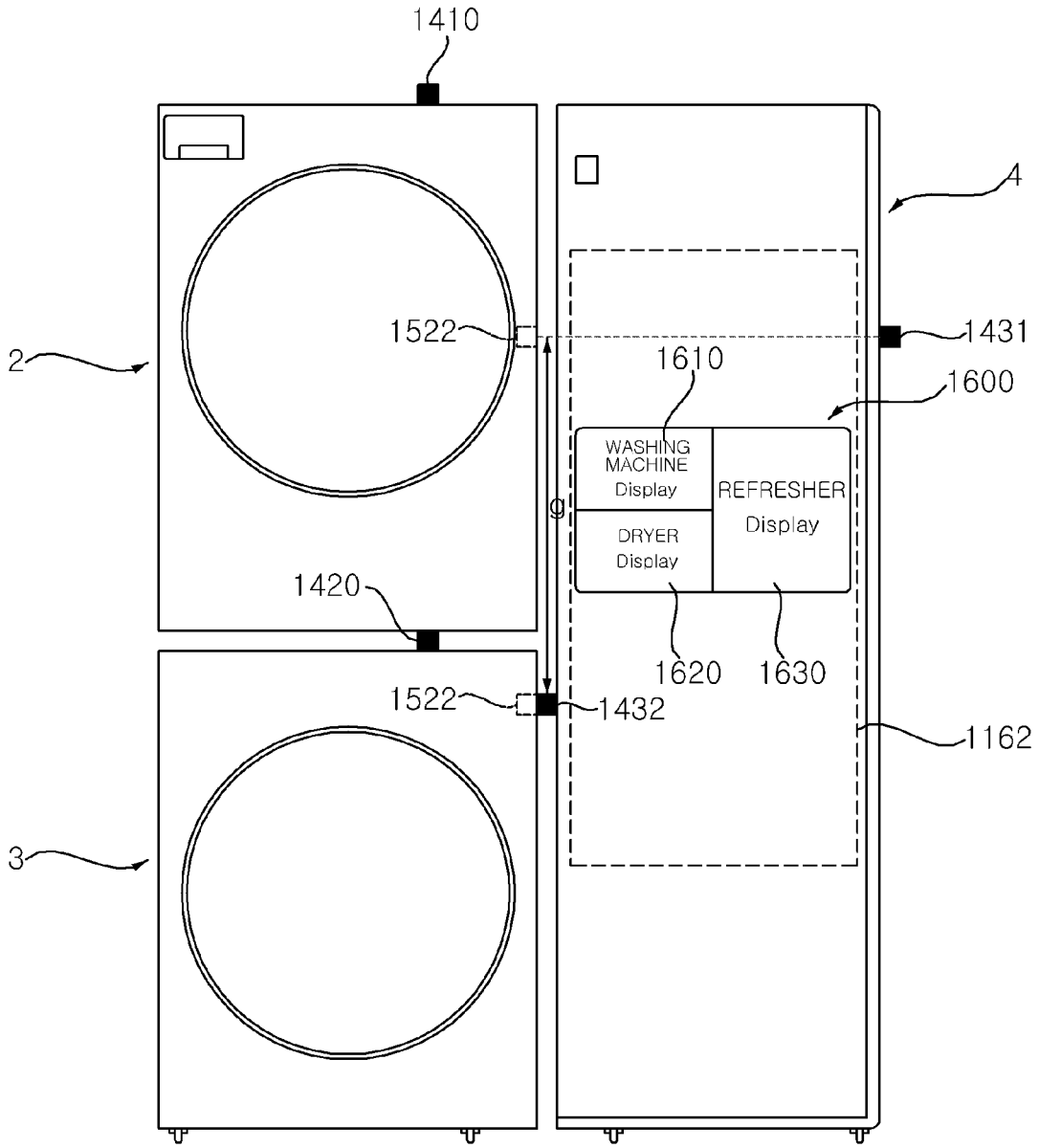

The refresher 4 can have the third case 410 and the third door 420 for opening and closing the third case 410. As illustrated in FIG. 3, the third door 420 can be rotatably coupled to the third case 410. Alternatively, the third door 420 can be a drawer type door which can be drawn forwardly from the third case 410. As shown in FIG. 16, display 1162 can be disposed on a front surface of the third door 420. Generally, the washing machine 2 and the dryer 3 can have front surfaces through which laundry therein can be seen, such that the display 1162 is desirably disposed on a front surface of the refresher 4. Accordingly, the display 1162 can be implemented as a large screen display compared to the front surfaces of the washing machine 2 and the dryer 3.

The display 1162 can be implemented as a touch screen and can be used as an input means.

The display 1162 can be exposed to the outside when a user approaches the third door 420 or sends a physical signal. The display 162 can be a mirror display. The display 1162 can include a light emitting element, such as an LED and the like, and can turn on the light emitting element when the user approaches the third door 420 or sends the physical signal.

A user interface provided on the display 1162 can reflect combinations, arrangements, and operating circumstances of the machines 2, 3, 4, and 6.

According to an embodiment of the present disclosure, the display 1162 can include an operation screen having a plurality of menu buttons (see 1815, 1825, and 1835 of FIG. 18B) for operating at least one of the washing machine 2, the dryer 3, the refresher 4, and the heating device 6.

Arrangement positions of the plurality of menu buttons 1815, 1825, and 1835 on the operation screen can vary according to arrangements of the washing machine 2, the dryer 3, and the refresher 4.

According to an embodiment of the present disclosure, the operation screen can be provided on the control panel 5. Even in this situation, the arrangement positions of the plurality of menu buttons 1815, 1825, and 1835 on the operation screen can vary according to the arrangement of the washing machine 2, the dryer 3, and the refresher 4. For example, the arrangement positions of the plurality of menu buttons 1815, 1825, and 1835 on the operation screen can change to match or substantially correspond to the relative spatial locations of the washing machine 2, the dryer 3, and the refresher 4, in the real world, such as how they are configured within the overall structure of the clothing treatment apparatus 1.

When a user command or predetermined data are input by operating the input means, the interface 1160 can apply the input data to the processor 1110.

According to the user command and the like, the processor 1110 can control the machines 2, 3, 4, and 6. For example, the processor 1110 can control the heating device 6 to heat air. Further, the processor 1110 can switch a passage to supply the air, heated by the heating device 6, to at least one of the clothing treatment machines 2, 3, and 4.

In addition, the processor 1110 can control the steam generator 350 and the like to supply steam to at least one of the clothing treatment machines 2, 3, and 4.

The processor 1110 can be the aforesaid controller 690.

Alternatively, the processor 1110 can correspond to controllers provided for at least some of the machines 2, 3, 4, and 6. For example, the washing machine 2, the dryer 3, the refresher 4, and the machine room 6*s* can include controllers for controlling each operation thereof. In this situation, the controllers can be mounted on a printed circuit board (PCB) disposed in the respective machines 2, 3, 4, and 6. The processor 1110 can correspond to the controllers of the machines 2, 3, 4, and 6 and can control the operations of the respective machines 2, 3, 4, and 6.

The respective controllers can communicate with each other. In some situations, at least one controller can be an upper level controller that can control other controllers and machines.

Further, rather than having individual controllers, some of the machines 2, 3, 4, and 6 can be operated under the control of the controllers mounted on the PCB of other machines.

The processor 1110 can be implemented as a block of the controller, and any one controller can include a plurality of processors 1110. The plurality of processors 1110 can be disposed in the same predetermined space or all the plurality of processors 1110 can be mounted on a single PCB. Alternatively, some of the plurality of processors 1110 can be mounted on another PCB.

The machines 2, 3, 4, and 6 can communicate with another device, the mobile terminal 1020, and the like through the communication module 1120. The communication module 1120 of at least some of the machines 2, 3, 4, and 6 can include a wireless communication module to communicate wirelessly with the mobile terminal 1020 and the like. In addition, at least one of the machines 2, 3, 4, and 6 can include a plurality of communication modules of different types.

The communication module 1120 (e.g., communication interface or transceiver) can include a transmitter 1121 for transmitting predetermined data to another device. In addition, the machines 2, 3, 4, and 6 can include a receiver 1122 for receiving predetermined data from another device. The transmitter 1121 and the receiver 1122 can be integrated as a transceiver.

By using the mobile terminal 1020, a user can execute an application or can access a predetermined website to remotely monitor and control the clothing treatment apparatus 1. In addition, the user can receive various services by registering the clothing treatment apparatus 1 with a manufacturer or a service provider.

FIGS. 12A to 12D are diagrams illustrating user interface screens provided during a product registration procedure. FIGS. 12A to 12D are diagrams illustrating an example of a method of product registration on a user interface screen displayed on a display of a mobile terminal (e.g., such as a user's smart phone or tablet device).

Figure 12A:
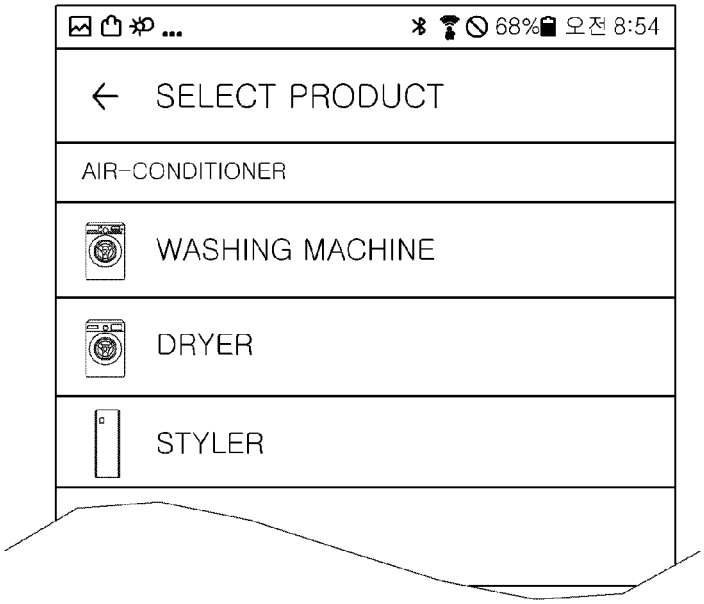
FIGS. 12A to 12D are diagrams illustrating user interface screens provided during a product registration procedure according to embodiments of the present disclosure.

When a user selects an application item related to a home appliance on a screen of the mobile terminal, the screen showing the home appliance application can be displayed as illustrated in FIG. 12A.

Figure 12B:
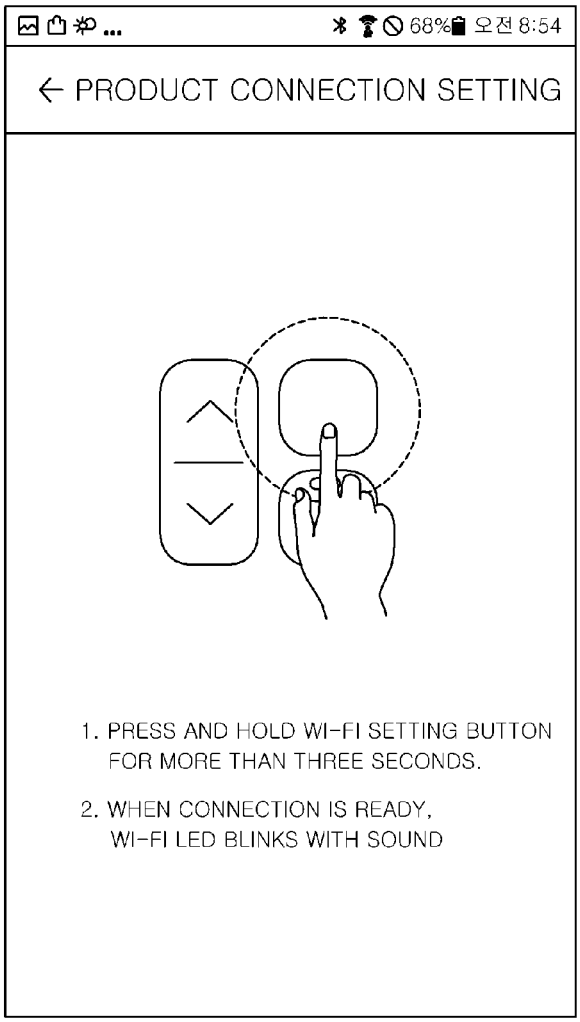

When a user selects any one of a plurality of home appliances provided on the user interface screen as illustrated in FIG. 12A, a guide screen for connection setup of the selected home appliance can be displayed as illustrated in FIG. 12B.

If the user is currently not in a logged in state, a login screen can be displayed which includes a login item, an ID input bar, a password input bar, and the like.

Figure 12C:
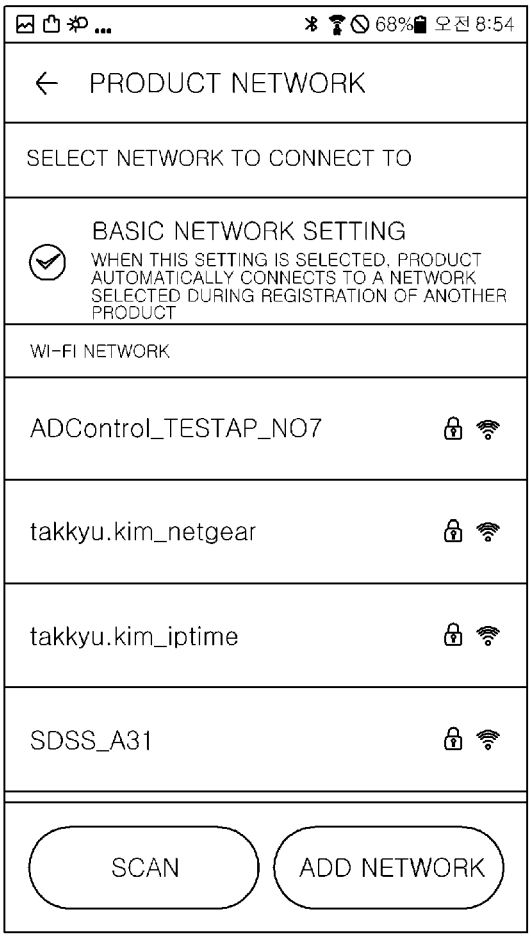

Meanwhile, once an operation is performed according to the guide screen provided as illustrated in FIG. 12B, a product network setting screen can be displayed as illustrated in FIG. 12C. For example, the product network setting screen can display a list of Wi-Fi access point (AP) devices.

If any one item is selected from the list on the product network setting screen, the mobile terminal is set to access a corresponding AP device.

Particularly, in an AP mode in which the home appliance functions as the AP device when a specific key of the home appliance is operated, the mobile terminal can access the home appliance before product registration. By operating the mobile terminal having accessed the home appliance, the user can input information corresponding to the AP device into a server and can register the product.

Figure 12D:
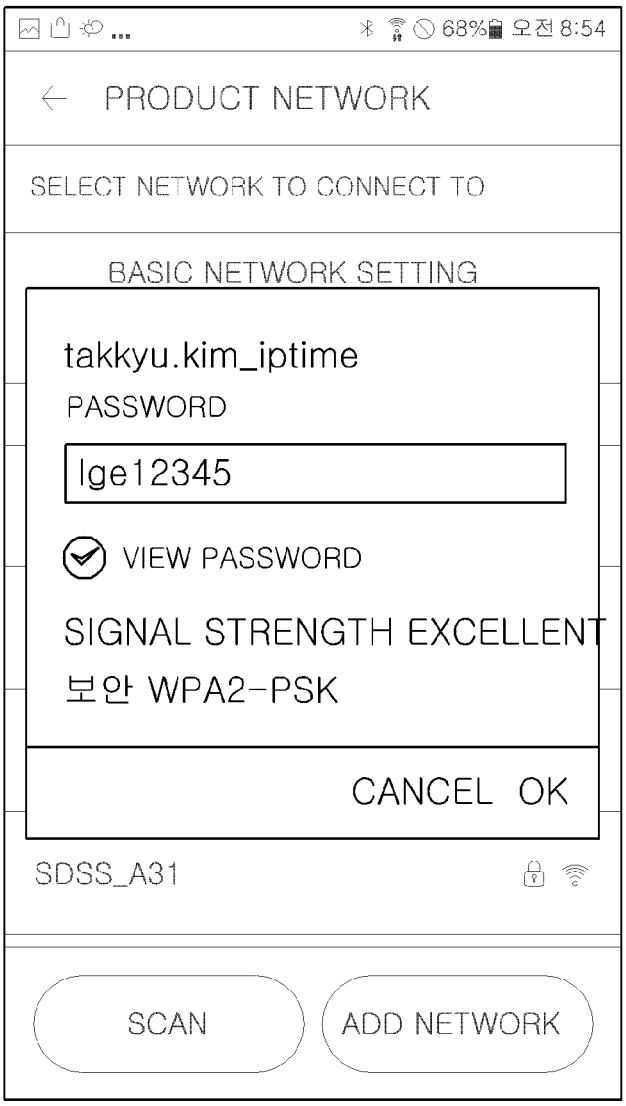

If the user selects any one AP device item, an input screen including a password input bar for the AP device can be displayed as illustrated in FIG. 12D.

Once the password is input, the selected AP device and password information are transmitted to the home appliance, such that the home appliance can be converted from the AP mode into a station mode in which the home appliance can access the AP device. The home appliance can access the corresponding AP device by using network information (SSID, password information, etc.) regarding the AP device.

The selected AP device and the password information are transmitted to the server, such that the home appliance can be registered with the server.

In addition, the home appliance can be registered with the server in such a manner that the home appliance in the AP mode transmits product information to the mobile terminal, and the mobile terminal transmits the product information of the home appliance to the server.

The clothing treatment apparatus 1 according to the present disclosure can include the washing machine 2, the dryer 3, and the refresher 4. In this situation, it can be considerably inconvenient for users to have to repeat the above procedure for each product as illustrated in FIGS. 12A to 12D.

In addition, if a user wants to control the heating device 6 using the mobile terminal 1020 by registering the heating device 6, there is a problem in that a separate hardware manipulator, such as a Wi-Fi Setup button and the like, is required.

However, according to an embodiment of the present disclosure, the machines 2, 3, 4, and 6, communicating with each other, can share device information, and a specific machine transmits the information to the server, such that all the machines 2, 3, 4, and 6 can be registered at once and can be controlled individually. Alternatively, a specific machine can transmit prestored device information of the machines 2, 3, 4, and 6 to the server 1010, such that all the machines 2, 3, 4, and 6 can be registered at once. If necessary, the specific device can transmit response data of the server 1010 to the respective machines 2, 3, 4, and 6, to complete registration.

Figure 13:
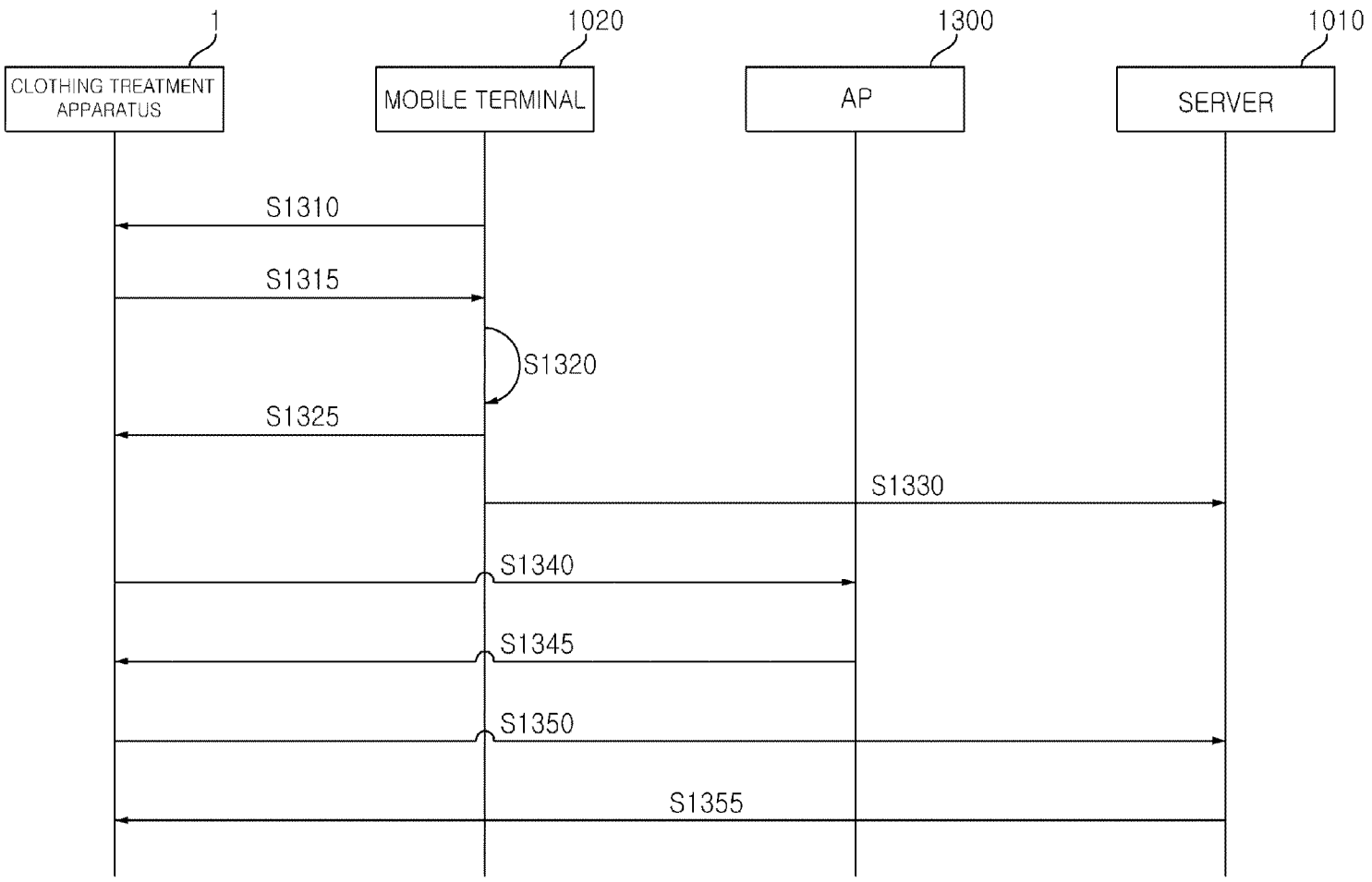
FIG. 13 is a flowchart illustrating a product registration procedure of a clothing treatment apparatus according to an embodiment of the present disclosure.
Figure 14:
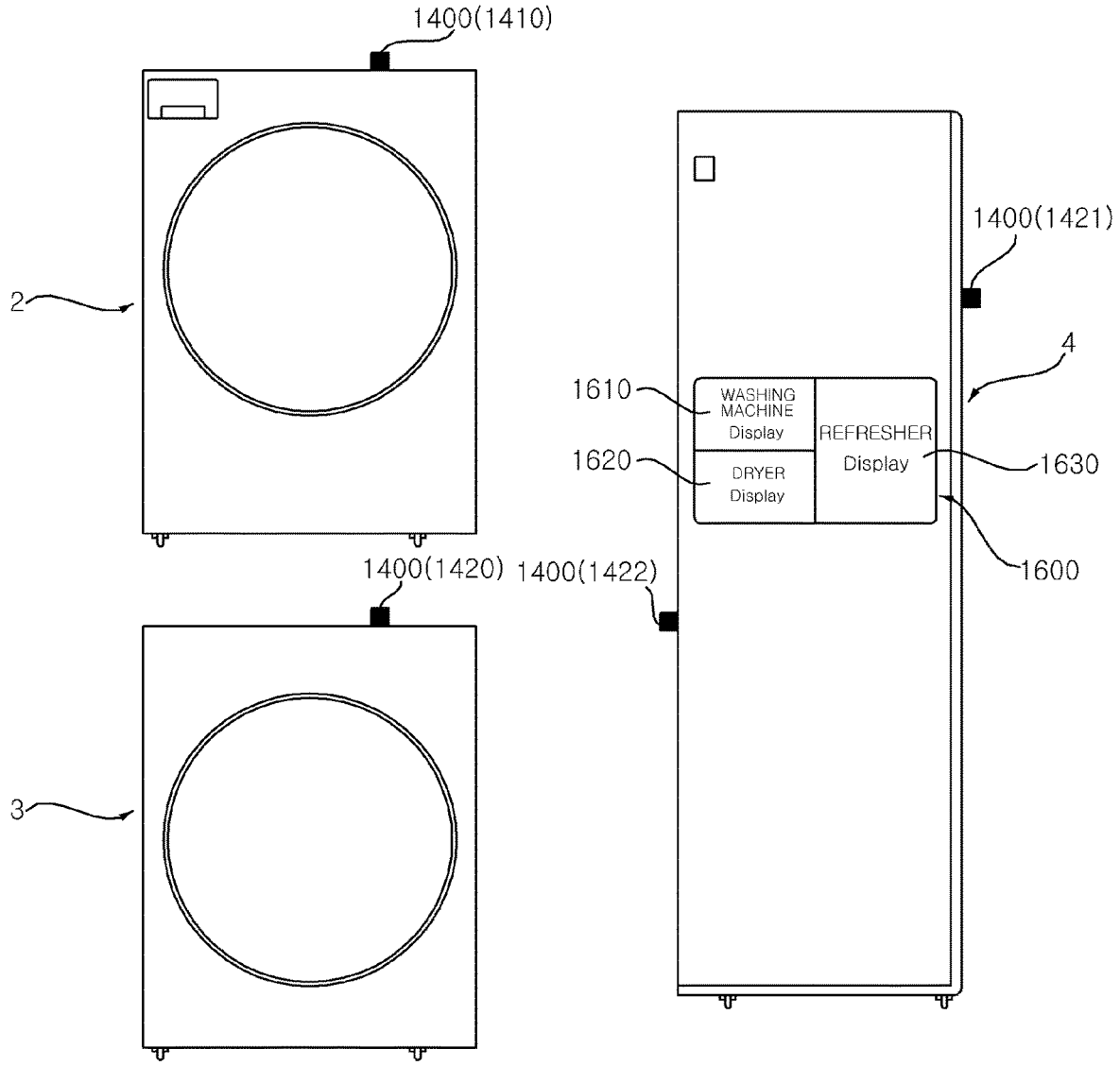
FIGS. 14 to 19 are diagrams referred to in the description of user interface screens corresponding to combinations of arrangements of the clothing treatment machines and arrangements of the clothing treatment machines according to embodiments of the present disclosure.

FIG. 13 is a flowchart illustrating a product registration procedure of a clothing treatment apparatus according to an embodiment of the present disclosure, in which a signal flow of the clothing treatment apparatus 1, the mobile terminal 1020, the access point (AP) device 1300, and the server 1010 is illustrated.

Referring to FIG. 13, among the machines 2, 3, 4, and 6 of the clothing treatment apparatus 1, the mobile terminal 1020 can communicate with a representative device including a communication module, such as a Wi-Fi communication module and the like, for communicating with an external device (S1315).

The mobile terminal 1020 attempts to access the representative device in the AP mode (S1310) and can communicate with the Wi-Fi communication module of the representative device (S1315).

To this end, once an application related to the home appliance is executed, the mobile terminal 1020 can provide the user interface screens as illustrated in FIGS. 12A and 12B.

Further, by operating a specific button of the clothing treatment apparatus 1 in advance, the clothing treatment apparatus 1 can be converted into the AP mode. For example, according to the guide information displayed on the provided user interface screen as illustrated in FIG. 12B, a user can operate the clothing treatment apparatus 1. In this situation, even when the heating device 6 is the representative device, the clothing treatment apparatus 1 can be converted into the AP mode by operating one of the buttons provided for the clothing treatment apparatus 1.

Meanwhile, the mobile terminal 1020 can receive information (identification information (SSID), password information, etc.) of the AP device 1300 to be registered (S1320).

When a user manually inputs information of the AP device 1300 to be registered (S1320), the mobile terminal 1020 can transmit information on the AP device 1300 which is to be accessed by the clothing treatment apparatus 1 (S1325).

Further, the mobile terminal 1020 can transmit a request for registration of the clothing treatment apparatus 1 to the server 1010 (S1330).

Depending on embodiments, the mobile terminal 1020 transmits the request for registration of the clothing treatment apparatus 1 by transmitting, to the server 1010, product information on the clothing treatment apparatus 1 and/or information on the AP device 1300 to be registered (S1330).

The representative device can transmit individual product information of the machines 2, 3, 4, and 6 to the mobile terminal 1020, so that the machines 2, 3, 4, and 6 can be registered at once as the clothing treatment apparatus 1, and all the machines 2, 3, 4, and 6 can be registered individually.

Meanwhile, by using the received information on the AP device 1300, the clothing treatment apparatus 1 can transmit an access request to the AP device 1300 (S1340), and the AP device 1300 can approve access based on the received identification information and password information (S1345).

In addition, upon accessing the AP device 1300, the clothing treatment apparatus 1 can transmit a request for product registration and a request for server connection to the server 1010 via the AP device 1300 (S1350).

In this situation, the clothing treatment apparatus 1 can transmit product information to the server 1010. The representative device can transmit individual product information of the machines 2, 3, 4, and 6 to the server 1010 so that the machines 2, 3, 4, and 6 can be registered at once as the clothing treatment apparatus 1, and all the machines 2, 3, 4, and 6 can be registered individually.

Further, depending on embodiments, the clothing treatment apparatus 1 can transmit information on the AP device 1300 and/or information on the mobile terminal 1020 to the server 1010.

Upon normally receiving the requests for registration from both the clothing treatment apparatus 1 and the mobile terminal 1020, the server 1010 can complete registration by using the received product information, and can transmit a message, indicating that the registration is complete, to the mobile terminal 1020 via the AP device 1300 (S1355). Accordingly, the clothing treatment apparatus 1 can be registered in a simple and convenient manner.

Meanwhile, according to an embodiment of the present disclosure, one of the machines 2, 3, 4, and 6 can function as a wireless router. In this situation, a machine functioning as a wireless router can also function as the AP device 1300.

According to at least one of the embodiments of the present disclosure, operation panels can be integrated, and integrated management of each clothing treatment apparatus can be provided using an application and the like.

In addition, the user interface screens provided on the display 1162 or the control panel 1161, 5 can vary according to the arrangement of the clothing treatment machines 2, 3, and 4.

FIGS. 14 to 19 are diagrams referred to in the description of user interface screens corresponding to combinations of arrangements of the clothing treatment machines and arrangements of the clothing treatment machines.

FIGS. 20 to 24 are diagrams referred to in the description of user interface screens provided for each circumstance according to an embodiment of the present disclosure.

In FIGS. 14 to 24, an example of providing a user interface screen on a display 1162 is illustrated. The user interface screen can be provided on the control panel 1161, 5.

Figure 15:
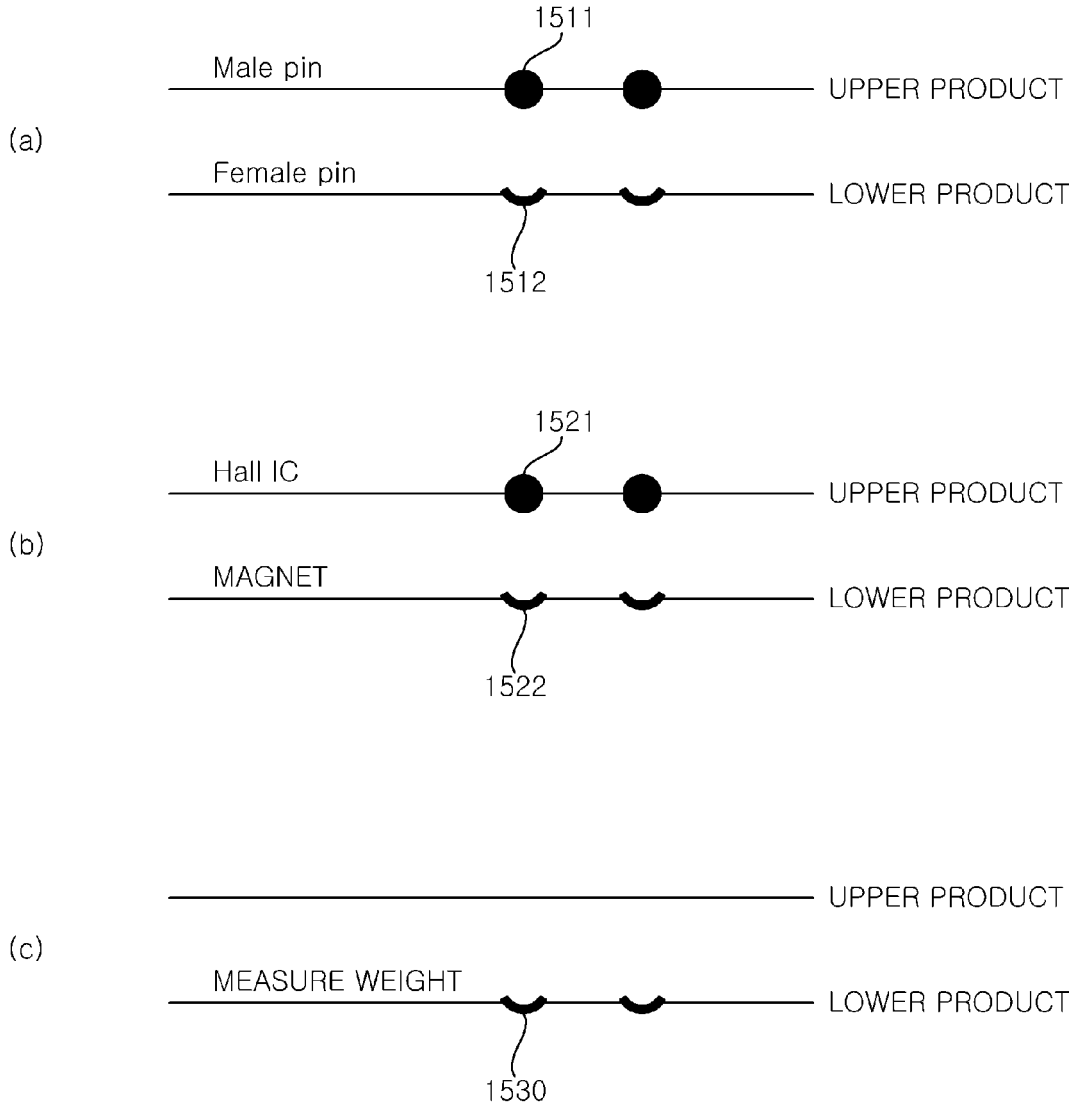

Referring to FIG. 15, including parts (a), (b) and (c), a user interface screen 1500 can be displayed on the display 1062 disposed on a front surface of the refresher 4. The user interface screen 1500 can be configured according to at least one of combinations, arrangements, and operating circumstances.

The user interface screen 1500 can be an operation screen having a plurality of menu buttons (see 1815, 1825, and 1835 of FIG. 18B) for operating at least one of the washing machine 2, the dryer 3, and the refresher 4.

The operation screen can have a washing machine display area (1510 of FIG. 14, 1810 of FIG. 18A, etc.) in which the menu button 1815 for operating the washing machine 2 is provided, a dryer display area (1520 of FIG. 14, 1820 of FIG. 18A, etc.) in which the menu button 1825 for operating the dryer 3 is provided, and a refresher display area (1530 of FIG. 14, 1830 of FIG. 18A, etc.) in which the menu button 1835 for operating the refresher 4 is provided.

Meanwhile, the arrangement of the washing machine display area (1510, 1810), the dryer display area (1520, 1820), and the refresher display area (1530, 1830) can be the same as the spatial arrangement of the washing machine 2, the dryer 3, and the refresher 4 in the real world. For example, virtual areas of the display can include menus that match or correspond to the physical positions of the washing machine 2, the dryer 3, and the refresher 4 within the overall configuration structure of the clothing treatment apparatus 1.

According to an embodiment of the present disclosure, a plurality of machines can be controlled in an integrated manner by using an operation screen corresponding to the arrangement of the devices.

Meanwhile, according to an embodiment of the present disclosure, the arrangement of the washing machine 2, the dryer 3, and the refresher 4 can be sensed automatically. To this end, each of the washing machine 2, the dryer 3, and the refresher 4 can include a position sensor 1400 for sensing other adjacent clothing treatment machines. Based on data sensed by the position sensors 1400, the processor 1110 can automatically configure the operation screen. Accordingly, arrangement positions of the plurality of menu buttons 1815, 1825, and 1835 on the operation screen can be changed automatically by reflecting the physical arrangement of the clothing treatment machines 2, 3, and 4.

The washing machine 2 and the dryer 3 can include the position sensor 1400 disposed on at least an upper surface thereof. According to a sensing method of the position sensor 1400 provided for the washing machine 2 and the dryer 3, an object to be sensed that forms a pair with the position sensor 1400 can be disposed on a lower surface of the washing machine 2 and the dryer 3.

The position sensor 1400 can recognize the object to be sensed, and can determine whether there is another device at the position of the object. Alternatively, the position sensor 1400 can recognize the object to be sensed and can transmit sensed data to the processor 1110, and the processor 1110 can identify the arrangement of the machines based on the position of the position sensor 1400 that transmits the sensed data.

The refresher 4 can include the position sensor 1400 disposed on at least one side thereof. More desirably, the refresher 4 can include the position sensor 1400 on both sides thereof. According to a sensing method of the position sensor 1400 included in the refresher 4, an object to be sensed that forms a pair with the position sensor 1400 can be disposed on the sides of the washing machine 2 and the dryer 3.

The washing machine 2 and the dryer 3 include upper panels 210*a* and 310*a*, respectively, which form upper surfaces thereof and lower panels 210*b* and 310*b*, respectively, which form lower surfaces thereof. The position sensors 1410 and 1420 can be disposed on the upper panels 210*a* and 310*a*, and the object to the sensed, which can be sensed by the position sensors 1410 and 1420, can be disposed on the lower panels 210*b* and 310*b*.

The refresher 4 can include a first position sensor 1431 disposed on the left side and a second position sensor 1432 disposed on the right side. The first position sensor 1431 and the second position sensor 1432 can be disposed at different heights.

The washing machine 2 and the dryer 3 can include side panels 210*e* and 310*e*, respectively, which form the left and right sides thereof, and the object to be sensed, which can be sensed by the first and second position sensors 1431 and 1432, can be disposed on the left and right side panels 210*e* and 310*e*.

According to an embodiment of the present disclosure, positions of the clothing treatment machines 2, 3, and 4 can be identified using sensing methods of Pin, position sensor, magnetic force sensor, weight sensor, and the like which can sense up and down and left and right positions when the clothing treatment machines 2, 3, and 4 are coupled to each other, and the arrangement on the operation screen can be changed automatically.

FIG. 15 is a diagram illustrating position sensing methods.

In FIG. 15, (a) illustrates a pin contact method. In the Pin contact method, when electrodes are connected by a power supply contact method, it is possible to recognize that another device is disposed in a corresponding area. Here, a male pin 1511 disposed at a lower end of an upper product is the object to be sensed, and a female pin 1512 disposed at an upper end of a lower product can be the position sensors 1410 and 1420. When a current flows through the female pin 1512, the lower product can sense that it is disposed on a lower side.

When a current flows through the left female pin, the refresher 4 can sense that it is disposed on the right side, and when a current flows through the right female pin, the refresher 4 can sense that it is disposed on the left side.

In FIG. 15, (b) illustrates a method of using an element, such as a Hall sensor and the like, in which a voltage changes according to magnetic field strength.

A Hall sensor 1522 can be disposed at the lower end of the upper product or at the upper end of the lower product. In addition, a magnet 1522 can be disposed at the upper end of the lower product or at the lower end of the upper product. The arrangement positions of the machines can be recognized according to directions in which the magnetism is sensed.

In FIG. 15, (c) illustrates a method of using a weight sensor.

A weight sensor 1530 is disposed at the upper end of the washing machine 2 or the dryer 3, and when another product is disposed at the upper end, the weight sensor 1530 can sense the weight. Upon sensing the weight at the upper end, the product can recognize that it is disposed at the lower side. The upper product, having no product disposed on the weight sensor, can automatically recognize that it is disposed at the upper side.

Alternatively, the respective clothing treatment machines 2, 3, and 4 can include a proximity sensor for sensing other devices.

Meanwhile, the data sensed by the position sensor 1400 or position determination results are collected by the processor 1110, and the processor 1110 can control the operation screen, corresponding to the arrangement of the clothing treatment machines 2, 3, and 4, to be displayed on the display 1162.

In the Pin contact method, when the washing machine 2 is disposed at the upper side, a connection switch 1410 provided at the upper portion of the washing machine 2 is not connected (e.g., see FIG. 16). Accordingly, the washing machine 2, in which no current flows through the connection switch 1410, can sense that it is disposed at the upper side.

In addition, a switch 1420 of the dryer 3 is connected to the washing machine 2, such that the dryer 3 can sense that it is disposed at the lower side.

Further, a connection switch 1432 on the right side of the refresher 4 is connected to the washing machine 2/dryer 3, such that the refresher 4 can sense that the washing machine 2/dryer 3 are disposed on the right side.

Referring to FIG. 16, a distance g between the first position sensor 1431 and the second position sensor 1432 can be equal to a distance g between an object 1522 to be sensed which is disposed on the washing machine 2 and an object 1522 to be sensed which is disposed on the dryer 3.

An operation screen 1500 reflecting the arrangement of the clothing treatment machines 2, 3, and 4 is displayed on the display 1162. When viewed from the front of the clothing treatment machines 2, 3, and 4, the washing machine 2 is disposed on the left upper side, the dryer 3 is disposed on the left lower side, and the refresher 4 is disposed on the right side. The operation screen 1500 also shows that when viewed from the front thereof, a washing machine display area 1510 is disposed on the left upper side, a dryer display area 1520 is disposed on the left lower side, and a refresher display area 1530 is disposed on the right side. Thus, the areas of the operation screen 1500 on the display can automatically match the physical arrangement of the clothing treatment machines 2, 3, and 4.

Figure 17:
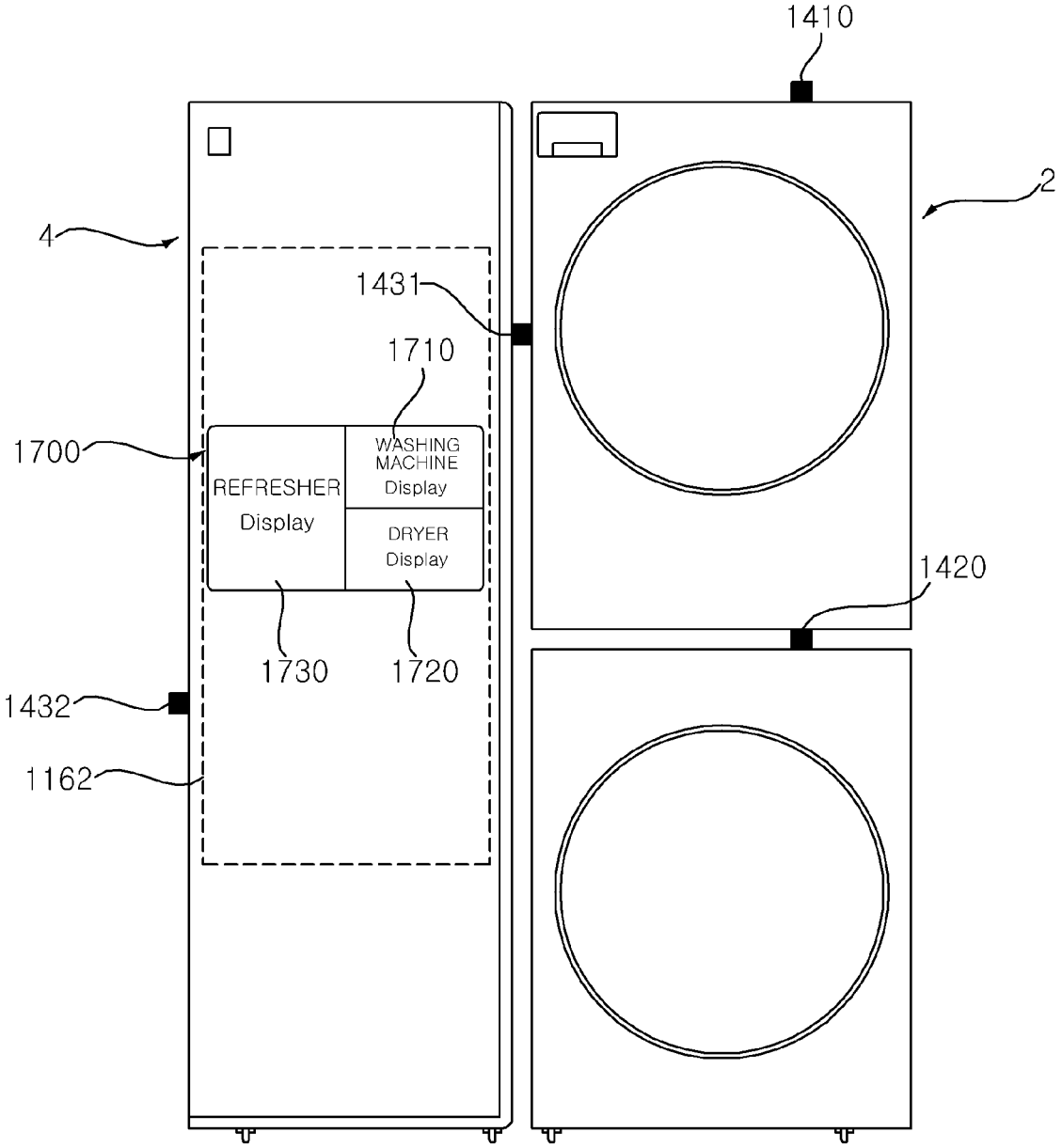

Referring to FIG. 17, when the washing machine 2 is disposed at the upper side, the connection switch 1410 at the upper portion of the washing machine 2 is not connected. Accordingly, the washing machine 2, in which no current flows through the connection switch 1410, can sense that it is disposed at the upper side. In addition, the switch 1420 of the dryer 3 is connected to the washing machine 2, such that the dryer 3 can sense that it is disposed at the lower side.

Further, a connection switch 1431 on the left side of the refresher 4 is connected to the washing machine 2/dryer 3, such that the refresher 4 can sense that the washing machine 2/dryer 3 are disposed on the left side.

An operation screen 1700 reflecting the arrangement of the clothing treatment machines 2, 3, and 4 is displayed on the display 1162. When viewed from the front of the clothing treatment machines 2, 3, and 4, the washing machine 2 is disposed on the right upper side, the dryer 3 is disposed on the right lower side, and the refresher 4 is disposed on the left side. The operation screen 1700 also shows that when viewed from the front thereof, a washing machine display area 1710 is disposed on the right upper side, a dryer display area 1720 is disposed on the right lower side, and a refresher display area 1730 is disposed on the right side.

Figure 18A:
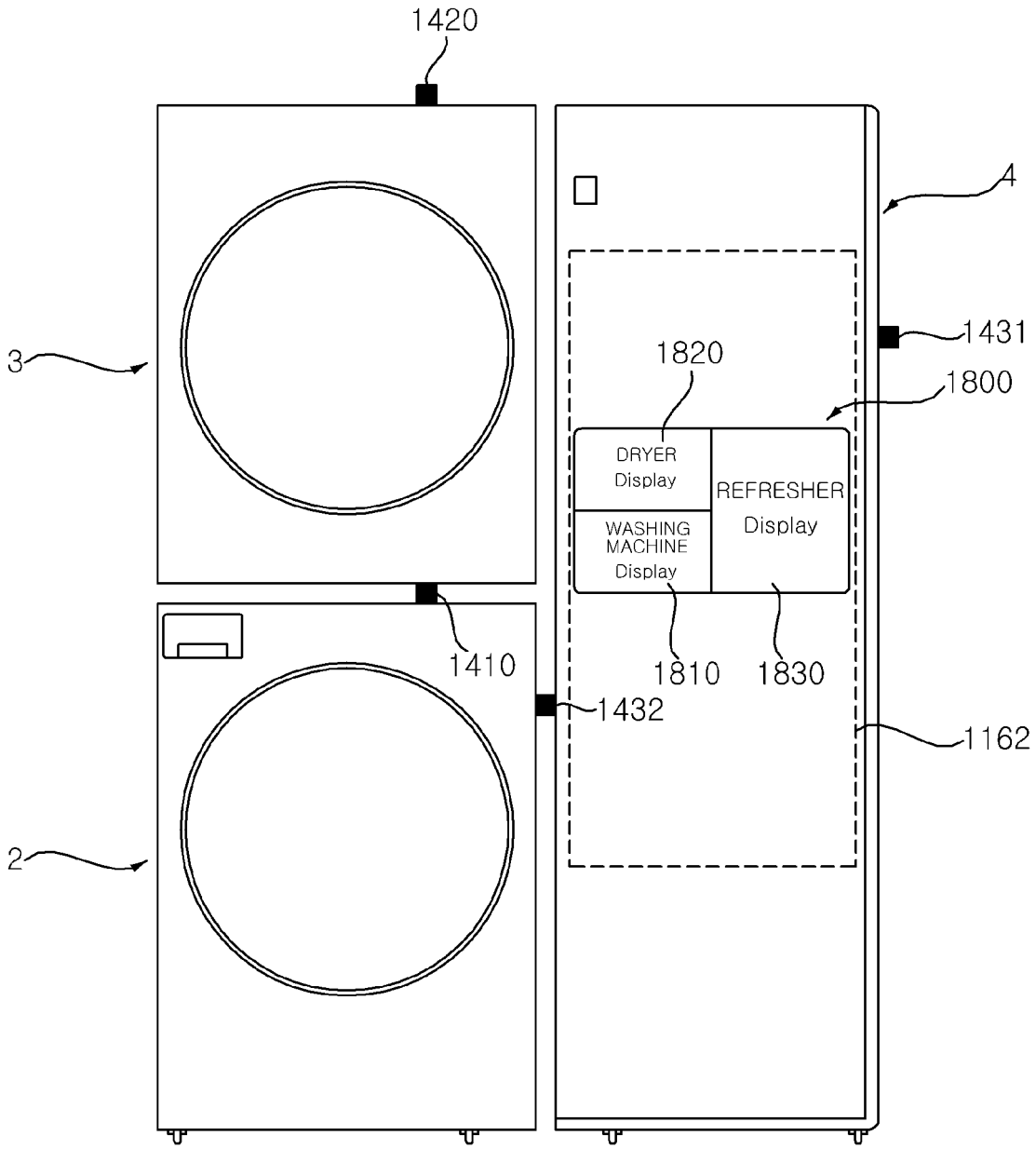

Referring to FIG. 18A, when the dryer 3 is disposed at the upper side, the connection switch 1420 at the upper portion of the dryer 3 is not connected. Accordingly, the dryer 3, in which no current flows through the connection switch 1420, can sense that it is disposed at the upper side. In addition, the connection switch 1410 of the washing machine 2 is connected to the dryer 3, such that the washing machine 2 can sense that it is at the lower side.

Further, the connection switch 1432 on the right side of the refresher 4 is connected to the washing machine 2/dryer 3, such that the refresher 4 can sense that the washing machine 2/dryer 3 are disposed on the right side.

An operation screen 1800 reflecting the physical arrangement of the clothing treatment machines 2, 3, and 4 is displayed on the display 1162. When viewed from the front of the clothing treatment machines 2, 3, and 4, the dryer 3 is disposed on the left upper side, the washing machine 2 is disposed on the left lower side, and the refresher 4 is disposed on the right side. The operation screen 1500 also shows that when viewed from the front thereof, a dryer display area 1820 is disposed on the left upper side, a washing machine display area 1810 is disposed on the left lower side, and a refresher display area 1830 is disposed on the right side.

Figure 18B:
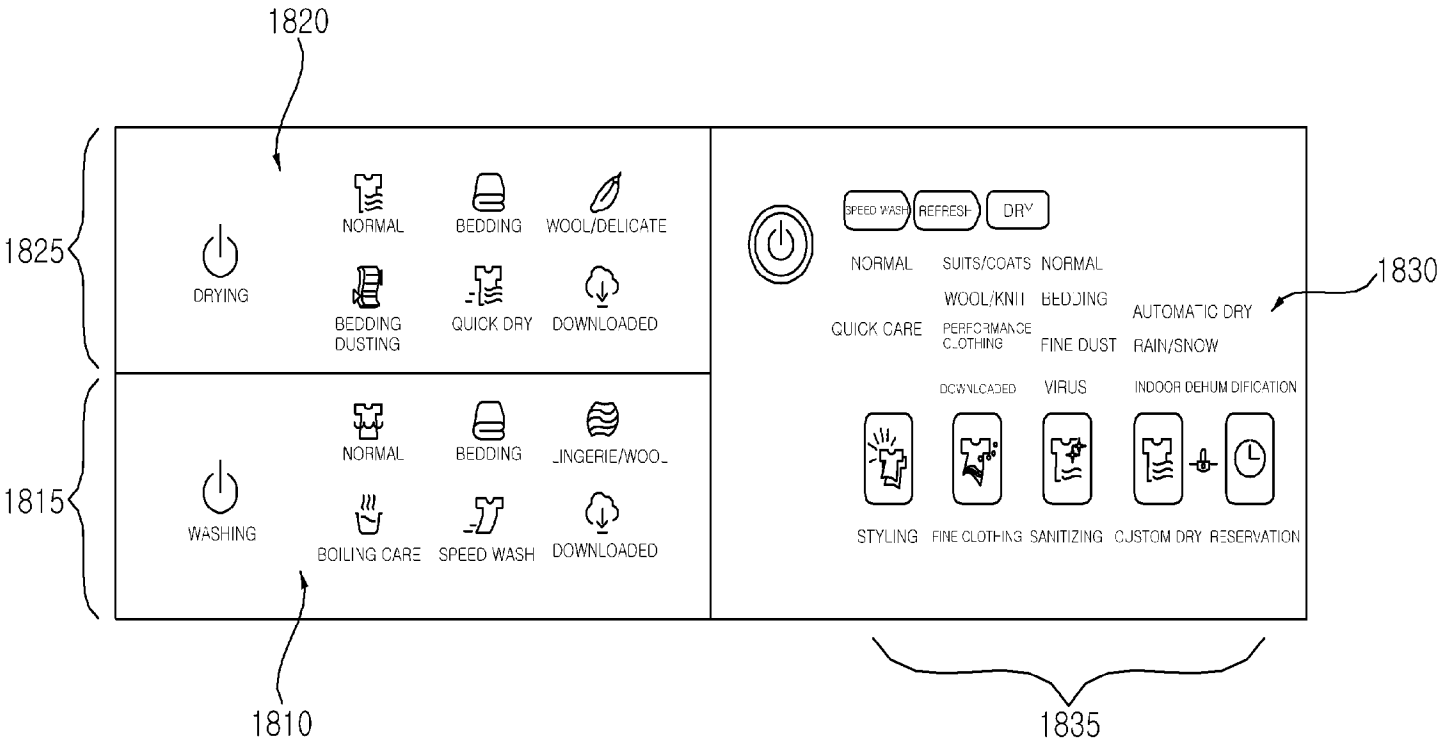

Referring to FIG. 18B, a plurality of menu buttons 1825 for operating the dryer 3 are provided in the dryer display area 1820 at the left upper side. A plurality of menu buttons 1815 for operating the washing machine 2 are provided in the washing machine display area 1810 at the left lower side. Also, a plurality of menu buttons 1835 for operating the refresher 4 can be provided in the refresher display area 1830 on the right side.

Figure 19:
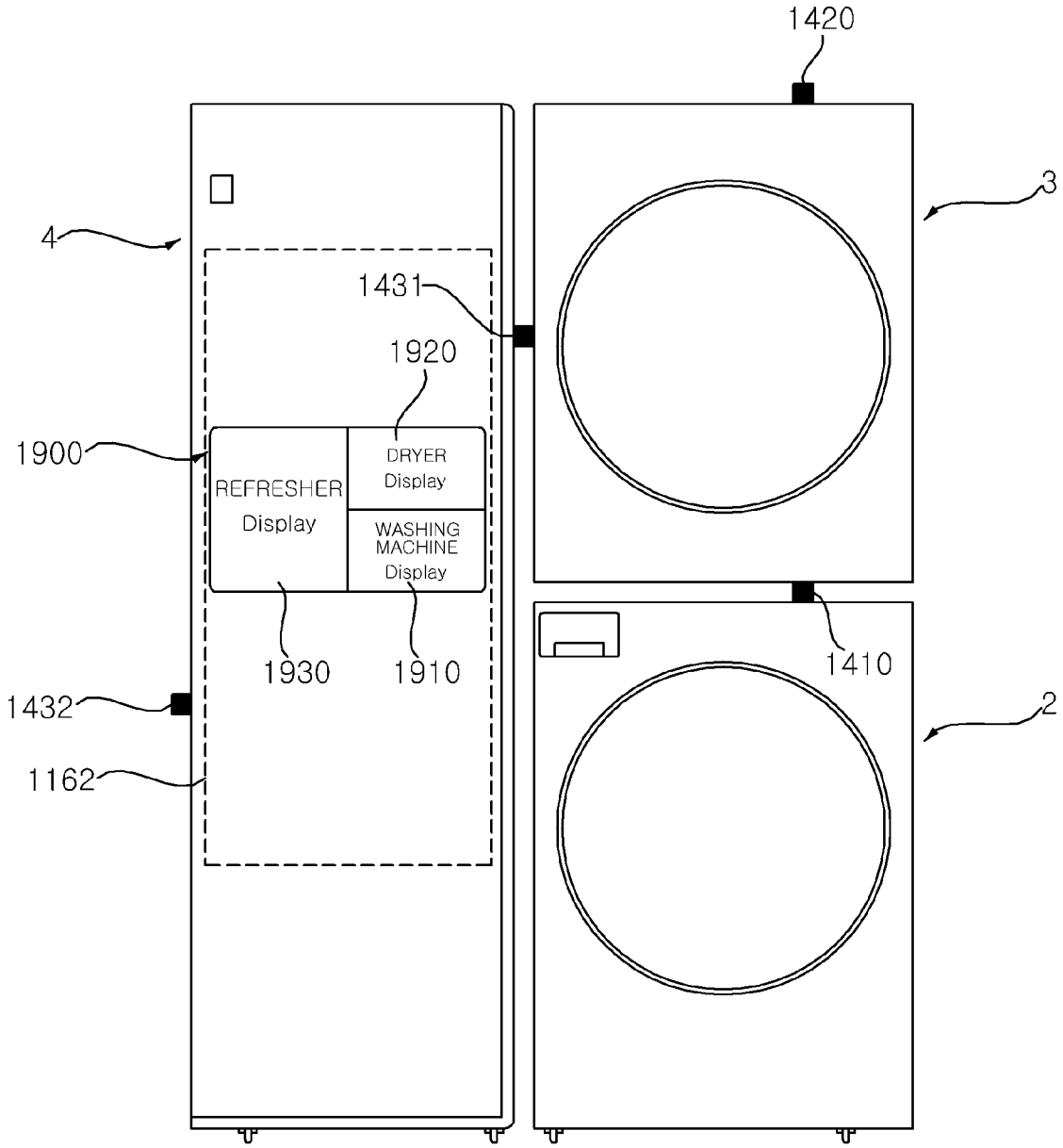

Referring to FIG. 19, when the dryer 3 is disposed at the upper side, the connection switch 1420 at the upper portion of the dryer 3 is not connected. Accordingly, the dryer 3, in which no current flows through the connection switch 1420, can sense that it is disposed at the upper side. In addition, the connection switch 1410 of the washing machine 2 is connected to the dryer 3, such that the washing machine 2 can sense that it is disposed at the lower side.

Further, the connection switch 1431 on the left side of the refresher 4 is connected to the washing machine 2/dryer 3, such that the refresher 4 can sense that the washing machine 2/dryer 3 are disposed on the left side.

An operation screen 1900 reflecting the arrangement of the clothing treatment machines 2, 3, and 4 is displayed on the display 1162. When viewed from the front of the clothing treatment machines 2, 3, and 4, the dryer 3 is disposed on the right upper side, the washing machine 2 is disposed on the right lower side, and the refresher 4 is disposed on the left side. The operation screen 1500 also shows that when viewed from the front thereof, a dryer display area 1820 is disposed on the right upper side, a washing machine display area 1810 is disposed on the right lower side, and a refresher display area 1830 is disposed on the left side.

According to at least one of the embodiments of the present disclosure, an intuitive user experience can be provided according to the arrangement of the clothing treatment machines. Further, according to at least one of the embodiments of the present disclosure, the arrangement of the clothing treatment machines can be sensed automatically and various areas of the display screen can be automatically configured.

The display 1162 can be exposed to the outside when a user sends a physical signal to the door. In addition, the user interface provided by the display 1162 can reflect combinations, arrangements, operating circumstances of the machines.

In response to an input to the washing machine 2, the dryer 3, or the refresher 4, the display 1062 can change brightness of a display area that corresponds to the input, among the washing machine display area, the dryer display area, and the refresher display area.

In addition, in response to an input to the washing machine 2, the dryer 3, or the refresher 4, an internal LED provided in the washing machine 2, the dryer 3, or the refresher 4 can be turned on.

Alternatively, in response to an input to the washing machine 2, the dryer 3, or the refresher 4, the display 1162 can display only a display area that corresponds to the input, among the washing machine display area, the dryer display area, and the refresher display area. In this case, only a display area that corresponds to the input can be enlarged on the display, among the washing machine display area, the dryer display area, and the refresher display area.

Figure 20:
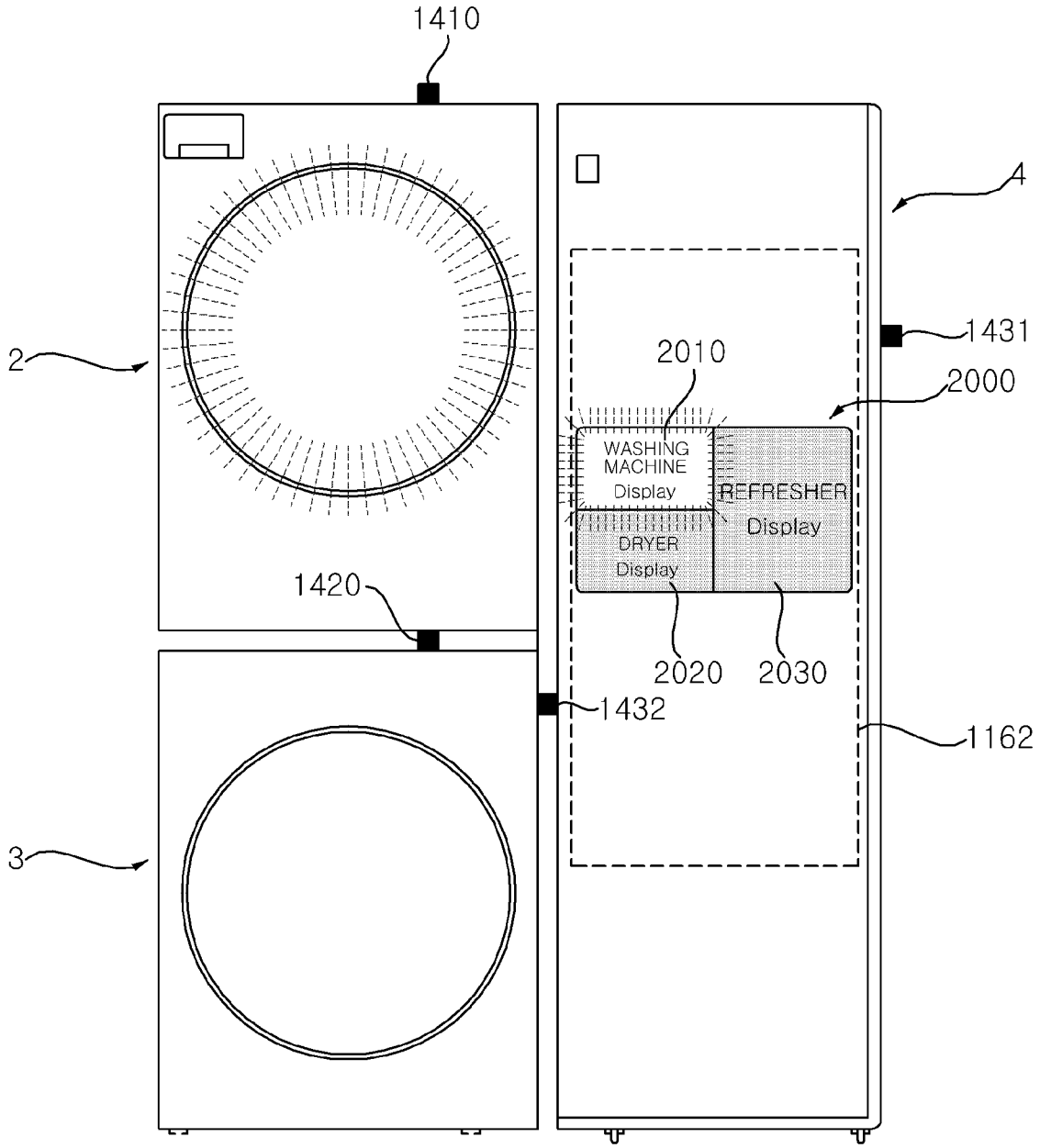
FIGS. 20 to 23 are diagrams referred to in the description of user interface screens provided for various circumstances according to embodiments of the present disclosure.

Referring to FIG. 20, an operation screen 200 can include a washing machine display area 2010, a dryer display area 2020, and a refresher display area 2030 in which the arrangement of the clothing treatment machines 2, 3, and 4 is reflected.

When a user knocks on or touches the washing machine 2, only the washing machine display area 2010 can be lit or can increase in brightness, among the washing machine display area 2010, the dryer display area 2020, and the refresher display area 2030. Further, the internal LED of the washing machine 2 can be turned on.

Alternatively, in response to an input to the washing machine 2, the dryer 3, or the refresher 4, the display 1162 can display only a display area that corresponds to the input, among the washing machine display area, the dryer display area, and the refresher display area.

Figure 21:
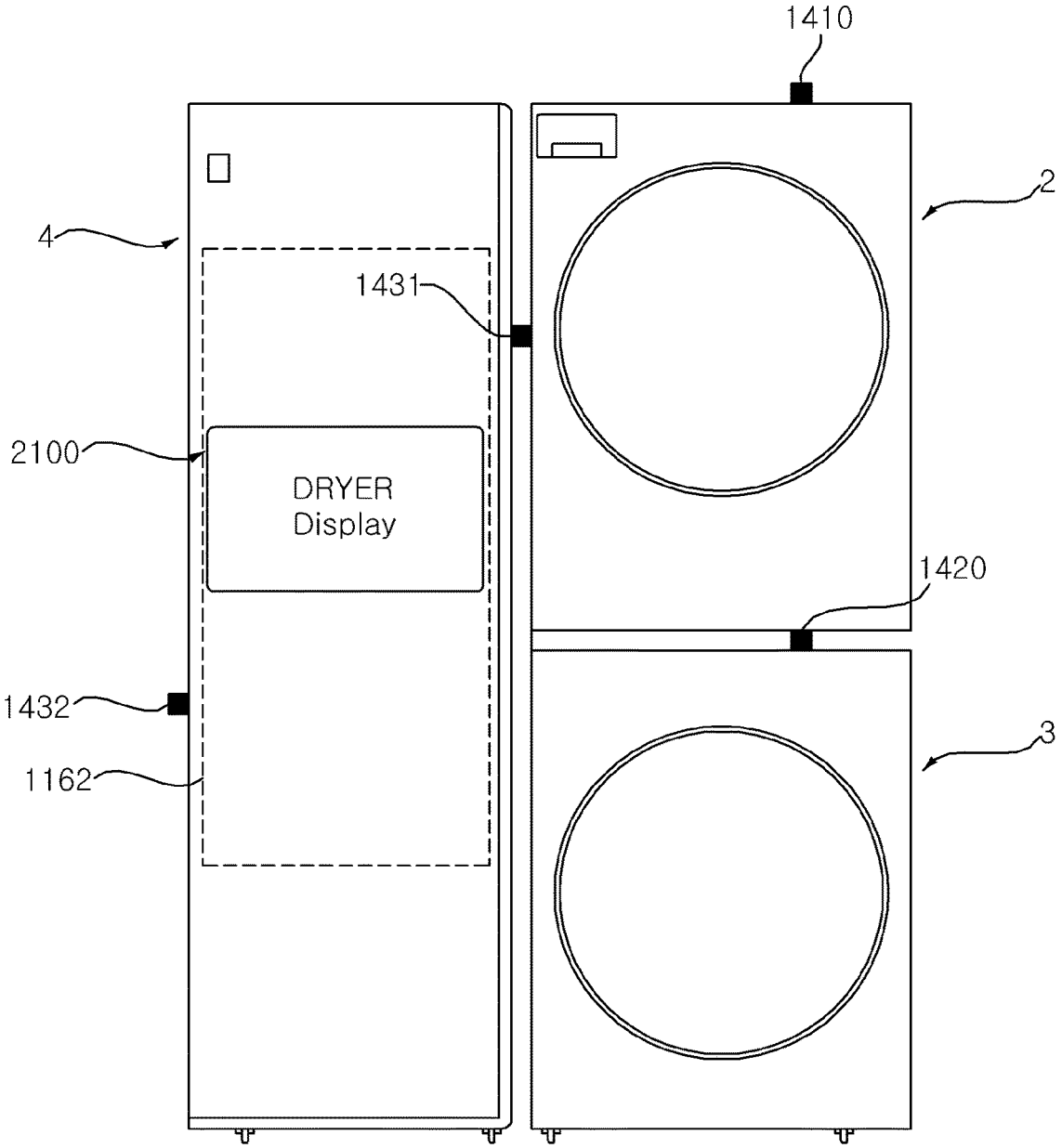

Referring to FIG. 21, when a user knocks on or touches the dryer 3, only the dryer display area 2100 can be enlarged. Further, the internal LED of the dryer 3 can be turned on.

Figure 22:
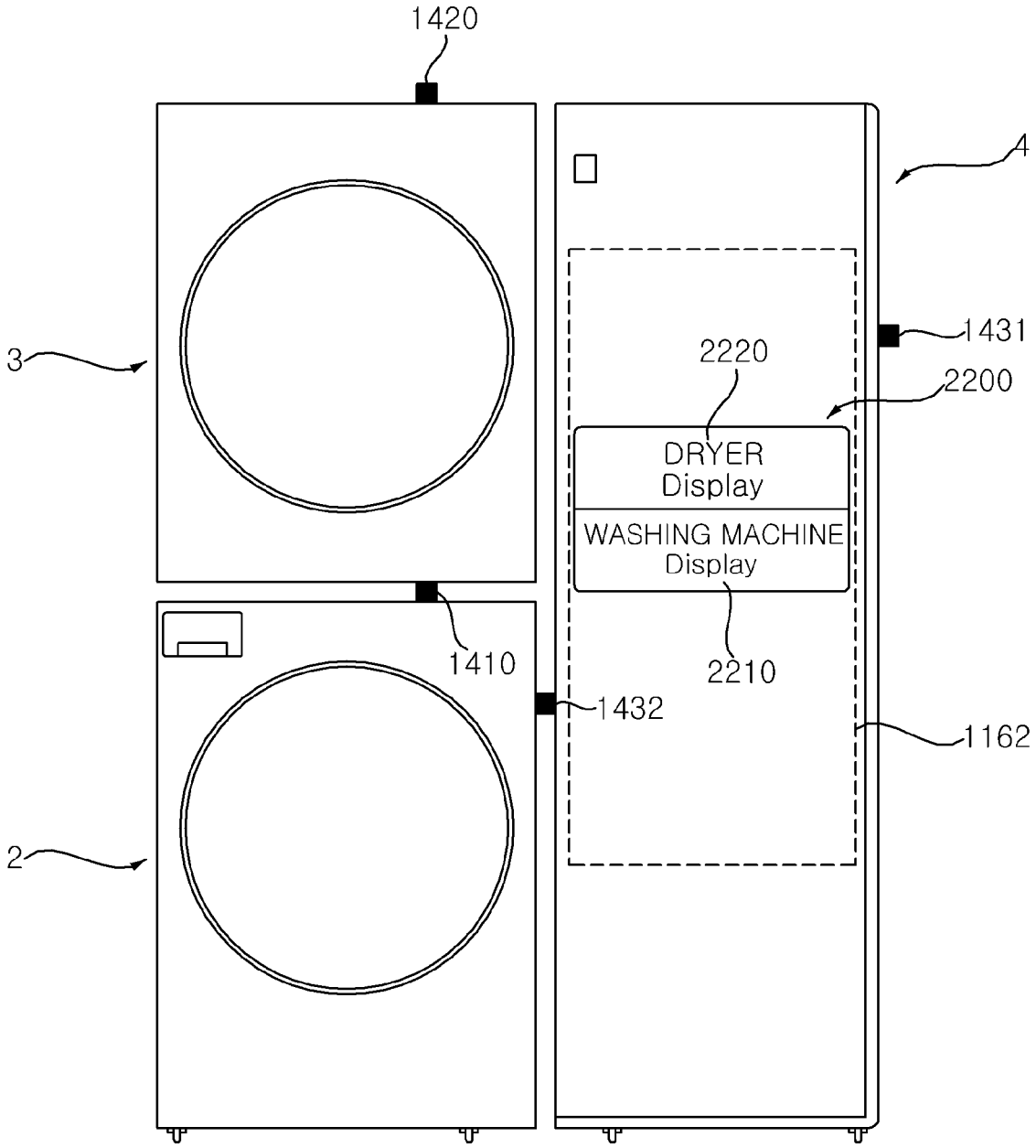

Depending on circumstances, the operation screen 2200 can include only areas corresponding to some of the clothing treatment machines 2, 3, and 4. Referring to FIG. 22, the operation screen 2200 can include the dryer display area 2020 at the upper side and the washing machine display area 2010 at the lower side. In other words, when the user is interacting physically with a specific one of the clothing treatment machines 2, 3, and 4, then the display area corresponding to that specific clothing treatment machine can be displayed more prominently relative to the display areas that correspond to the other clothing treatment machines (e.g., such as by magnification the display area, highlighting effects, increase brightness, display at a center area, etc.).

Figure 23:
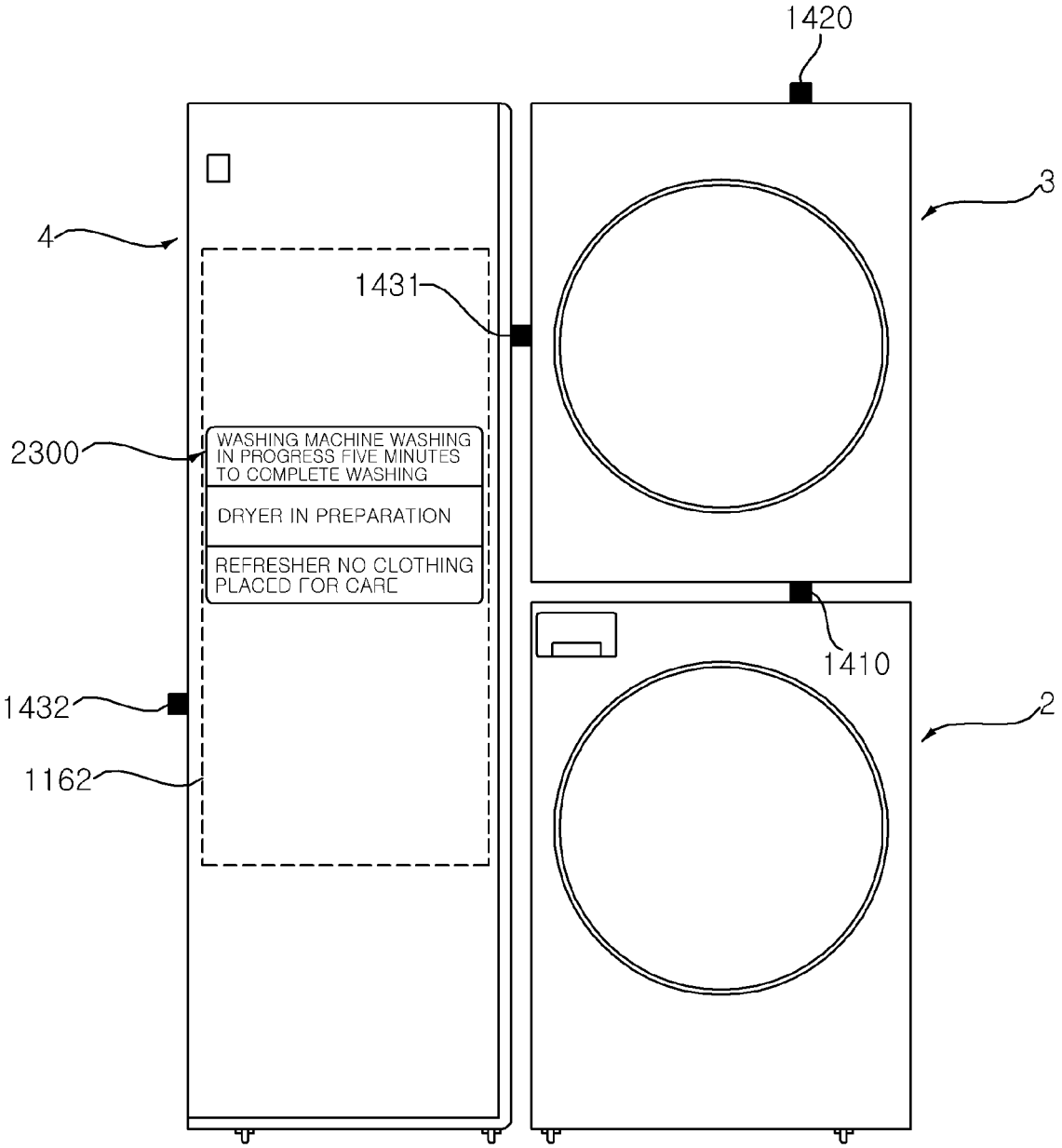

Referring to FIG. 23, when a user approaches nearby the clothing treatment apparatus 1, proximity of the user can be sensed and the display 1162 can display current state information 2300 of the respective clothing treatment machines 2, 3, and 4.

According to at least one of the embodiments of the present disclosure, communications and operations of the clothing treatment machines 2, 3, and 4 are integrated, thereby improving user convenience.

According to at least one of the embodiments of the present disclosure, information visibility is improved, and information on the overall product operation can be easily identified.

The following is a list of examples:

1. A clothing treatment apparatus comprising: a washing machine including a first case having a first laundry loading opening, a first door for opening and closing the first case, a tub disposed in the first case, and a first drum which is rotatably mounted in the tub and in which laundry is placed; a dryer including a second case vertically disposed with respect to the first case and having a second laundry loading opening, a second door for opening and closing the second case, and a second drum which is rotatably mounted in the second case and in which laundry is placed; and a refresher including a third case disposed at least on one side of the washing machine and the dryer and having an inner space for receiving laundry, and a third door for opening and closing the third case, in which a display is disposed on a front surface of the third door, and displays an operation screen having a plurality of menu buttons for operating the washing machine, the dryer, and the refresher, in which arrangement positions of the plurality of menu buttons on the operation screen vary according to arrangement of the washing machine, the dryer, and the refresher.

2. The clothing treatment apparatus of example 1, in which each of the washing machine, the dryer, and the refresher comprises a position sensor for sensing other adjacent clothing treatment machines, in which the arrangement positions of the plurality of menu buttons are automatically changed based on data sensed by the position sensors.

3. The clothing treatment apparatus of example 2, in which the refresher comprises a first position sensor disposed on a left side thereof and a second position sensor disposed on a right side thereof, the first position sensor and the second position sensor being disposed at different heights, in which each of the washing machine and the dryer comprises side panels forming a left side and a right side, in which an object to be sensed, which is sensed by the first and second position sensors, is disposed on the left and right side panels.

4. The clothing treatment apparatus of example 2, in which a distance between the first position sensor and the second position sensor is equal to a distance between the object to be sensed, which is disposed on the washing machine, and the object to be sensed which is disposed on the dryer.

5. The clothing treatment apparatus of example 2, in which each of the washing machine and the dryer comprises an upper panel forming an upper surface and a lower panel forming a lower surface, in which: the position sensor is disposed on the upper panel; and the object to be sensed, which is sensed by the position sensors, is disposed on the lower panel.

6. The clothing treatment apparatus of example 1, in which the operation screen comprises a washing machine display area in which menu buttons for operating the washing machine are provided, a dryer display area in which menu buttons for operating the dryer are provided, and a refresher display area in which menu buttons for operating the refresher are provided, in which arrangement of the washing machine display area, the dryer display area, and the refresher display area is identical to arrangement of the washing machine, the dryer, and the refresher.

7. The clothing treatment apparatus of example 6, in which in response to an input to the washing machine, the dryer, or the refresher, the display changes brightness of a display area corresponding to the input, among the washing machine display area, the dryer display area, and the refresher display area.

8. The clothing treatment apparatus of example 7, in which in response to an input to the washing machine, the dryer, or the refresher, an internal LED provided for the washing machine, the dryer, or the refresher is turned on.

9. The clothing treatment apparatus of example 6, in which in response to an input to the washing machine, the dryer, or the refresher, the display displays only a display area corresponding to the input, among the washing machine display area, the dryer display area, and the refresher display area.

10. The clothing treatment apparatus of example 6, in which in response to an input to the washing machine, the dryer, or the refresher, the display enlarges only a display area corresponding to the input, among the washing machine display area, the dryer display area, and the refresher display area.

11. The clothing treatment apparatus of example 1, further comprising a control panel disposed between the washing machine and the dryer.

12. The clothing treatment apparatus of example 1, in which each of the washing machine, the dryer, and the refresher comprises one or more communication modules to communicate with each other by wire or wirelessly, in which at least one of the washing machine, the dryer, and the refresher wirelessly communicates with an external device.

13. The clothing treatment apparatus of example 1, further comprising a heating device for heating air, in which the heated air is supplied to at least one of the washing machine, the dryer, and the refresher.

14. The clothing treatment apparatus of example 13, further comprising a machine room forming a space in which the heating device is disposed, in which the machine room is disposed between the first drum and the second drum.

15. The clothing treatment apparatus of example 13, further comprising a machine room forming a space in which the heating device is disposed, in which the machine room is disposed under the washing machine or the dryer.

16. A clothing treatment apparatus comprising: a washing machine including a first case having a first laundry loading opening, a first door for opening and closing the first case, a tub disposed in the first case, and a first drum which is rotatably mounted in the tub and in which laundry is placed; a dryer including a second case vertically disposed with respect to the first case and having a second laundry loading opening, a second door for opening and closing the second case, and a second drum which is rotatably mounted in the second case and in which laundry is placed; a refresher including a third case disposed at least on one side of the washing machine and the dryer and having an inner space for receiving laundry, and a third door for opening and closing the third case; and a control panel displaying an operation screen having a plurality of menu buttons for operating the washing machine, the dryer, and the refresher, in which arrangement positions of the plurality of menu buttons on the operation screen vary according to arrangement of the washing machine, the dryer, and the refresher.

17. The clothing treatment apparatus of example 16, in which each of the washing machine, the dryer, and the refresher comprises a position sensor for sensing other adjacent clothing treatment machines, in which the arrangement positions of the plurality of menu buttons are automatically changed based on data sensed by the position sensors.

18. The laundry treating apparatus of example 16, in which the operation screen comprises a washing machine display area in which menu buttons for operating the washing machine are provided, a dryer display area in which menu buttons for operating the dryer are provided, and a refresher display area in which menu buttons for operating the refresher are provided, in which arrangement of the washing machine display area, the dryer display area, and the refresher display area is identical to arrangement of the washing machine, the dryer, and the refresher.

19. The clothing treatment apparatus of example 18, in which in response to an input to the washing machine, the dryer, or the refresher, the display changes brightness of a display area corresponding to the input, among the washing machine display area, the dryer display area, and the refresher display area.

20. The clothing treatment apparatus of example 16, further comprising a heating device for heating air, in which the heated air is supplied to at least one of the washing machine, the dryer, and the refresher.

21. A clothing treatment apparatus comprising: a washing machine including a first case having a first laundry loading opening, a first door for opening and closing the first case, a tub disposed in the first case, and a first drum which is rotatably mounted in the tub and in which laundry is placed; a dryer including a second case vertically disposed with respect to the first case and having a second laundry loading opening, a second door for opening and closing the second case, and a second drum which is rotatably mounted in the second case and in which laundry is placed; and a refresher including a third case disposed at least on one side of the washing machine and the dryer and having an inner space for receiving laundry, and a third door for opening and closing the third case, in which: each of the washing machine, the dryer, and the refresher comprises one or more communication modules to communicate with each other; and any one clothing treatment machine among the washing machine, the dryer, and the refresher comprises a representative communication module for wireless communication with an external device according to a first communication method, in which the clothing treatment machines, other than the representative clothing treatment machine comprising the representative communication module, communicate by wire or wirelessly with the representative clothing treatment machine.

22. The clothing treatment apparatus of example 21, in which the representative clothing treatment machine and the other clothing treatment machines also communicate wirelessly with each other using the first communication method, in which any one clothing treatment machine among the washing machine, the dryer, and the refresher functions as a wireless router.

23. The clothing treatment apparatus of example 23, in which the representative clothing treatment machine and the other clothing treatment machines communicate with each other using a second communication method which is different from the first communication method.

24. The clothing treatment apparatus of example 23, in which compared to the first communication method, the second communication method is a low power short range wireless communication or wired communication method.

25. The clothing treatment apparatus of example of 21, further comprising a heating device for heating air, in which the heated air is supplied to at least one of the washing machine, the dryer, and the refresher.

26. The clothing treatment apparatus of example 25, in which the heating device comprises a communication module to communicate with the representative clothing treatment machine.

27. The clothing treatment apparatus of example 25, in which the heating device is disposed between the washing machine and the dryer, and is connected by wire with the washing machine and the dryer for wired communication, and wirelessly communicates with the refresher.

28. The clothing treatment apparatus of example 25, further comprising a control panel disposed between the washing machine and the dryer and provided on a front surface of the heating device, in which the control panel and the heating device are connected by wire for wired communication.

29. The clothing treatment apparatus of example 25, in which the heating device is disposed under the washing machine or the dryer, and communicates wirelessly with the washing machine, the dryer, and the refresher.

30. The clothing treatment apparatus of example 21, in which when not in use, the representative clothing treatment machine and the other clothing treatment machines are turned off.

31. The clothing treatment apparatus of example 21, in which a display is disposed on a front surface of the third door, and displays an operation screen having a plurality of menu buttons for operating the washing machine, the dryer, and the refresher, in which arrangement positions of the plurality of menu buttons on the operation screen vary according to arrangement of the washing machine, the dryer, and the refresher.

32. A clothing treatment apparatus comprising: a washing machine including a first case having a first laundry loading opening, a first door for opening and closing the first case, a tub disposed in the first case, and a first drum which is rotatably mounted in the tub and in which laundry is placed; a dryer including a second case vertically disposed with respect to the first case and having a second laundry loading opening, a second door for opening and closing the second case, and a second drum which is rotatably mounted in the second case and in which laundry is placed; and a refresher including a third case disposed at least on one side of the washing machine and the dryer and having an inner space for receiving laundry, and a third door for opening and closing the third case; and a heating device for heating air, in which: the air heated by the heating device is supplied to at least one of the washing machine, the dryer, and the refresher; each of the washing machine, the dryer, the refresher, and the heating device comprises one or more communication modules to communicate with each other; and any one clothing treatment machine among the washing machine, the dryer, the refresher, and the heating device comprises a representative communication module for wireless communication with an external device according to a first communication method, in which the clothing treatment machines, other than the representative clothing treatment machine comprising the representative communication module, communicate by wire or wirelessly with the representative clothing treatment machine.

33. The clothing treatment apparatus of example 32, in which the representative clothing treatment machine and the other clothing treatment machines also communicate wirelessly with each other using the first communication method, in which any one clothing treatment machine among the washing machine, the dryer, the refresher, and the heating device functions as a wireless router.

34. The clothing treatment apparatus of example 32, in which the representative clothing treatment machine and the other clothing treatment machines communicate with each other using a second communication method which is different from the first communication method.

35. The clothing treatment apparatus of example 34, in which compared to the first communication method, the second communication method is a low power short range wireless communication or wired communication method.

36. The clothing treatment apparatus of example 32, in which the heating device is disposed between, the heating device is disposed between the washing machine and the dryer, and is connected by wire with the washing machine and the dryer for wired communication, and wirelessly communicates with the refresher.

37. The clothing treatment apparatus of example 32, further comprising a control panel disposed between the washing machine and the dryer and provided on a front surface of the heating device, in which the control panel and the heating device are connected by wire for wired communication.

38. The clothing treatment apparatus of example 25, in which the heating device is disposed under the washing machine or the dryer, and communicates wirelessly with the washing machine, the dryer, and the refresher.

39. The clothing treatment apparatus of example 32, in which when not in use, the representative clothing treatment machine and the other clothing treatment machines are turned off.

40. The clothing treatment apparatus of example 32, in which a display is disposed on a front surface of the third door, and displays an operation screen having a plurality of menu buttons for operating the washing machine, the dryer, and the refresher, in which arrangement positions of the plurality of menu buttons on the operation screen vary according to arrangement of the washing machine, the dryer, and the refresher.

It will be apparent to those skilled in the art that various modifications and variations can be made in the present invention without departing from the spirit or scope of the invention. Thus, it is intended that the present disclosure cover the modifications and variations of this invention provided they come within the scope of the appended claims and their equivalents.

Certain embodiments or other embodiments of the disclosure described above are not mutually exclusive or distinct from each other. Any or all elements of the embodiments of the disclosure described above can be combined with another or combined with each other in configuration or function.

For example, a configuration "A" described in one embodiment of the disclosure and the drawings and a configuration "B" described in another embodiment of the disclosure and the drawings can be combined with each other. Namely, although the combination between the configurations is not directly described, the combination is possible except in the case where it is described that the combination is impossible.

The foregoing embodiments are merely examples and are not to be considered as limiting the present disclosure. The scope of the present disclosure should be determined by rational interpretation of the appended claims, and all modifications within the equivalents of the disclosure are intended to be included within the scope of the present disclosure.

What is claimed is:

1. A clothing treatment apparatus comprising:

a washing machine including:

a first case having a first laundry loading opening, a first door for opening and closing the first case, a tub disposed in the first case, and a first drum rotatably mounted in the tub for washing laundry;

a dryer including:

a second case having a second laundry loading opening, the second case being disposed above or below the first case of the washing machine, a second door for opening and closing the second case, and a second drum rotatably mounted in the second case for drying the laundry;

a refresher including:

a third case disposed at one side of the washing machine and the dryer and having an inner space for receiving the laundry, a third door for opening and closing the third case, and a display disposed on the third door; and a controller configured to:

display, via the display on the third door of the refresher, an operation screen having a plurality of menu buttons for operating the washing machine, the dryer, and the refresher, and vary arrangement positions of the plurality of menu buttons on the operation screen based on a physical arrangement of the washing machine, the dryer and the refresher, wherein the clothing treatment apparatus further comprises:

a plurality of position sensors, each of the plurality of position sensors being configured to sense an adjacent clothing treatment machine, and wherein the controller is further configured to automatically change the arrangement positions of the plurality of menu buttons based on data sensed by the plurality of position sensors.

2. The clothing treatment apparatus of claim 1, wherein the plurality of position sensors include a first position sensor and a second position sensor, wherein the refresher comprises the first position sensor disposed on a left side of the refresher and a second position sensor disposed on a right side of the refresher, the first position sensor being disposed at a first height and the second position sensor being disposed at a second height different than the first height.

3. The clothing treatment apparatus of claim 2, wherein a distance between the first position sensor and the second position sensor corresponds to distance between two points of a stacked structure, the stacked structure including the washing machine stacked on the dryer or the dryer stacked on the washing machine.

4. The clothing treatment apparatus of claim 1, wherein at least one of the plurality of position sensors is disposed on a lower surface of the dryer or the washing machine, and wherein at least one of the plurality of position sensors is disposed on an upper surface of the dryer or the washing machine.

5. The clothing treatment apparatus of claim 1, wherein the operation screen comprises:

a washing machine display area including menu buttons for operating the washing machine, a dryer display area including menu buttons for operating the dryer, and a refresher display area including menu buttons for operating the refresher, wherein arrangement of the washing machine display area, the dryer display area, and the refresher display area matches or corresponds to the physical arrangement of the washing machine, the dryer and the refresher.

6. The clothing treatment apparatus of claim 5, wherein the controller is further configured to:

in response to receiving an input to one of the washing machine display area, the dryer display area or the refresher display area, change a brightness or increase a display area of the one of the washing machine display area, the dryer display area or the refresher display area corresponding to the input.

7. The clothing treatment apparatus of claim 5, wherein the controller is further configured to:

in response to receiving an input to one of the washing machine display area, the dryer display area or the refresher display area, active an internal light emitting diode (LED) within the washing machine, the dryer or the refresher based on the input to the one of the washing machine display area, the dryer display area or the refresher display area.

8. The clothing treatment apparatus of claim 5, wherein the controller is further configured to:

in response to an input to the washing machine, the dryer or the refresher, display only a display area corresponding to the input on the display, from among the washing machine display area, the dryer display area and the refresher display area.

9. The clothing treatment apparatus of claim 5, wherein the controller is further configured to:

in response to an input to the washing machine, the dryer or the refresher, enlarge or visually emphasize a display area corresponding to the input, from among the washing machine display area, the dryer display area and the refresher display area.

10. The clothing treatment apparatus of claim 1, wherein each of the washing machine, the dryer, and the refresher comprises one or more communication modules configured to communicate with each other by wire or wirelessly, wherein any one clothing treatment machine among the washing machine, the dryer, and the refresher comprises a representative communication module for wireless communication with an external device according to a first communication method, and wherein remaining clothing treatment machines among the washing machine, the dryer, and the refresher, other than the representative clothing treatment machine comprising the representative communication module, communicate with the representative clothing treatment machine by using the first communication method or a second communication different from the first communication method.

11. The clothing treatment apparatus of claim 10, wherein at least one of the washing machine, the dryer and the refresher is configured to function as a wireless router.

12. The clothing treatment apparatus of claim 1, further comprising:

a heating device configured to generate heated air, wherein the heated air is supplied to one or more of the washing machine, the dryer, and the refresher.

13. The clothing treatment apparatus of claim 12, further comprising a machine room forming a space that houses the heating device, wherein the machine room is disposed between the first drum and the second drum, or the machine room is disposed under the washing machine or the dryer.

14. The clothing treatment apparatus of claim 13, wherein any one clothing treatment machine among the washing machine, the dryer, the refresher and the heating device comprises a representative communication module for wireless communication with an external device according to a first communication method, and wherein remaining clothing treatment machines among the washing machine, the dryer, the refresher and the heating device, other than the representative clothing treatment machine comprising the representative communication module, communicate with the representative clothing treatment machine by using the first communication method or a second communication method different from the first communication method.

15. The clothing treatment apparatus of claim 1, wherein the controller is included in at least one of the washing machine, the dryer and the refresher, or wherein the controller is separate from each of the washing machine, the dryer and the refresher.

16. A clothing treatment apparatus comprising:

a washing machine including:

a first case having a first laundry loading opening, a first door for opening and closing the first case, a tub disposed in the first case, and a first drum rotatably mounted in the tub for washing laundry;

a dryer including:

a second case vertically disposed with respect to the first case and having a second laundry loading opening, a second door for opening and closing the second case, and a second drum rotatably mounted in the second case for drying the laundry;

a refresher including:

a third case disposed at one side of the washing machine and the dryer and having an inner space for receiving the laundry, and a third door for opening and closing the third case; and a control panel configured to display an operation screen having a plurality of menu buttons for operating the washing machine, the dryer and the refresher, wherein arrangement positions of the plurality of menu buttons on the operation screen vary according to a physical arrangement of the washing machine, the dryer and the refresher, wherein the clothing treatment apparatus further comprises:

a plurality of position sensors, each of the plurality of position sensors being configured to sense an adjacent clothing treatment machine, and wherein the arrangement positions of the plurality of menu buttons are automatically changed based on data sensed by the plurality of position sensors.

17. The clothing treatment apparatus of claim 16, wherein the operation screen comprises:

a washing machine display area including menu buttons for operating the washing machine, a dryer display area including menu buttons for operating the dryer, and a refresher display area including menu buttons for operating the refresher are provided, and wherein an arrangement of the washing machine display area, the dryer display area, and the refresher display area matches or corresponds to the physical arrangement of the washing machine, the dryer and the refresher.

18. The clothing treatment apparatus of claim 16, wherein the washing machine, the dryer and the refresher include one or more communication modules to communicate with each other, wherein any one clothing treatment machine among the washing machine, the dryer and the refresher comprises a representative communication module configured to wirelessly communicate with an external device according to a first communication method, wherein remaining clothing treatment machines among the washing machine, the dryer and the refresher, other than the representative clothing treatment machine comprising the representative communication module, are configured to communicate with the representative clothing treatment machine by using the first communication method or a second communication method different from the first communication method.

19. The clothing treatment apparatus of claim 16, further comprising:

a heating device for heating air supplied to at least one of the washing machine, the dryer and the refresher, wherein any one clothing treatment machine among the washing machine, the dryer, the refresher and the heating device comprises a representative communication module configured to wirelessly communicate with an external device according to a first communication method, and wherein remaining clothing treatment machines among the washing machine, the dryer, the refresher and the heating device, other than the representative clothing treatment machine comprising the representative communication module, are configured to communicate with the representative clothing treatment machine by using the first communication method or a second communication method different from the first communication method.

* * * * *